US010053934B2

(12) United States Patent
Keogh et al.

(10) Patent No.: US 10,053,934 B2
(45) Date of Patent: Aug. 21, 2018

(54) FLOOR MOUNTED RACKING ARM FOR HANDLING DRILL PIPE

(71) Applicant: National Oilwell Varco, L.P., Houston, TX (US)

(72) Inventors: Gregory Keogh, Houston, TX (US); Baldwin Zahn, Tomball, TX (US); Christopher Yeldell, Sugar Land, TX (US); Albert Koether, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 470 days.

(21) Appl. No.: 14/563,678

(22) Filed: Dec. 8, 2014

(65) Prior Publication Data

US 2016/0160586 A1 Jun. 9, 2016

(51) Int. Cl.
*E21B 19/00* (2006.01)
*E21B 19/14* (2006.01)
*E21B 19/24* (2006.01)

(52) U.S. Cl.
CPC ..... *E21B 19/14* (2013.01); *E21B 19/24* (2013.01)

(58) Field of Classification Search
CPC ..... E21B 19/14; E21B 19/24; E21B 19/15; E21B 19/155
USPC ..... 414/22.51–22.71
See application file for complete search history.

(56) References Cited

U.S. PATENT DOCUMENTS 3,467,262 A 9/1969 Reed
3,840,128 A 10/1974 Swoboda, Jr. et al.
4,274,778 A * 6/1981 Putnam ..... B25J 9/0084 175/85
4,615,656 A * 10/1986 Geraghty, Jr. ..... B66F 9/18 294/103.1
4,621,974 A * 11/1986 Krueger ..... E21B 19/20 211/70.4

(Continued)

FOREIGN PATENT DOCUMENTS

WO 2014144995 A1 9/2014

OTHER PUBLICATIONS

National Oilwell Varco Rotary and Handling Tools Catalog, 2013 Land and Offshore, 2013.

(Continued)

*Primary Examiner* — Anna M Momper
*Assistant Examiner* — Lynn E Schwenning
(74) *Attorney, Agent, or Firm* — Amerson Law Firm, PLLC

(57) ABSTRACT

A racking arm assembly is adapted to be mounted on a drill floor of a drilling rig and includes a lift arm assembly having a first arm that is movably coupled to a vertical support column, wherein the lift arm assembly is adapted to be raised and lowered along a vertical length of the vertical support column during a pipe handling operation. A lift jaw assembly is pivotably coupled to a second arm of the lift arm assembly and includes a lift jaw assembly having a lift jaw gripping apparatus that is adapted to grip and fixedly hold a drill pipe stand proximate a pin end of the drill pipe stand during the pipe handling operation. The lift jaw gripping apparatus is further adapted to be rotated relative to the lift arm assembly about a substantially horizontal axis while the lift jaw gripping apparatus is fixedly holding the drill pipe stand.

31 Claims, 48 Drawing Sheets

(56) References Cited

U.S. PATENT DOCUMENTS

| | | | | |
|---|---|---|---|---|
| 4,696,207 | A | 9/1987 | Boyadjieff | |
| 4,715,761 | A | 12/1987 | Berry et al. | |
| 4,765,401 | A | 8/1988 | Boyadjieff | |
| 6,543,551 | B1 | 4/2003 | Sparks et al. | |
| 6,821,071 | B2 | 11/2004 | Woolslayer et al. | |
| 7,083,007 | B2 | 8/2006 | Herst | |
| 7,246,983 | B2 | 7/2007 | Zahn et al. | |
| 8,317,448 | B2 | 11/2012 | Hankins et al. | |
| 8,550,761 | B2 | 10/2013 | Belik et al. | |
| 8,814,487 | B2 | 8/2014 | Yater et al. | |
| 2008/0164064 | A1 | 7/2008 | Belik et al. | |
| 2010/0303586 | A1 | 12/2010 | Hankins et al. | |
| 2011/0079434 | A1* | 4/2011 | Belik ..... | E21B 19/14 175/57 |
| 2014/0202769 | A1 | 7/2014 | Magnuson | |

OTHER PUBLICATIONS

National Oilwell Varco Product Data Sheet, Bridge Racker, Atlantic Star, 2005.
National Oilwell Varco General Arrangement Drawing, Bridge Racker, Atlantic Star, 2005-06.
National Oilwell Varco Brochure, Vertical Pipe Handling—Offshore, Bridge Racker Systems.
National Oilwell Varco Brochure, Pipe Handling Solutions, 2012.
National Oilwell Varco Technical Marketing Sheet, Pipe Handling—Column Rackers.
National Oilwell Varco Service Manual, PRS-8i Pipe Racking System, Jan. 2005.
National Oilwell Varco Brochure, Pipe Racking System—PRS-8i, 2013.

* cited by examiner

FLOOR MOUNTED RACKING ARM FOR HANDLING DRILL PIPE

BACKGROUND

1. Field of the Disclosure

The present disclosure is generally directed to methods and apparatuses for handling drill pipe and other tubular members during drilling and/or workover operations of a well, and in particular to a drill floor mounted racking arm for lifting and positioning drill pipe stands.

2. Description of the Related Art

Drilling masts are vertical structures that are commonly used to support a drill string while a well is being drilled. Drilling masts usually have a relatively compact, rectangular footprint, as opposed to a derrick structure, which typically has a steep pyramidal shape. The rectangular shape of the typical drilling mast also offers relatively good overall stiffness, which allows the mast to be lowered to a horizontal position. The compact, rectangular shape of the drilling mast structure therefore facilitates transportation of the drilling rig over surface roads, many times without the need for obtaining special shipping permits, and thereby making drilling masts very common on portable land-based (onshore) drilling rigs. FIG. 1A shows an elevation view of an illustrative portable land-based drilling rig 1 having a drilling mast 2.

During typical drilling operations, a string of drill pipe—shown as reference number 6 in FIG. 1A—which may have a drill bit or other equipment mounted on the lower end thereof, may be suspended from a traveling block 3 and top drive assembly 4 in the drilling mast 2. As may be required for certain drilling operations, the top drive 4 assembly imparts a rotational force to the drill string 6, thereby turning the drill bit and advancing the depth of the drilled wellbore. As the depth of the wellbore increases, additional lengths of drill pipe are added to the drill string 6 at the surface.

Due to the relatively compact footprint that may be associated with drilling mast structures, there may be very limited space available for storing the drill pipe and other tubular members adjacent to the drilling mast 2. Therefore, in many cases, the drill pipe is usually vertically staged in a specially designed structural assembly—often referred to as a racking board or fingerboard 5—that is attached to the drilling mast 2, as shown in FIG. 1A. The fingerboard 5 is designed to facilitate the vertical arrangement of the various sections of drill pipe that are used during the drilling operations. While the fingerboard 5 is commonly attached directly to the drilling mast 2, it may be positioned many feet—for example, 75 feet or more—above the drill floor 7, depending on the length of the various sections of staged drill pipe. FIGS. 1B and 1C show a close-up elevation view and a plan view, respectively, of the position of the fingerboard 5 relative to the drilling mast 2, the traveling block 3, the top drive assembly 4, and the drill string 6.

"Tripping" is a term of art used in drilling operations that generally refers to acts of either adding multiple joints of drill pipe to, or removing multiple joints of drill pipe from, a drilled wellbore. Oftentimes during the drilling operations, tripping operations may be performed wherein the drill string 6 is pulled from the wellbore in order to change the drill bit, or to run various other types of equipment, such as testing equipment and the like, into the wellbore on the end of the drill string 6. When tripping drill pipe out of the wellbore, a drill pipe elevator, which is typically suspended from the traveling block 3/top drive assembly 4 by pipe-handler links 4*a* (see, FIG. 1B), is removably coupled to the upper end, or box end, of the drill string, and the elevator is raised by the traveling block 3/top drive assembly 4 until a "stand" of drill pipe (i.e., one or more sections, or joints, of drill pipe) extends above the drilling rig floor. Depending on the size of the drilling rig mast and/or the target depth of the drilling operations, a stand of drill pipe that is added to or removed from the drill string may include anywhere from one to three joints of drill pipe, where each joint has a "random" length of approximately 30-35 feet. However, in most modern land-based rigs, a stand of drill pipe often includes two (doubles) or three (triples) joints of drill pipe, with the most common drill pipe stand configuration including three joints of drill pipe, totaling approximately 90-100 feet in length. Thereafter, slips are placed between the string of drill pipe and the drilling rig floor in order to suspend the drill string 6 in and above the wellbore from a point beneath the bottom threaded joint of the stand of drill pipe that is to be removed from the drill string. In this position, the drill string 6 suspended by the slips extends above the drill floor 7, and the box end of the string 6 is positioned above the plane of the fingerboard 5, which, as noted previously, may be located 75 feet or more above the drill floor 7.

Once the drill string 6 has been suspended with its box end positioned above the fingerboard 5, the threaded connection between the stand of drill pipe and the remainder of the drill string 6 is then unthreaded, and the lower end, or pin end, of the stand is guided away from the remainder of the drill string 6 and wellbore and positioned above a support pad—sometimes referred to as a setback—on the drill floor 7. Once the pin end of the removed drill pipe stand is positioned above the setback, the traveling block 3 is lowered until the weight of the stand is supported on the setback by the pin end. Next, the box end of the drill pipe is uncoupled from the elevator and the box end of the stand is guided to the fingerboard 5 where it is staged between a set of racking fingers 8 (see FIG. 1C) in a substantially vertical orientation. In this position, the box end of the removed stand of drill pipe remains a few feet above the plane 5*p* of the fingerboard 5. The top drive assembly 4 is then lowered by the traveling block 3 to the box end of the drill string 6 that is suspended by the slips in the wellbore and the elevator is again coupled to the drill string 6. Thereafter, the drill string 6 is once again lifted to a position where the box end is positioned above the plane 5*p* of the fingerboard 5, and the process is repeated until all of the sections of pipe—e.g., in three joint stands—are supported by their respective pin ends on the setback, with their respective box ends being constrained between pairs of racking fingers 8 on the fingerboard 5. When a new drill bit or other type of tool is being run into the well, the above-described tripping process is reversed and repeated, as the pin end of each stand of drill pipe is threaded into the box end of the drill string 6 suspended by the slips at the drill floor 7, and the drill string 6 is lowered until the drill bit or other tool reaches a desired depth in the wellbore.

On many land-based (onshore) drilling rigs, the movement and guidance of the stands of drill pipe to and from the setback area of the drill floor 7, as well as to and from the traveling block 3/top drive assembly 4 to the racking fingers 8 of the fingerboard 5, has historically been performed manually by the various rig personnel, who may pull and/or push the drill pipe to its proper staging location. However, it is generally well understood that such guidance and movement of large sections of drill pipe may involve a variety of handling difficulties, particularly as drilling rigs have become larger and wellbore depths have become greater—factors which can often lead to larger diameter drill pipe, and longer and heavier drill pipe stands. For example, as the length of drill pipe stands increases, such as with doubles and triples, they can become more susceptible to swaying when supported from the uppermost box end by the traveling block 3/top drive 4, due to various operational and/or environmental conditions (e.g., wind, etc.). In such cases, manual guidance and control of the lowermost pin end of the drill pipe stand between the wellcenter and the setback can be cumbersome and difficult, due to the momentum of the swaying drill pipe stand. Furthermore, maneuvering the upper end of the drill pipe stand to or from its proper staging location in the fingerboard 5 generally requires manually uncoupling the box end of the stand from (or manually coupling the box end to) the drill pipe elevator, and manually moving the upper end of the stand of drill pipe from its location at or near the centerline 9 of the well (i.e., the wellcenter) over to and into the racking fingers 8 of the fingerboard 5, and vice versa. In order to enable rig personnel to perform these coupling, uncoupling, and movement activities, the fingerboard 5 usually includes access platforms 10 adjacent to and surrounding the racking fingers 8. The fingerboard 5 may also sometimes include an additional access platform 11, sometimes referred to as a diving board 11, in order to facilitate easier access to the elevator, the traveling block 3, the top drive assembly 4, and/or the drill string 6. In most cases, the diving board 11 is configured so as to run down the center of the fingerboard 5—i.e., between rows of racking fingers 8—and extend away from the fingerboard 5 and toward the centerline 9 of the well, as shown in FIG. 1C. Additionally, the diving board 11 sometimes includes a hinged extension section 11*a*, which can be folded out for closer access to the centerline 9 of the well, or folded back to provide more clearance between the traveling block 3 or top drive assembly 4 and the diving board 11 during some rig operations.

In order to increase overall efficiency and consistency in handling drill pipe during the time-consuming—and thus costly—tripping operations, various prior art mechanical systems have been developed to lift and/or guide the stands of drill pipe between the wellcenter and the setback and fingerboard 5, thus freeing up at least some rig personnel to perform or monitor other rig operations. For example, FIGS. 2A-2C are various isometric views of one prior art mechanical pipe handling system 20 that has been used in some drilling applications to handle and move drill pipe stands during tripping operations.

FIG. 2A is an isometric view of a pipe handling system 20, which includes a vertical support 21 that supports an upper arm assembly 22*a* and a lower arm assembly 22*b*. The upper arm assembly 22*a* includes a lift jaw assembly 26*a* that is used to grip an upper end of a stand 50 of drill pipe, i.e., near the box end 50*b*, and to fixedly hold and guide the drill pipe stand 50 as it is moved around during drilling operations. Furthermore, the upper arm assembly 22*a* can be raised and lowered along the vertical height of the vertical column 21 by a hoist carriage 33, as will be further described below. The lower (tailing) arm assembly 22*b* includes a guide claw assembly 26*b* that is used to capture (but not grip) and guide the lower end of the drill pipe stand 50, i.e., near the pin end 50*p*, during movement of the stand 50, and as the stand 50 is being raised or lowered by the upper arm assembly 22*a* and lift jaw assembly 26*a*.

The pipe handling system 20 also includes a floor track 23*b* that is fixed to the drill floor of a drilling rig, i.e., to the setback area, and the lower end of the vertical column 21 includes a lower drive assembly 24*b* that is operatively coupled to the floor track 23*b*. Additionally, an upper track 23*a* is coupled to and positioned in front of a fingerboard 25, or between a pair of fingerboards 25, that extend laterally away from the upper track 23*a*, and the upper end of the vertical column 21 includes an upper drive assembly 24*a* that is operatively coupled to the upper track 23*a*. The fingerboards 25 are typically fixed to the rig mast or derrick, or to a structure positioned adjacent to the mast or derrick, depending on the type of drilling rig on which the pipe handling system 20 is used. During pipe handling operations, the upper and lower drive assemblies 24*a*, 24*b* are operated in tandem so as to move the vertical column 21 back and forth along the upper track 23*a* and the floor track 23*b*, that is, between or in front of the fingerboards 25 and across the rig setback, as will be described further in conjunction with FIGS. 2B and 2C below. Furthermore, the drive assemblies 24*a*, 24*b* and the track 23*a*, 23*b* are configured so that a vertical axis 21*x* of the vertical column 21 is maintained in a vertical orientation, that is, substantially perpendicular to the drill floor, as the vertical column 21 is moved along the tracks 23*a*, 23*b*.

The upper and lower arm assemblies 22*a*, 22*b* are coupled to the vertical column 21 such that each is in the same orientation relative to the vertical axis 21*x*. In this way, the lift jaw assembly 26*a* of the upper arm assembly 22*a* is always positioned directly vertically above the guide claw assembly 26*b* of the lower arm assembly 22*b*, thus enabling the pipe handling system 20 lift and move the drill pipe stand 50 while the stand 50 is maintained in a substantially vertical orientation. A column rotation assembly 39 is positioned at the lower end of the vertical column 21 and above the lower drive assembly 24*b*, and is configured to rotate the vertical column 21 about the vertical axis 21*x* relative to each of the tracks 23*a*, 23*b*. Thus, the drive assemblies 24*a*, 24*b* can be used to move the vertical column 21 along the tracks 23*a*, 23*b* and the column rotation assembly 39 can be used to rotate the column 21 so that the upper and lower arm assemblies 22*a*, 22*b* are properly positioned and orientated for grabbing a drill pipe stand, such as the stand 50, from any position within the fingerboard 25. Once positioned and oriented in this manner, the lift jaw assembly 26*a* is used to grab and fixedly hold the drill pipe stand 50, the hoist carriage 33 is used to raise the upper arm 22*a* so that the pin end 50*p* of the stand 50 is lifted off of the setback, and the lift jaw assembly 26*a* and the guide claw assembly 26*b* are used to guide the stand 50 out of the fingerboard 25 and over to the wellcenter as the vertical column 21 is moved along the tracks 23*a*, 23*b* and rotated into position by the column rotation assembly 39.

After the drill pipe stand 50 is positioned above the wellcenter, the upper arm assembly 22*a* is then lowered by the hoist carriage 33 so that the pin end 50*p* of the stand 50 can be engaged with and threadably coupled to a box end of a drill string that is suspended by slips in the wellbore (not shown in FIGS. 2A-2C). As noted previously, the guide claw assembly 26*b* captures, but does not grip, the drill pipe stand 50, and therefore does not restrict the vertical (up and down) movement of the stand 50 during raising and lowering operations. Accordingly, during this stand lowering operation, the stand 50 simply slides through the guide claw assembly 26*b*. Once the stand 50 has been threadably coupled to the drill string, a drill pipe elevator (not shown) that is supported from a traveling block/top drive assembly (not shown) is coupled to the box end 50*b* of the drill pipe stand 50, the lift jaw assembly 26*a* releases its grip on the stand 50, the upper and lower arm assemblies 22*a*, 22*b* are retracted so that the lift jaw assembly 26*a* and the guide claw assembly 26*b* are moved away from the stand 50 and the slips are removed from the drill string. Thereafter, the drill string with the newly attached drill pipe stand 50 is lowered into the wellbore by the traveling block/top drive assembly, or in some operations the drill sting can be lowered using the pipe handling system 20, after which the slips are reset and the process repeated for the next drill pipe stand 50.

FIGS. 2B and 2C are close-up isometric views of the lower arm assembly 22*b* and the upper arm assembly 22*a*, respectively, and show some additional detailed aspects of the prior art pipe handling system 20. As shown in FIG. 2B, the pipe handling system 20 includes a horizontal travel motor 29 that is coupled to a gearbox 30, which is used to drive a vertical driveshaft (not shown) that extends upward inside of the vertical column 21. The vertical driveshaft is coupled to and used to drive the upper drive assembly 24*a*, which includes an upper drive shaft (not shown) that is coupled to the upper end of the vertical drive shaft. The vertical drive shaft drives an upper drive pinion gear (not shown), which in turn engages an upper track gear rack 32*a* (see, FIG. 2C) so as to move the upper end of the vertical column 21 along the upper track 23*a*. The gearbox 30 is also coupled to the lower drive assembly 24*b*, which includes a lower drive shaft (not shown), which is used to drive a lower drive pinion gear 31*b* that engages a floor track gear rack 32*b* and moves the lower end of the vertical column 21 along the floor track 23*b*. Therefore, since the upper and lower drive assemblies 24*a* and 24*b* are driven simultaneously by the horizontal travel motor 29, they are appropriately geared so as to allow the vertical column 21 to remain vertical during it horizontal movement along the tracks 23*a* and 23*b*.

The column rotation assembly 39 includes a rotation drive motor 28 that is coupled to rotation drive pinion gear (not shown), which in turn engages a rotation drive ring gear (not shown) so as to rotate the vertical column 21 about the column axis 21*x*, as is required to orient the upper and lower arm assemblies 22*a*, 22*b* during pipe handling operations. A lower arm extension cylinder 27*b* is pivotably coupled to the vertical column 21 and the lower arm assembly 23*b*. The extension cylinder is used to extend the lower arm assembly 23*b* away from the vertical column 21 so that the guide claw assembly 26*b* can engage and guide the lower end of the drill pipe stand 50, and to retract the lower arm assembly 23*b* back from the drill pipe stand 50 once the stand has been released by the lift jaw assembly 26*a*.

The pipe handling system 20 also includes a pair of wire rope spooling drums 35, each of which is driven by respective hoist motors 36 (one only shown in FIG. 2B). The wire rope 34 that is spooled around each of the drums 35 is sheaved about respective crown sheaves 37 that are coupled to opposing sides of the upper end of the vertical column 21, and about respective wire rope sheaves 38 that are coupled to opposing sides of the hoist carriage 33. See, FIG. 2C. The pair of hoist motors 36 are used to raise and lower the hoist carriage 33 so as to raise and lower the upper arm assembly 22*a*, and to raise and lower the drill pipe stand 50 when it is gripped and fixedly held by the lift jaw assembly 26*a*.

A plurality of upper column rotation guide rollers 40 are coupled to the upper end of the vertical column 21 so as to facilitate the rotation of the vertical column 21 about the column axis 21*x* by the column rotation assembly 39. An upper arm extension cylinder 27*a* is pivotably coupled to the vertical column 21 and the upper arm assembly 23*a*, and is used to extend the upper arm assembly 23*a* away from the vertical column 21 so that the lift jaw assembly 26*a* can grip and guide the upper end of the drill pipe stand 50 during pipe handling operations, and to retract the upper arm assembly 23*a* after the lift jaw assembly 26*a* has released the stand 50.

As shown in FIGS. 2A-2C, the upper and lower arm assemblies 22*a*, 22*b* are positioned on the same side of the vertical column 21. Therefore, both arm assemblies 22*a*, 22*b* will always be oriented in the same direction relative to the column axis 21*x*, irrespective of how the column rotation assembly 39 might rotate the column 21. Furthermore, in order to keep the drill pipe stand 50 in a substantially vertical orientation during pipe handling operations, the lift jaw assembly 26*a* must be positioned directly above the guide claw assembly 26*b*. Therefore, the upper and lower arm assemblies 22*a*, 22*b* must generally be operated in tandem, i.e., together, in order to lift and move drill pipe stands around a drilling rig. As such, it should be appreciated that the upper arm assembly 22*a* cannot be operated independently of the lower arm assembly 22*b* so as to grab and lift an upper end of one drill pipe stand while the lower arm assembly 22*b* is operated to guide a lower end of a different drill pipe stand.

Additionally, as noted above, the floor track 23*b* of the pipe handling system 20 is typically fixed to the drill floor in the setback area and the upper track 23*a* is coupled to the fingerboards 25, which are in turn typically fixed to the rig mast/derrick, or to a structure positioned adjacent to the mast/derrick. As such, when it is not being used for pipe handling operations, the pipe handling system 20 generally cannot be moved off of the drill floor and/or out of the way—other than the vertical column 21 being moved back along the tracks 23*a*, 23*b* and away from the wellcenter—so that drill floor space can be freed up for performing other rig operations. This can be problematic in some applications, particularly for operations performed with portable land-based (onshore) rigs, where drill floor space is at a premium. Therefore, pipe handling systems such as the system 20 are typically used for offshore applications, where the system 20 is an integral part of the overall rig design, and the layout of the drill floor space can be specifically designed around the configuration of the system 20.

The present disclosure directed to methods, systems, and apparatuses that may be used to address of one or more of the design and/or operational issues outlined above.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

The present disclosure is generally directed to methods and apparatuses for handling drill pipe and other tubular members during drilling and/or workover operations of a well, and in particular to a floor mounted racking arm for lifting and positioning drill pipe stands. In one illustrative embodiment, a racking arm assembly is disclosed that is adapted to be mounted on a drill floor of a drilling rig. The racking arm assembly includes a lift arm assembly having a first arm that is movably coupled to a vertical support column, wherein the lift arm assembly is adapted to be raised and lowered along a vertical length of the vertical support column during a pipe handling operation. The illustrative racking arm assembly further includes, among other things, a lift jaw assembly that is pivotably coupled to a second arm of the lift arm assembly, the lift jaw assembly having a lift jaw gripping apparatus that is adapted to grip and fixedly hold a drill pipe stand proximate a pin end of the drill pipe stand during the pipe handling operation. Additionally, the lift jaw gripping apparatus is adapted to be rotated relative to the lift arm assembly about a substantially horizontal axis while the lift jaw gripping apparatus is fixedly holding the drill pipe stand.

In another illustrative embodiment, a floor mounted racking arm assembly is disclosed that includes a pipe handling apparatus conveyance system that is adapted to be removably mounted in a mounting position on a drill floor of a drilling rig. Additionally, a drill floor extension platform is positioned adjacent to the mounting position, wherein the pipe handling apparatus conveyance system is adapted to extend from the mounting position across the drill floor extension platform. The illustrative floor mounted racking arm assembly further includes a movable pipe handling apparatus that is movably coupled to the pipe handling apparatus conveyance system. The movable pipe handling apparatus includes, among other things, a vertical support column rotatably coupled to a column movement carriage, wherein the column movement carriage movably couples the vertical support column to the pipe handling apparatus conveyance system, as well as a lift arm assembly that is movably coupled to the vertical support column, wherein the lift arm assembly is adapted to raise and lower a drill pipe stand during a pipe handling operation. Furthermore, a lift jaw assembly is pivotably coupled to the lift arm assembly, the lift jaw assembly being adapted to grip and fixedly hold a drill pipe stand proximate a pin end of the drill pipe stand during the pipe handling operation. The movable pipe handling apparatus also includes carriage movement means for moving the movable pipe handling apparatus along the pipe handling apparatus conveyance system during the pipe handling operation, wherein the carriage movement means is adapted to retract the pipe handling apparatus conveyance system from the mounting position when the movable pipe handling apparatus is positioned above the drill floor extension platform.

A further exemplary embodiment of the present disclosure is a drilling rig pipe handling system that includes a floor mounted racking arm assembly and an upper pipe handling assembly. The floor mounted racking arm assembly includes, among other things, a pipe handling apparatus conveyance system that is mounted to a drill floor of a drilling rig and a movable pipe handling apparatus that is movably coupled to the pipe handling apparatus conveyance system, wherein the movable pipe handling apparatus is adapted to lift a pin end of a drill pipe stand from a setback area of the drill floor and move the pin end proximate a wellcenter of the drilling rig during a pipe handling operation. The movable pipe handling apparatus includes a lift jaw assembly that is adapted to clamp onto and fixedly hold the drill pipe stand proximate the pin end and a lift arm assembly that is adapted raise and lower the drill pipe stand while the drill pipe stand is fixedly held by the lift jaw assembly. The upper pipe handling assembly is mounted to a drilling mast of the drilling rig in a position that is substantially above the setback area of the drill floor and includes a fingerboard and a drill pipe stand transfer apparatus that is adapted to guide a box end of the drill pipe stand from the fingerboard to the wellcenter of the drilling rig. The lift jaw assembly of the floor mounted racking arm assembly further includes a pinned connection that is adapted to allow a lift jaw gripping apparatus of the lift jaw assembly to pivotably rotate about a substantially horizontal axis to a substantially non-zero misalignment angle relative to a substantially vertical axis while gripping and fixedly holding the pin end of the drill pipe stand when the box end of the drill pipe stand that is being handled by the upper pipe handling assembly is vertically misaligned relative to the pin end.

In another embodiment of the present disclosure, an illustrative lift jaw assembly of a floor mounted racking arm assembly includes, among other things, a lift jaw gripping apparatus that is adapted to grip and fixedly hold a pin end of a substantially vertically oriented drill pipe stand while the drill pipe stand is being raised or lowered by the floor mounted racking arm assembly. The lift jaw gripping apparatus includes a lift jaw frame and a plurality of gripping jaws pivotably coupled to the lift jaw frame, wherein each of the plurality of gripping jaws has a clamping face that is configured to engage with and clamp on an outer diametral surface of a drill pipe stand. Furthermore, the disclosed lift jaw assembly includes a lift jaw support lug that is adapted to couple the lift jaw assembly to a lift arm assembly of the floor mounted racking arm assembly, wherein the lift jaw support lug is pivotably coupled to the lift jaw gripping apparatus at a pinned connection that is adapted to allow the lift jaw gripping apparatus to pivotably rotate about a substantially horizontal axis relative to the lift jaw support lug and the lift arm assembly from a position wherein the gripping jaws are in a substantially vertical orientation by an angle of up to approximately 10°.

Also disclosed herein is an illustrative method for handling drill pipe, wherein the method includes movably coupling a movable pipe handling apparatus to a drill floor of a drilling rig, moving the movable pipe handling apparatus over the drill floor to a position proximate a drill pipe stand positioned in a setback area of the drill floor, and gripping onto and fixedly holding the drill pipe stand with a lift jaw assembly of the movable pipe handling apparatus proximate a pin end of the drill pipe stand, wherein the lift jaw assembly is coupled to a lift arm assembly of the movable pipe handling apparatus. The disclosed drill pipe handling method further includes, among other things, lifting the pin end of the drill pipe stand above the setback area with the lift arm while fixedly holding the drill pipe stand with the lift jaw assembly, moving the movable pipe handling apparatus proximate a wellcenter of the drilling rig while fixedly holding the drill pipe stand with the lift jaw assembly, and positioning the pin end of the drill pipe stand over the wellcenter with the lift arm assembly. Finally, the exemplary method includes maneuvering a box end of the drill pipe stand from a position in a fingerboard mounted to a drilling mast of the drilling rig above the setback area of the drill floor to a position proximate the wellcenter, wherein the box end of the drill pipe stand is vertically misaligned by an angle greater than 0° relative to the pin end of the drill pipe stand while the pin end is being moved proximate the wellcenter by the movable pipe handling apparatus.

BRIEF DESCRIPTION OF THE DRAWINGS

The disclosure may be understood by reference to the following description taken in conjunction with the accompanying drawings, in which like reference numerals identify like elements, and in which.

Figure 1A:
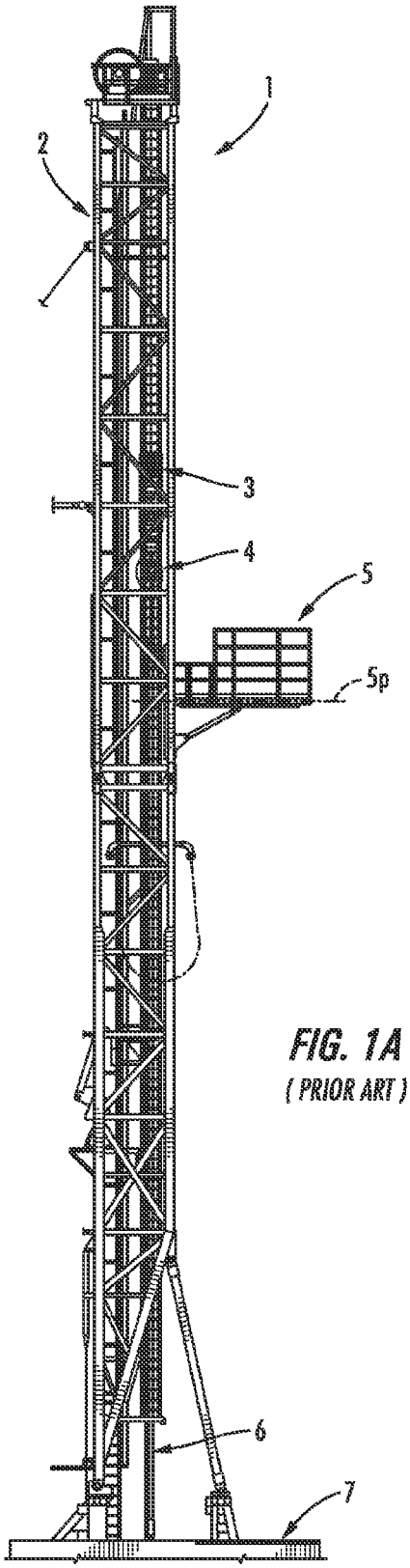
FIG. 1A ( PRIOR ART )
FIGS. 1A-1C are various elevation and plan views of an illustrative drilling rig assembly that includes an exemplary prior art system for manually handling drill pipe stands during drilling operations.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In the following detailed description, various details may be set forth in order to provide a thorough understanding of the various exemplary embodiments disclosed herein. However, it will be clear to one skilled in the art that some illustrative embodiments of the invention may be practiced without some or all of these such various disclosed details. Furthermore, features and/or processes that are well-known in the art may not be described in full detail so as not to unnecessarily obscure the disclosed subject matter. In addition, like or identical reference numerals may be used to identify common or similar elements.

The present invention relates generally to methods and apparatuses for handling drill pipe and other tubular members during drilling and/or workover operations of a well. In certain embodiments, a floor mounted racking arm assembly may be used for lifting and positioning drill pipe stands during drilling operations, e.g., tripping operations and the like. Furthermore, the floor mounted racking arm assembly may be adapted to perform such lifting and positioning operations without the aid or involvement of a traveling block assembly that is mounted in the drilling mast, as would be the case in many prior art piping handling systems. As such, the floor mounted racking arm assembly may perform pipe handling operations "offline" while the traveling block assembly is being used to perform other tripping activities, such as lowering a drill string into a drilled wellbore after another drill pipe stand has been attached so as to lengthen the drill string.

For example, in at least some illustrative embodiments, the floor mounted racking arm assembly may be used to lift and maneuver the pin end, i.e., lower end, of a drill pipe stand while a second pipe handling apparatus, such as a stand transfer apparatus and the like, is simultaneously used to guide and maneuver the box end, i.e., upper end, of the drill pipe stand during handling operations. In other embodiments, the floor mounted racking arm assembly may be operated to lift and maneuver the pin (lower) end of the of the drill pipe stand substantially independently of the guiding or maneuvering handling operation that is being performed on the box (upper) end of the drill pipe stand by stand transfer apparatus. In such embodiments, the drill pipe stand may, at some point, be oriented at a substantially non-zero angle relative to a vertical direction due to a vertical misalignment between the floor mounted racking arm assembly located at the drill floor of the drilling rig and the stand transfer apparatus located at the fingerboard. During some operations, such vertical misalignment may be caused at least in part by the floor mounted racking arm assembly moving the pin end of the drill pipe stand toward the wellcenter either before or after the stand transfer apparatus has begun guiding the box end of the drill pipe from the fingerboard to the wellcenter for coupling to a drill pipe elevator, or by moving the pin end of the drill pipe stand at either a quicker or slower pace than the box end is being moved. Furthermore, in at least some exemplary embodiments, the floor mounted racking arm assembly may sometimes move the pin end of the drill pipe stand to the wellcenter while the box end is still positioned in the fingerboard, whereas in other embodiments, the floor mounted racking arm assembly may not move the pin end back away from the wellcenter until after the stand transfer apparatus has been used to guide the box end back into the fingerboard. Accordingly, a lift jaw assembly of the floor mounted racking arm assembly that is used to clamp onto and/or grip and fixedly hold a drill pipe stand during pipe handling operations may be adapted to allow for such misalignment between the floor mounted racking arm assembly and the stand transfer apparatus (or fingerboard position) by pivoting or twisting about a substantially horizontally oriented axis that is substantially perpendicular to the axis of the drill pipe stand.

Figure 3A:
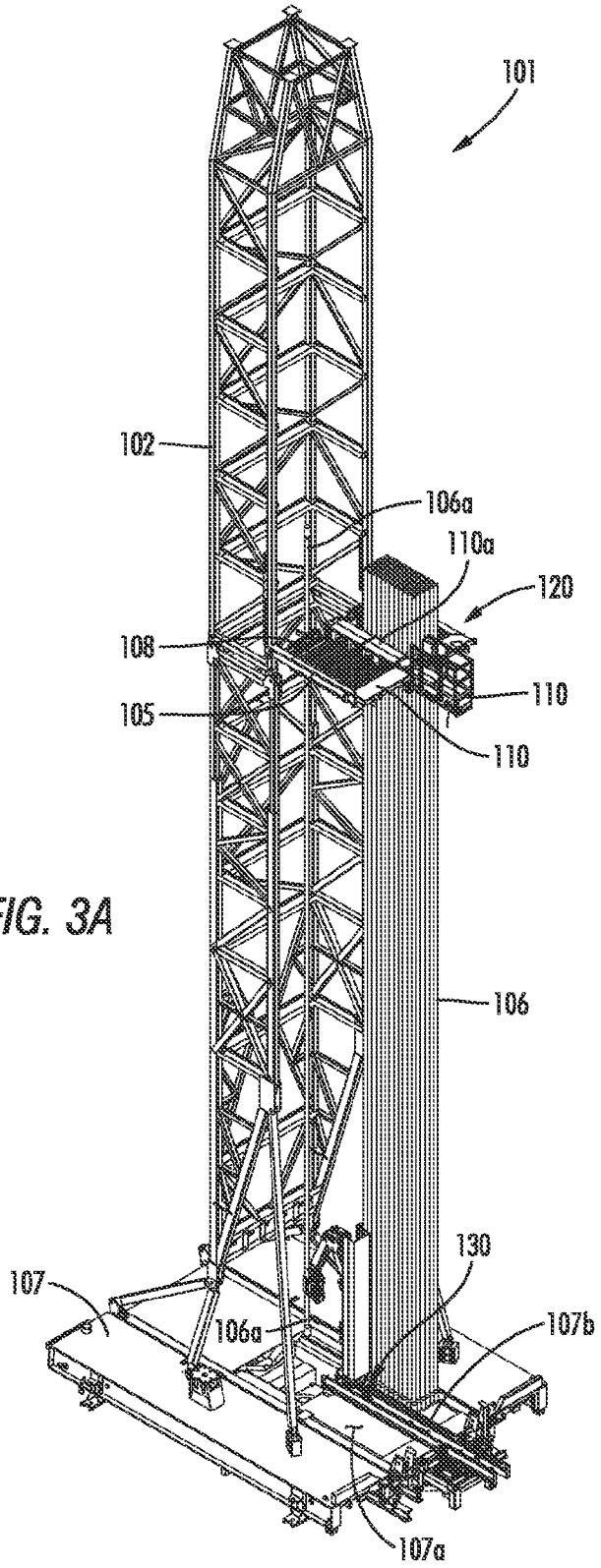
FIGS. 3A and 3B are isometric and elevation views, respectively, of portions of an illustrative drilling rig assembly that utilizes a floor mounted racking arm assembly and an upper pipe handling assembly for handling and moving drill pipe stands during drilling operations in accordance with one exemplary embodiment of the present disclosure.
Figure 3B:
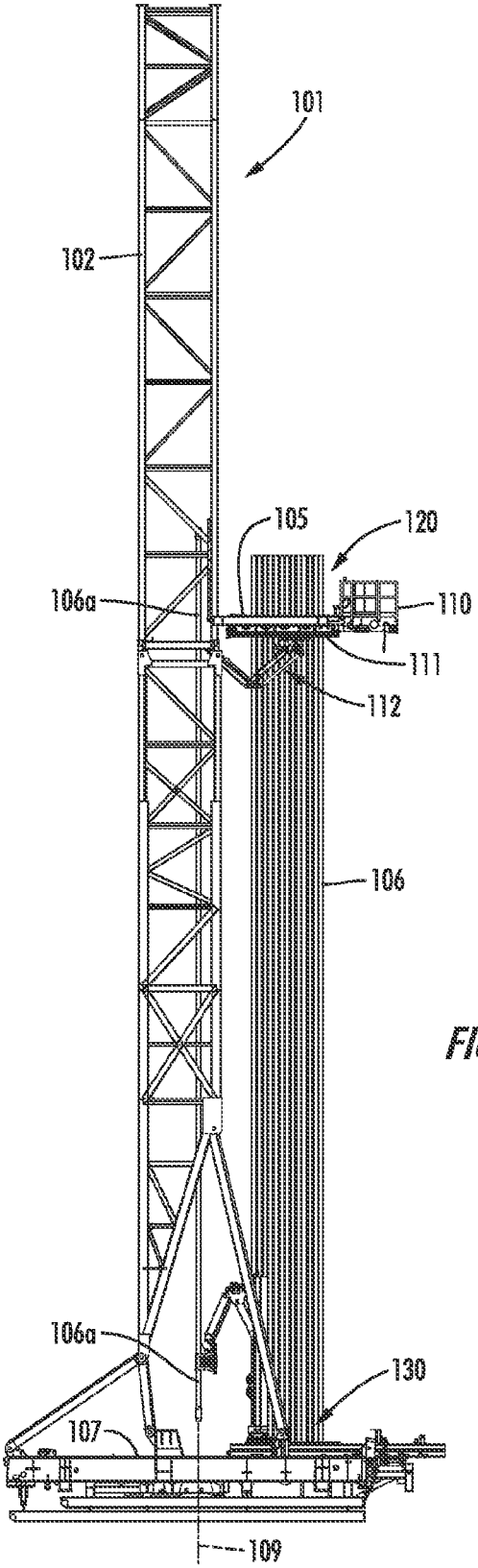

FIGS. 3A and 3B illustrate portions an illustrative drilling rig assembly 101 that utilizes one exemplary embodiment of a floor mounted racking arm assembly 130 for handling and moving drill pipe stands during pipe handling operations. In particular, FIG. 3A is an isometric view of the drilling rig assembly 101 when viewed from the setback and driller's side of the rig assembly 101, and FIG. 3B is an elevation view of the drilling rig assembly 101 when viewed from the driller's side. For simplicity, any rig elements below the drill floor 107, such as the rig substructure and the like, are not shown in FIGS. 3A and 3B.

The drilling rig assembly 101 includes a drilling mast 102, and an upper pipe handling assembly 120 is mounted to the drilling mast 102 substantially directly above the setback area 107*a* of the drill floor 107. In some embodiments, the upper pipe handling assembly 120 may include a fingerboard assembly 105 having a plurality of racking fingers 108, which may be used to facilitate the vertical staging of a plurality of drill pipe stands 106 on the setback area 107*a*. Depending on the lengths of the various sections of staged drill pipe stands 106, the upper pipe handling assembly 120 may be positioned approximately 75 feet or even higher above the drill floor 107.

The upper pipe handling assembly 120 may also include one or more access platforms 110 so as to allow access by drilling rig personnel for monitoring various operations and/or for maintenance purposes and the like. Additionally, a diving board 110*a* may be positioned between the rows of racking fingers 108 so as to run down the center of the fingerboard 105, thus also allowing access across the fingerboard 105 or even over to the wellcenter 109, as may be required. In at least some embodiments, the upper pipe handling assembly 120 may also include a stand transfer apparatus 112 that is movably mounted on a rail or trolley system 111, which in turn may be positioned below the diving board 110*a*, i.e., below the center of the fingerboard 105. In this way, the stand transfer apparatus 112 can be moved back and forth along the trolley system 111 down the center of the fingerboard 105, thus allowing the stand transfer apparatus 112 to capture and move the box end (i.e., upper end) of a given drill pipe stand 106 back and forth from its position between the pairs of racking fingers 108 and the wellcenter 109.

During some stages of pipe handling operations, such as during the initial stages of a tripping in operation or during the latter stages of a tripping out operation, groups of vertically staged drill pipe stands 106 will be positioned in the fingerboard 105 on both sides of the diving board 110*a*, and consequently above both corresponding sides of the setback area 107*a*. During these pipe handling stages, a clear space is therefore typically present in the setback area 107*a* between the groups of drill pipe stands 106, i.e., where no drill pipe stands 106 are stacked, that substantially corresponds to the position of the diving board 110*a* of the upper pipe handling system 120. This clear space in the setback area 107*a*, which is sometimes referred to as an "alleyway" and is designated by reference number 107*b* in FIG. 3A, thereby allows access across the setback area 107*a*, particularly during manual pipe handling operations, so that rig personnel can maneuver and guide the pin end (i.e., the lower end) of a given drill pipe stand 106 from its position on the setback area 107*a* over and into position adjacent to the wellcenter 109. However, for drawing clarity only one group of drill pipe stands 106 is shown in FIGS. 3A and 3B, that is, drill pipe stands 106 are only depicted on the off-driller's side of the fingerboard 105 and on the corresponding off-driller's side of the setback area 107*a*.

Returning now to FIGS. 3A and 3B, an illustrative floor mounted racking arm assembly 130 is positioned on the drill floor 107 of the drilling rig assembly 101. In some embodiments, the floor mounted racking arm assembly 130 may be mounted on the setback area 107*a* such that it is substantially positioned in the alleyway 107*b* running between the groups of vertically staged drill pipe stands 106 (only one group shown in FIGS. 3A and 3B, for clarity). Furthermore, FIGS. 3A and 3B depict a stage of pipe handling operations that may correspond to either a tripping in operation or a tripping out operation.

While the floor mounted racking arm assembly 130 is depicted in the attached figures as being positioned in the alleyway 107*b*, it should be understood by those of ordinary skill after a complete reading of the present disclosure that the racking arm assembly 130 may be mounted on the drill floor 107 in substantially any position that provides adequate access for the racking arm assembly 130 between the staged drill pipe stands 106 in the setback area 107*a* and the wellcenter 109. For example, in certain illustrative embodiments, the racking arm assembly 130 may be positioned on either the driller's side or the off-driller's side of the setback area 107*a*, and oriented in such a fashion so as to run in a direction that is substantially parallel to the alleyway 107*b*—that is, in a direction from the setback side of the drilling rig assembly 101 to the drawworks side. In other embodiments, the racking arm assembly 130 may be positioned between the setback area 107*a* and the wellcenter 109, and oriented so as to run in a direction that is substantially orthogonal, or perpendicular, to the alleyway 107*b*—that is, in a direction from the driller's side of the rig 101 to the off-driller's side. Other positions and orientations may also be used. Furthermore, in at least one embodiment, a plurality of racking arm assemblies 130 may be mounted on the drill floor 107, in a combination of any one of the one or more configurations described above. However, for simplicity, the following description is directed to configurations wherein the floor mounted racking arm assembly 130 is positioned in the alleyway 107*b*, which should not be construed as a limitation on the subject matter described herein, except as may otherwise be specifically indicated in the claims set forth below.

For example, FIGS. 3A and 3B may depict a tripping in operation after the floor mounted racking arm assembly 130 has been used to grab the pin end of a drill pipe stand 106*a* from its position in the setback area 107*a*, lift the pin end off of the drill floor 107, and move the pin end into a position above the wellcenter 109, as will be more fully described in conjunction with FIGS. 9A-9F below. On the other hand, FIGS. 3A and 3B may also depict a tripping out operation after the pin end of the drill pipe stand 106*a* has been unthreaded from a drill string (not shown) suspended by slips in a drilled wellbore (not shown), and the floor mounted racking arm assembly 130 has been used to grab the pin end of the stand 106*a* prior to moving it back to the setback area 107*a* for storage. Similarly, FIGS. 3A and 3B show the drill pipe stand 106*a* after the box (upper) thereof has been captured by the stand transfer apparatus 112 of the upper pipe handling assembly 120 and moved/guided into position above the wellcenter 109 (during a tripping in operation), or before the box end has been moved back into the fingerboard 105 for storage (during a tripping out operation). During a tripping in operation, the pin end of the drill pipe stand 106*a* may then be lowered by the floor mounted racking arm assembly 130 into position above the uppermost box end of the drill string extending out of the wellbore (not shown in FIGS. 3A and 3B) so that the drill pipe stand 106*a* can be threadably engaged to the drill string so as to lengthen the drill string in the manner previously described. Thereafter, a drill pipe elevator suspended from a traveling block (not shown) in the drilling mast 102 may be coupled to the box end of the drill pipe stand 106*a* and the lengthened drill pipe stand may then be lowered into the drilled wellbore, as previously described.

Figure 4:
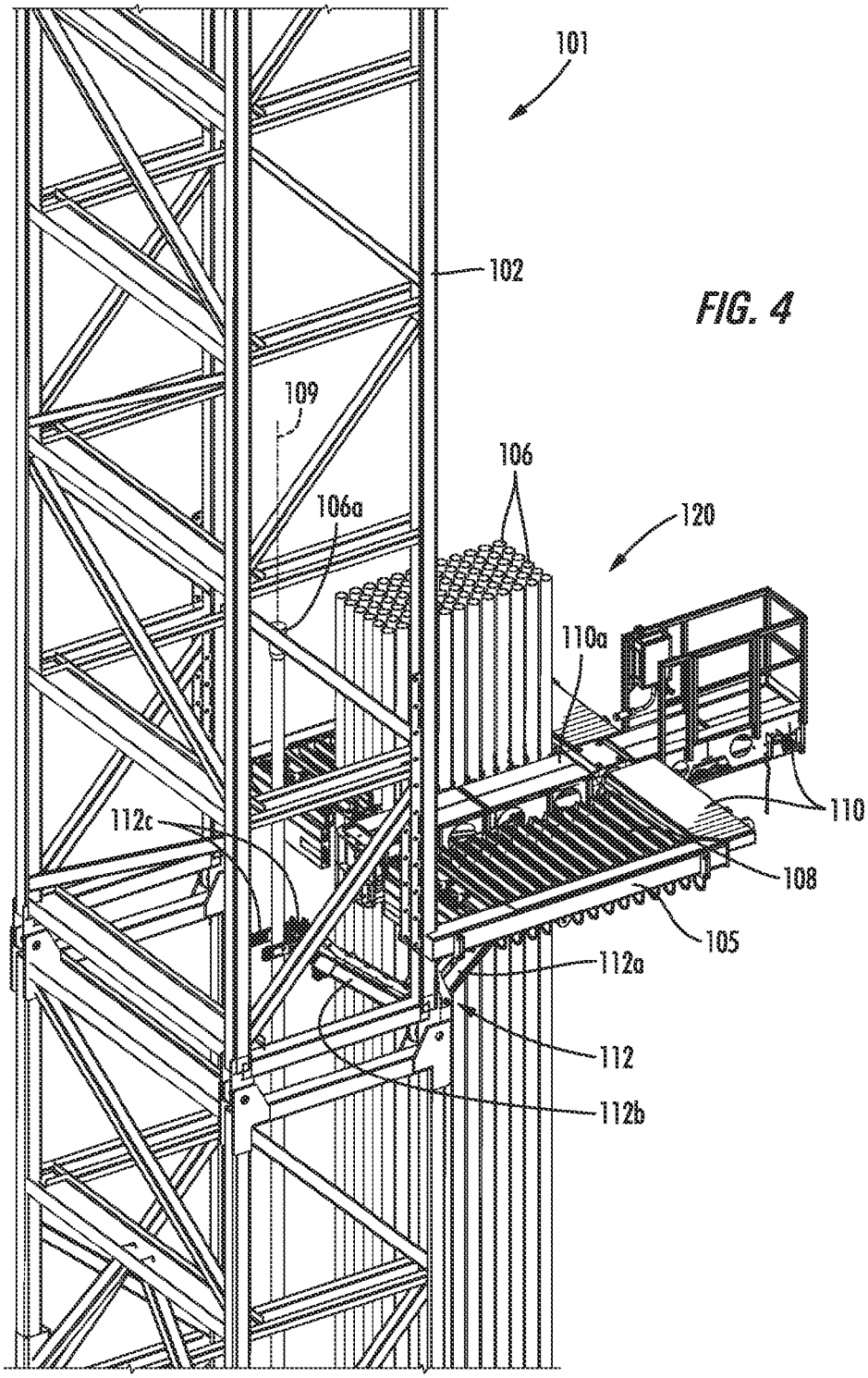
FIG. 4 is an isometric view of the illustrative upper pipe handling assembly depicted in FIGS. 3A and 3B that is used to guide and maneuver the upper ends of drill pipe stands during drill pipe handling operations.

FIG. 4 is a close-up isometric view showing some additional detailed aspects of the illustrative upper pipe handling assembly 120 depicted in FIGS. 3A and 3B when viewed from the drawworks and driller's side of the drilling rig assembly 101. As shown in FIG. 4, a group of vertically staged drill pipe stands 106 are positioned in the fingerboard 105 on the off-driller's side of the diving board 110*a*, and any drill pipe stands 106*a* that may be positioned on the driller's side of the fingerboard are not shown for drawing clarity, as previously noted.

In certain embodiments, the stand transfer apparatus 112 includes a rear arm 112*a* that is pivotably and rotatably coupled to the trolley system 111 (see, FIG. 3B). A front arm 112*b* of the stand transfer apparatus is pivotably coupled at one end to the rear arm 112*a* and a stand capture head 112*c* is pivotably coupled at the other end of the front arm 112*b*. Furthermore, since the rear arm 112*a* is rotatably coupled to the trolley system 111, the stand transfer apparatus 112 is adapted to be rotated about a substantially vertical axis so that the stand capture head 112*c* can be oriented toward any one of the drill pipe stands 106 that are vertically staged in the fingerboard 105. Additionally, since front and rear arms 112*b* and 112*a* and stand capture head 112*c* are pivotably interconnected, the stand transfer assembly 112 may be extended, e.g., by operation of a hydraulic cylinder and the like (not shown), so that the stand capture head 112*c* can engage with and capture a drill pipe stand 106, such as the drill pipe stand 106*a* shown in FIG. 4. Thereafter, the stand transfer assembly 112 may be refracted so as to pull the captured drill pipe stand 106 through and clear of the spaced-apart racking fingers 108 of the fingerboard 105. The trolley system 111 may then be operated so as to move the stand transfer assembly 112 to the end of the diving board 110*a* that proximate the drilling mast 102 and wellcenter 109. In this position, the stand transfer assembly 112 may then again be rotated about the vertical axis until the stand capture head 112*c* is oriented toward the wellcenter 109, and the stand transfer assembly 112 may be extended until the captured drill pipe stand 106*a* is positioned above the wellcenter 109, as shown in FIG. 4.

In certain exemplary embodiments, the upper pipe handling assembly 120 may be operated in a substantially automated fashion, that is, with only minimal monitoring and/or operational interaction by drilling rig personnel. By way of example only and not by way of limitation, an operator in a control room, which may be located a distance away from the upper pipe handling assembly 120, may remotely control the automated operations of the stand transfer apparatus 112 by use of monitoring cameras and a "joystick" so as to capture and maneuver the box end of a drill pipe stand 106*a* back and forth between fingerboard 105 and the wellcenter 109. In other embodiments, an operator may simply initiate a sequence of operations that may thereafter be automatically executed by the upper pipe handling assembly 120 substantially without any interaction by the operator, other than to stop the sequence and/or to begin a new sequence.

Figure 5A:
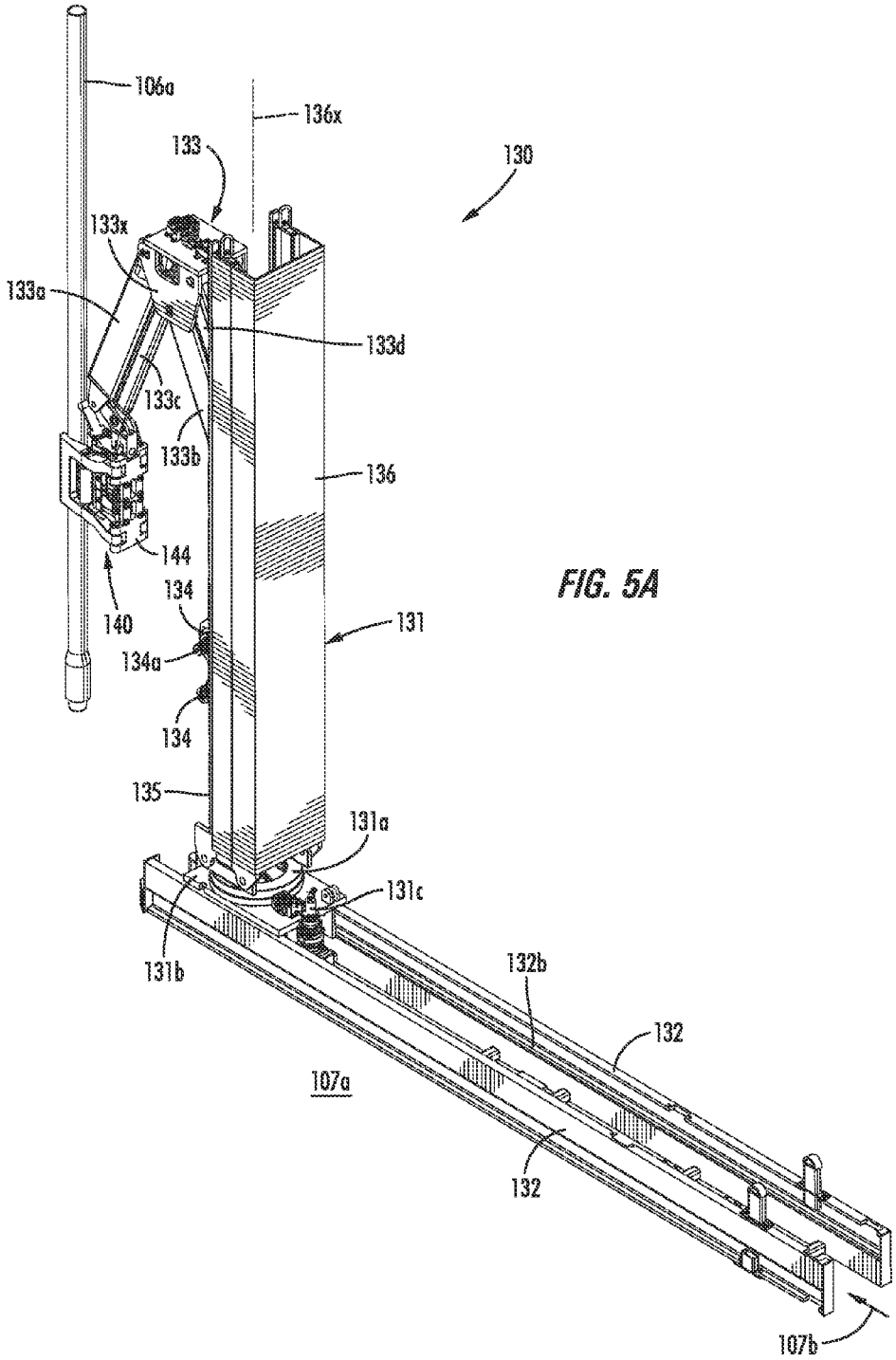
FIGS. 5A-5C are various isometric and elevation views of an illustrative floor mounted racking arm assembly shown in FIGS. 3A and 3B that is used to lift and maneuver the lower ends of drill pipe stands during drill pipe handling operations in accordance with some embodiments disclosed herein.
Figure 7A:
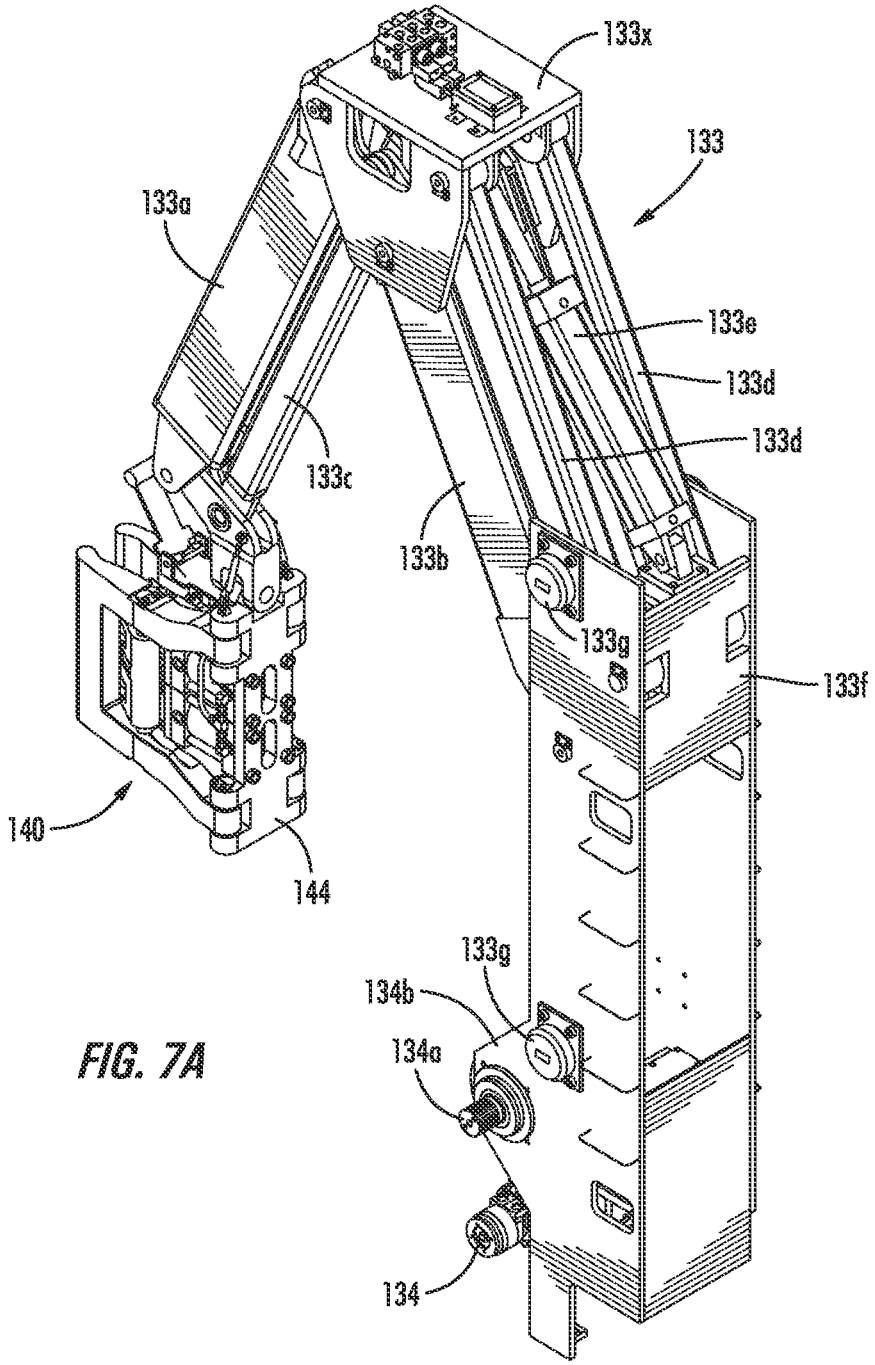
FIGS. 7A-7C are various isometric and elevation views that substantially correspond to the views shown in FIGS. 5A-5C and FIGS. 6A-6C, and which depict an illustrative lift arm assembly of the movable pipe handling apparatus shown in FIGS. 6A-6C in accordance with additional disclosed embodiments.
Figure 7B:
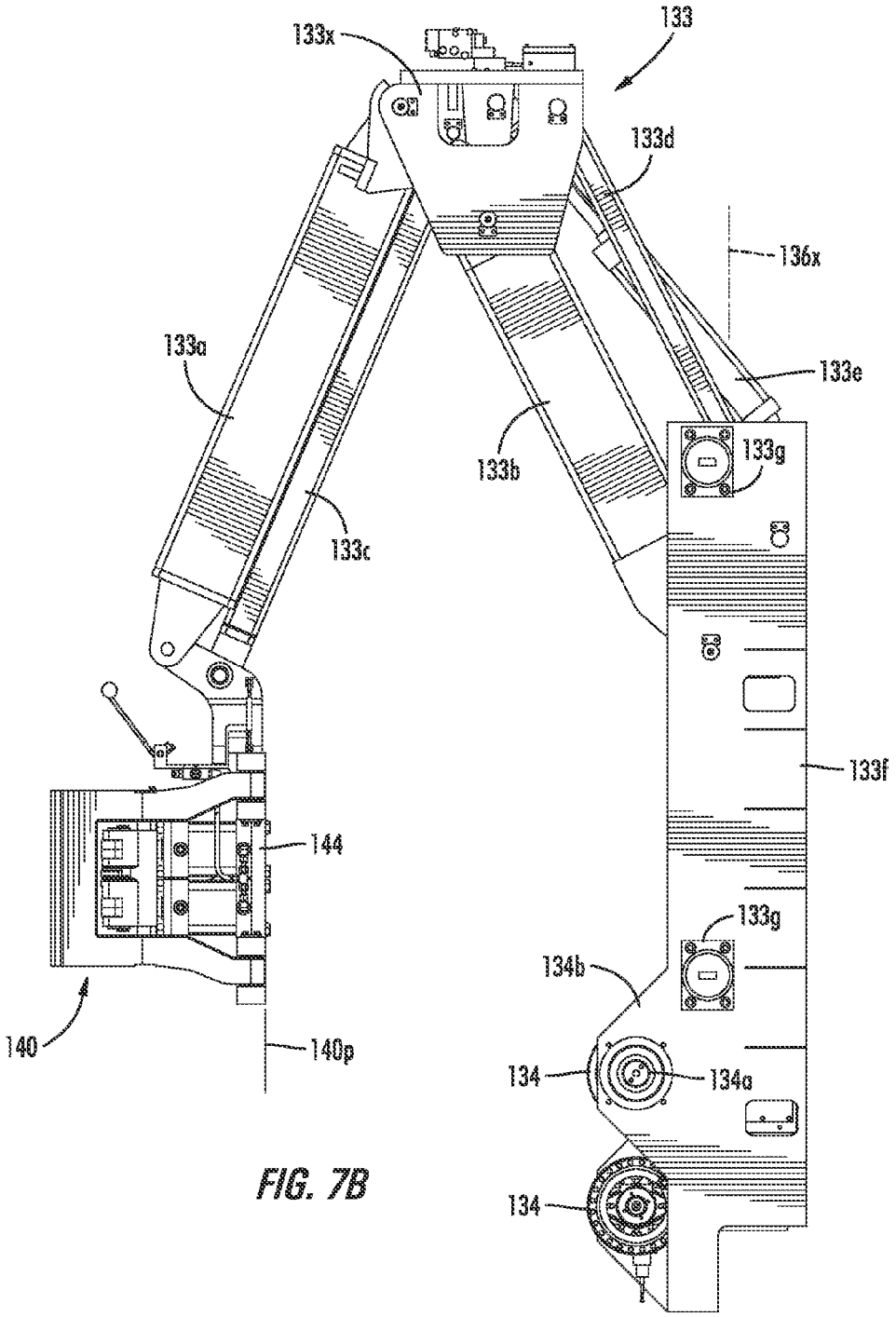
Figure 7C:
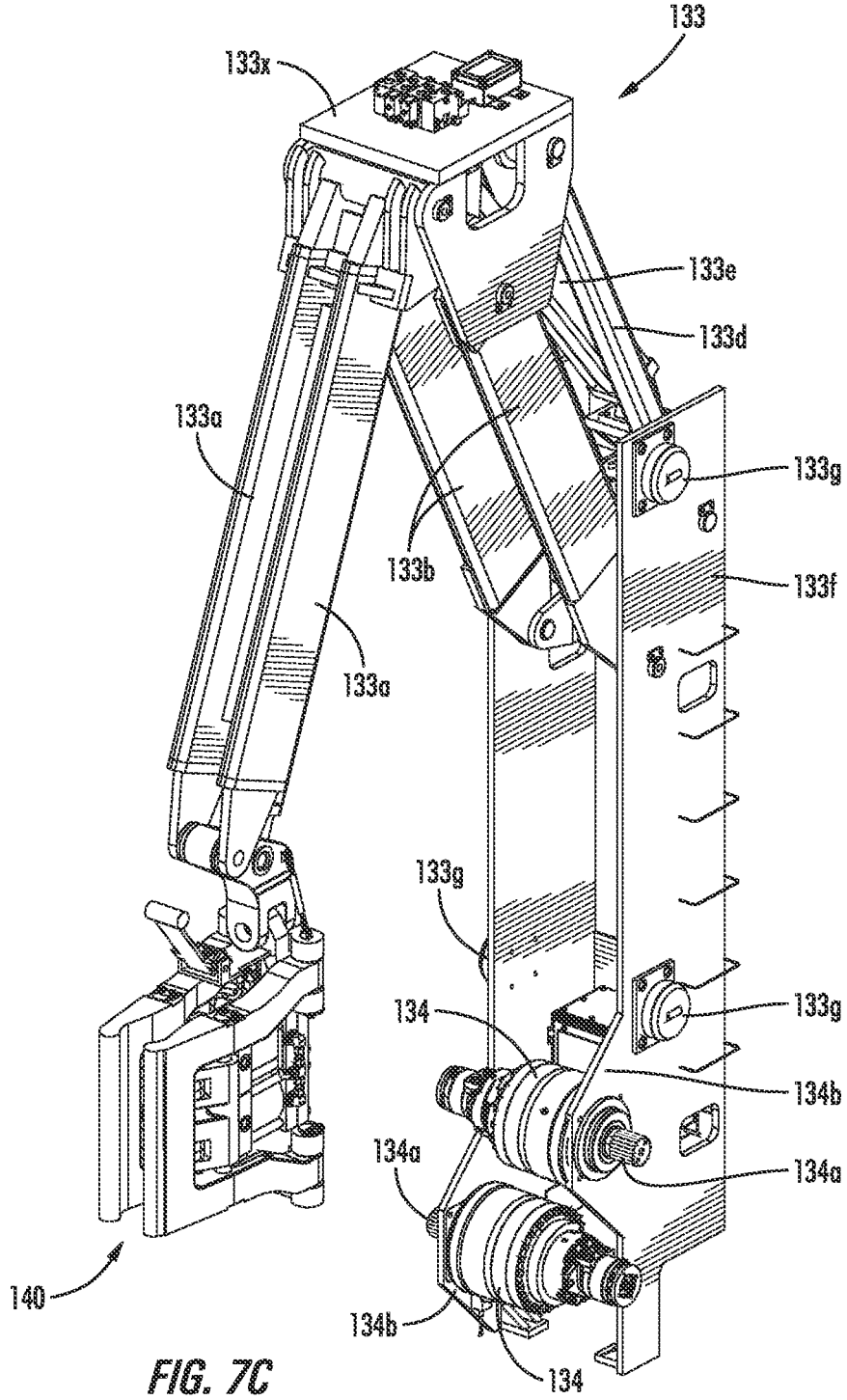

FIGS. 5A-7C depict various illustrative aspects of some exemplary embodiments of the floor mounted racking arm assembly 130 shown in FIGS. 3A and 3B. In particular, FIGS. 5A-5C are various isometric and elevation views of the illustrative floor mounted racking arm assembly 130 wherein several elements, such as the drilling mast 102, the group of drill pipe stands 106 vertically staged in the setback area 107*a*, and the surrounding drill floor 107, are not shown for drawing clarity. Furthermore, FIGS. 6A-6C are isometric and elevation views of a movable pipe handling apparatus 131 of the floor mounted racking arm assembly 130 that substantially correspond to the isometric and elevation views of FIGS. 5A-5C, respectively, wherein the pipe handling apparatus conveyance system, e.g., rails 132, are not included so as to show additional detailed aspects of a column movement carriage 131*b*. Additionally, FIGS. 7A-7C are isometric and elevation views of the movable pipe handling apparatus 131 that substantially correspond to the isometric and elevation views of FIGS. 5A-5C respectively and FIGS. 6A-6C respectively, wherein further elements, e.g., a vertical support column 136, a column rotation apparatus 131*a*, and the column movement carriage 131*b* are not included so as to show additional detailed aspects of a lift arm assembly 133.

Figure 5B:
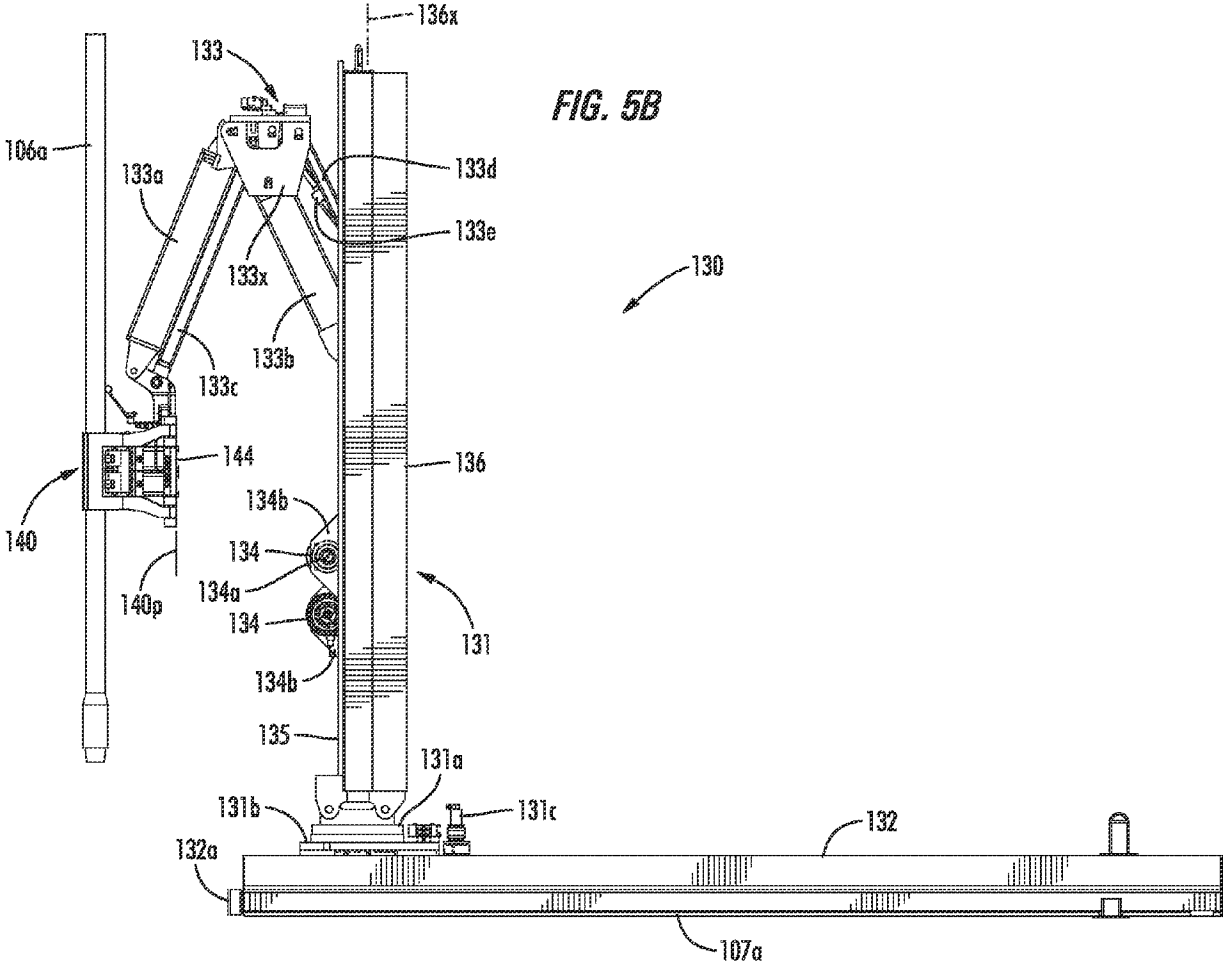
Figure 5C:
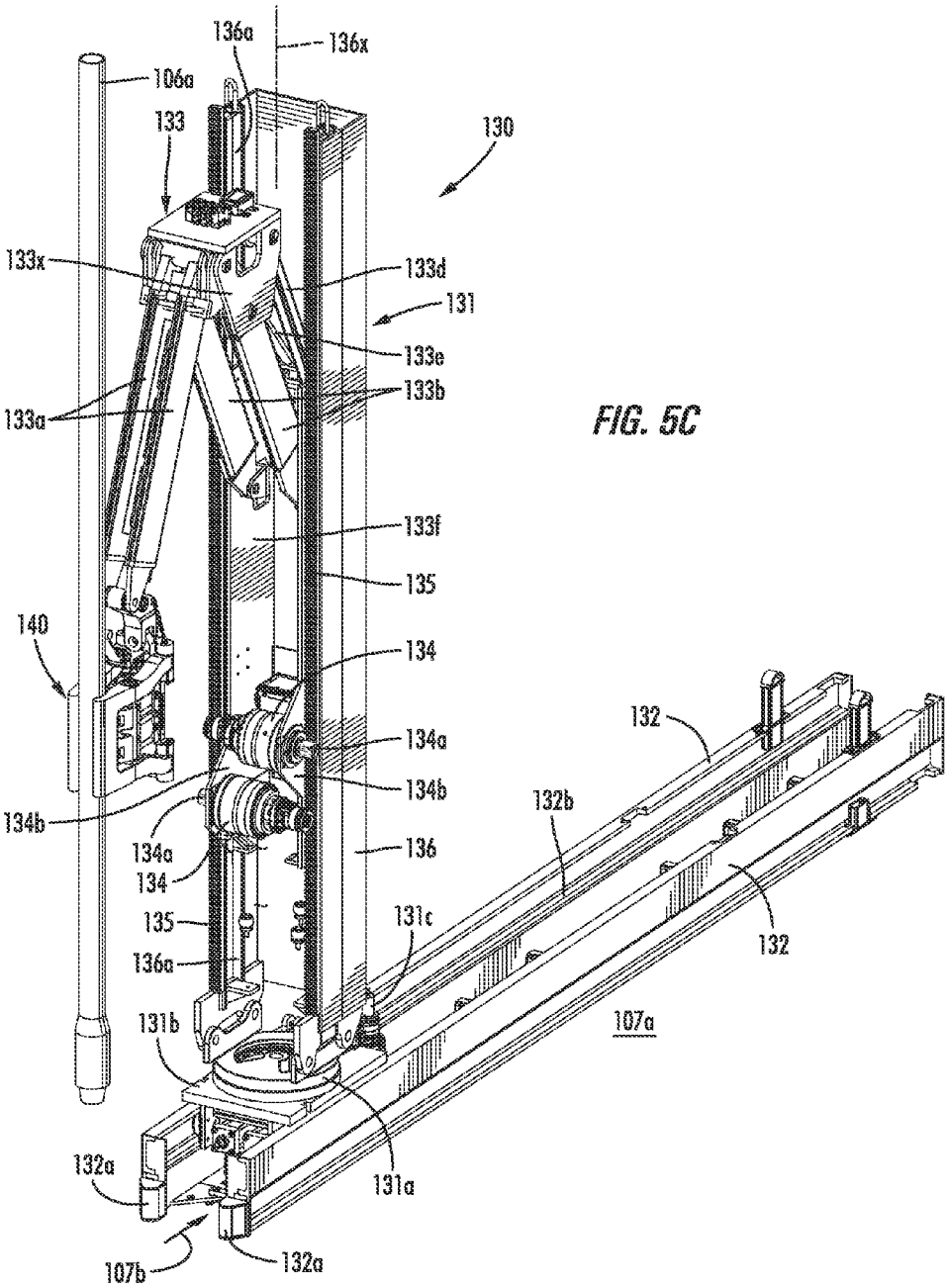
Figure 6A:
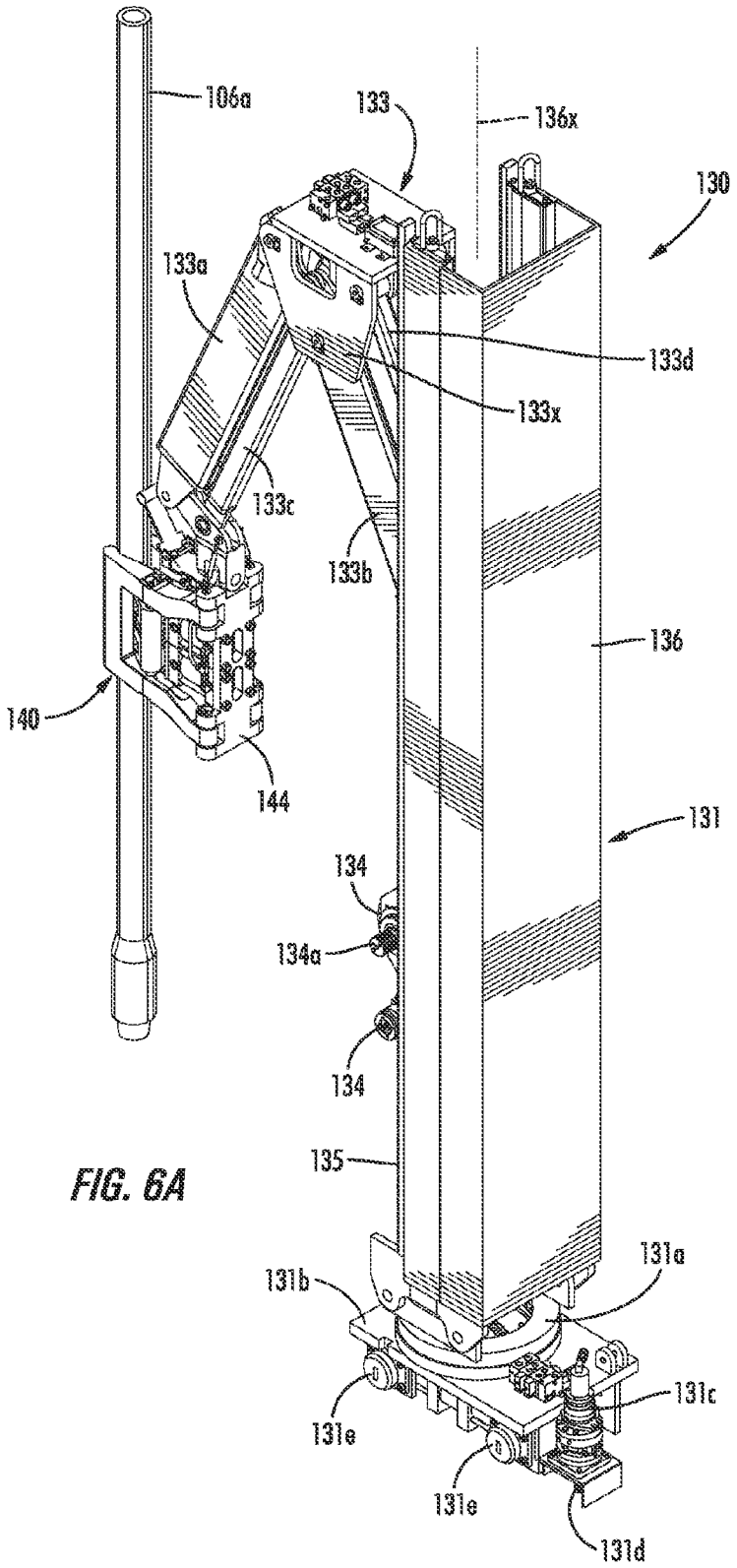
FIGS. 6A-6C are various isometric and elevation views that substantially correspond to the views shown in FIGS. 5A-5C, and which depict an exemplary movable pipe handling apparatus of the floor mounted racking arm assembly shown in FIGS. 5A-5C in accordance with certain illustrative embodiments of the present disclosure.
Figure 6B:
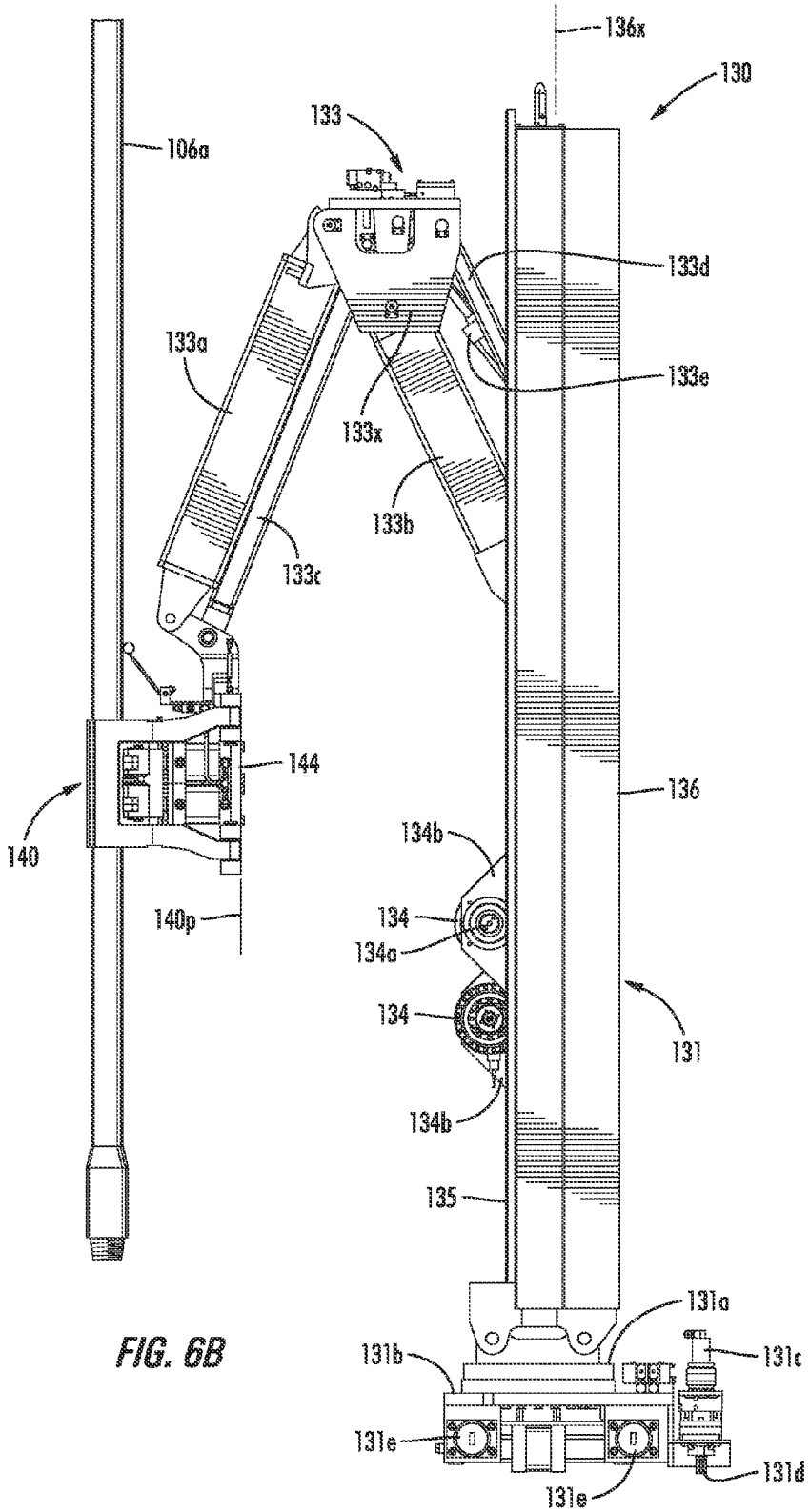
Figure 6C:
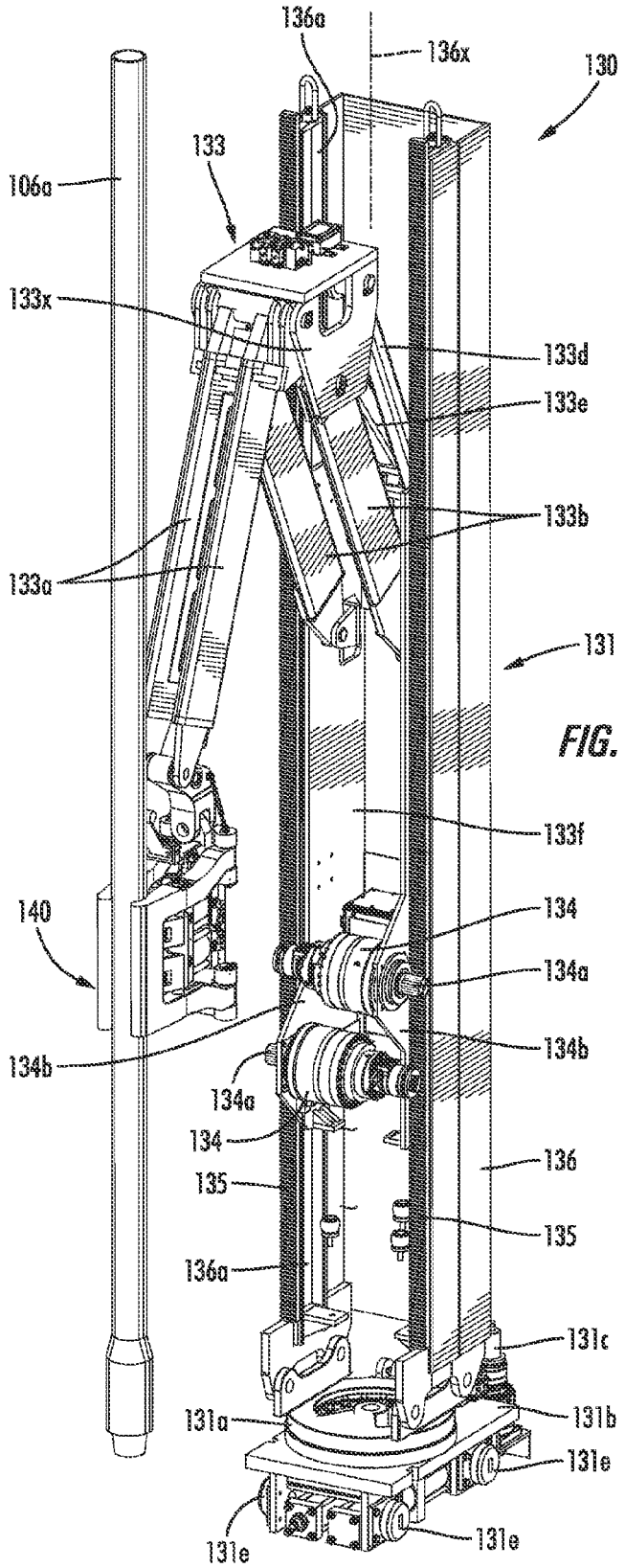

Turning now to FIGS. 5A-5C, the floor mounted racking arm assembly 130 may be mounted on the setback area 107*a* of the drill floor 107, and may include a movable pipe handling apparatus 131 that is movably mounted on a pipe handling apparatus conveyance system, e.g., a trolley system and the like. In some embodiments, the pipe handling apparatus conveyance system may include a pair of spaced-apart tracks or rails 132 and the like, and each of the spaced-apart rails 132 may each include at least one floor mounting connection 132*a* that is used to removably attach the respective rails 132 to the setback area 107*a*. Furthermore, in certain embodiments, the rails 132 may be attached to the setback area 107*a* so that the rails extend through the alleyway 107*b* as previously described, thus allowing the movable pipe handling apparatus 131 to be moved back and on the rails 132 and along the alleyway 107*b* during pipe handling operations.

In some embodiments, the movable pipe handling apparatus 131 may include a vertical support column 136, the lower end of which may be mounted on a column movement carriage 131*b* that is adapted to move the movable pipe handling apparatus 131 along the pipe handling apparatus conveyance system, e.g., the rails 132, during pipe handling operations. The column movement carriage 131*b* may be, for example, a trolley cart 131*b* that is adapted to be moved back and forth along the rails 132. Furthermore, in certain embodiments the floor mounted racking arm assembly 130 may include carriage movement means for moving the column movement carriage 131*b* along the rails 132. For example, the carriage movement means may include a drive motor 131*c* having a pinion gear 131*d* (see, FIGS. 6A and 6B) and a rack gear (not shown) mounted on one of the spaced-apart rails 132 that is adapted to engage the pinion gear 131*d*. Additionally, the column movement carriage 131*b* may include a plurality of roller support wheels 131*e* rotatably coupled thereto, e.g., two on each side of the column movement carriage 131*b* as shown FIGS. 6A-6C, so as to thereby facilitate a rolling movement of the column movement carriage 131*b* along the rails 132 when moved by the carriage movement means. For example, in at least some embodiments, each of the rails 132 may include a roller contact surface or groove 132*b* that is adapted to contactingly engage the roller support wheels 131*e* so as to support the column movement carriage 131*b* during its movement along the rails 132. Other suitable carriage movement means may also be used.

In certain exemplary embodiments, the vertical support column 136 may be rotatably mounted on the column movement carriage 131*b* by way of a column rotation apparatus 131*a*, which may include rotating means (not shown) for rotating the movable pipe handling apparatus 131 about a vertical axis 136*x* of the column 136 during pipe handling operations, as will be further discussed with respect to FIGS. 9A-9F below. For example, in at least one embodiment, the rotating means of the column rotation apparatus 131*a* may include a drive motor having a pinion gear (not shown) that is adapted to engage a corresponding ring gear (not shown), and a plurality of bearing elements (not shown), such as roller bearing and the like, to facilitate a substantially smooth rotation of the movable pipe handling apparatus 131 during operation of the column rotation apparatus 131*a*. Other suitable means for rotating the movable pipe handling apparatus 131 may also be used.

As shown in FIGS. 5A-5C, the movable pipe handling apparatus 131 may include a lift arm assembly 133 that is movably mounted to the vertical support column 136 and a lift jaw assembly 140 that is pivotably coupled to the end of the lift arm assembly 133. In certain illustrative embodiments, the lift jaw assembly 140 may be adapted to engage with a drill pipe stand, such as the drill pipe stand 106*a* shown in FIGS. 5A-5C, during pipe handling operations and to grip the drill pipe stand 106*a* in a clamping manner such that lift jaw assembly 140 fixedly holds onto the drill pipe stand 106*a*, i.e., so as to prevent it from slipping through the lift jaw assembly 140 as the drill pipe stand is raised and lowered by the lift arm assembly 133, as will be further described with respect to FIGS. 8A-8F below. In some embodiments, the lift arm assembly 133 may be adapted to extend the lift jaw assembly 140 laterally away from the vertical support column 136 so that the lift jaw assembly 140 can engage with and grip the drill pipe stand 106*a*, and in other embodiments the lift arm assembly may also be adapted to lift or raise the drill pipe stand 106*a* after the lift jaw assembly 140 has gripped the drill pipe stand 106*a*, as will be further described below.

In some embodiments, the lift arm assembly 133 includes a pair of front lift arms 133*a*, each of which is pivotably coupled at one end to a lift arm connecting frame 133*x* and pivotably coupled at the opposite end to the lift jaw assembly 140, as shown in FIGS. 5A-5C. Additionally, the lift arm assembly 133 may also include a pair of rear lift arms 133*b*, each of which is pivotably coupled at one end to the lift arm connecting frame 133*x* and at the opposite end to a lift arm carriage 133*f* (see, FIGS. 7A-7C), which is movably mounted to the vertical support column 136. In at least one embodiment, the lift arm assembly 133 also includes a front alignment strut 133*c* that is pivotably coupled at opposite ends thereof to the lift arm connecting frame 133*x* and the lift jaw assembly 140, as well as a pair of rear alignment struts 133*d*, each of which is pivotably coupled at opposite ends thereof to the lift arm connecting frame 133*x* and the lift arm carriage 133*f*. Furthermore, the lift arm assembly 133 may also include an arm extension apparatus 133*e*, such as a hydraulic or pneumatic cylinder and the like, that is pivotably coupled at a first end to the to the lift arm carriage 133*f* and pivotably coupled at a second end to the lift arm connecting frame 133*x*. See, FIGS. 7A-7C.

During operation of the lift arm assembly 133, the arm extension apparatus 133*e* may be actuated to extend the front and rear lift arms 133*a*, 133*b* so that the lift jaw assembly 140 can be used to reach out, grab, and fixedly hold onto a drill pipe stand 106*a*, and/or position the drill pipe stand 106*a* while it is fixedly held by the lift jaw assembly 140, as previously described. In certain embodiments, the front and rear alignment struts 133*c*, 133*d* may be pivotably coupled and arranged with respect to the lift jaw assembly 140, the lift arm connecting frame 133*x*, and the lift arm carriage 133*f* such that, during such a lift arm extension operation, the lift jaw assembly 140 may be maintained in a substantially constant attitude with respect to the vertical support column 136. For example, in at least some exemplary embodiments, the various elements of the lift arm assembly 133 may be configured and coupled together in such a way that, during lift arm extension operations, a plane 140*p* that is defined by a rear face of a lift jaw frame 144 at the back side of the lift jaw assembly 140 may be maintained substantially parallel to the vertical axis 136*x* of the vertical support column 136. In this way, the gripping jaws 145 (see, FIGS. 8A-8F) of the lift jaw assembly 140 may be properly oriented relative to a substantially vertically staged drill pipe stand 106*a* so that the lift jaw assembly 140 can grip the stand 106*a* for lifting and/or maneuvering by the lift arm assembly 133, as will be further described below.

In some illustrative embodiments, the movable pipe handling apparatus 131 may also include lift arm raising means for raising and lowering the lift arm assembly 133 up and down along the vertical support column 136. For example, the lift arm raising means may include, among other things, a plurality of roller wheels 133*g* that are rotatably coupled to the lift arm carriage 133*f*, e.g., two on each side of the lift arm carriage 133*f* as shown in FIGS. 7A-7C. In various embodiments, the plurality of roller wheels 133*g* may be adapted to engage with and rollingly contact a plurality of rails or grooves 136*a* that are formed in the vertical support column 136, thereby facilitating a sliding movement of the lift arm carriage 133*f* up and down the vertical length of the vertical support column 136. Furthermore, in certain embodiments, the lift arm raising means may also include one or more lift motors 134, which, as shown in FIGS. 5A-7C, may be coupled to one or both sides of the lift arm carriage 133*f* by respective lift motor mounting extension brackets 134*b*. As shown in the illustrative embodiment depicted in FIGS. 5A-6C, the lift arm raising means may also include a rack gear 135 for each of the respective one or more lift motors 134, wherein each rack gear 135 may be vertically mounted on the vertical support column 136 and furthermore may be adapted to engage with a respective pinion gear 134*a* coupled to a shaft of each respective lift motor 134. In such embodiments, each of the one or more lift motors 134 may therefore be operated so as to drive their respective pinion gears 134*a* along a respective rack gear 135, thereby raising and lowering the lift arm carriage 133*f*, and consequently raising and lowering the entire lift arm assembly 133 and lift jaw assembly 140 coupled thereto. It should be appreciated that other lift arm raising means, such as hydraulic or pneumatic cylinders, cable lifting assemblies, and/or screw drives and the like, may also be used.

Figure 8A:
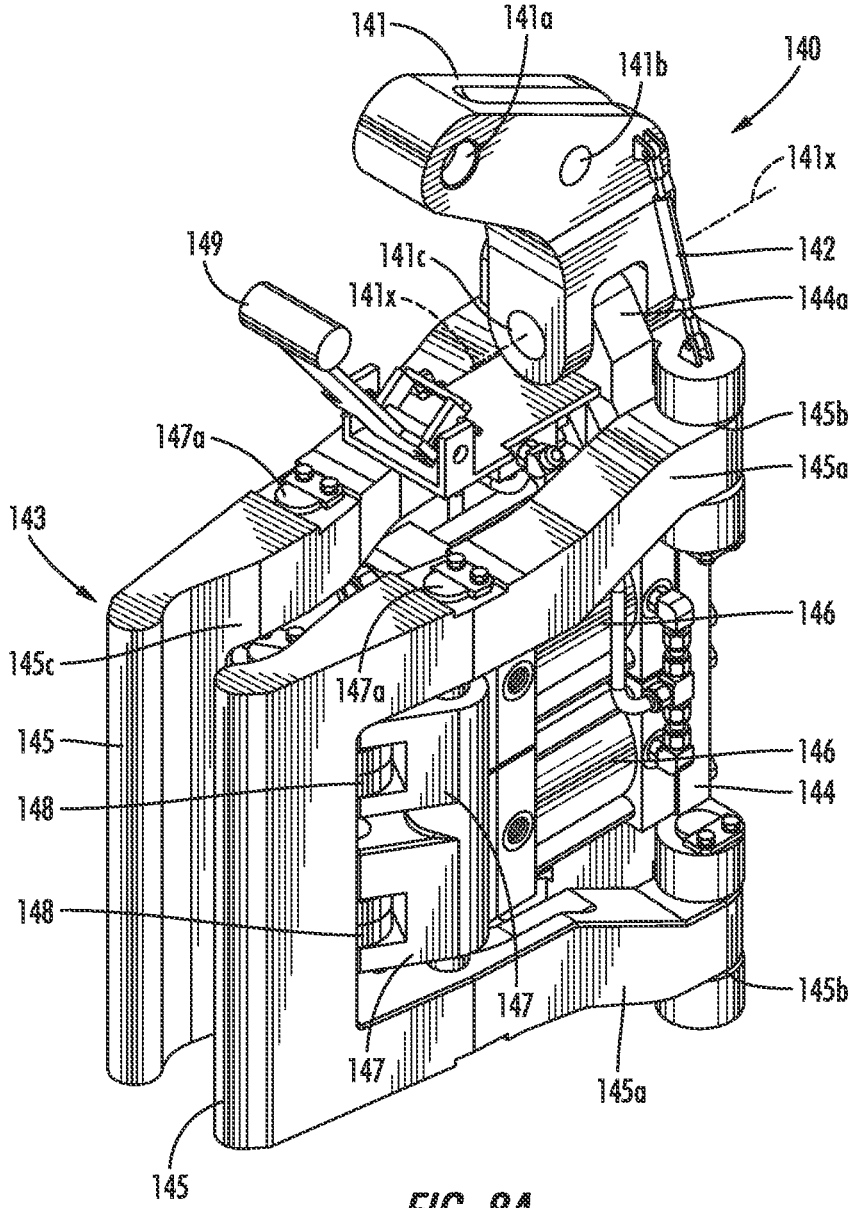
FIGS. 8A-8F are various isometric, elevation, top, and bottom views of one illustrative embodiment of a lift jaw assembly that may be used in conjunction with the exemplary lift arm assembly, movable pipe handling apparatus, and floor mounted racking arm assembly shown in FIGS. 5A-7C.
Figure 8B:
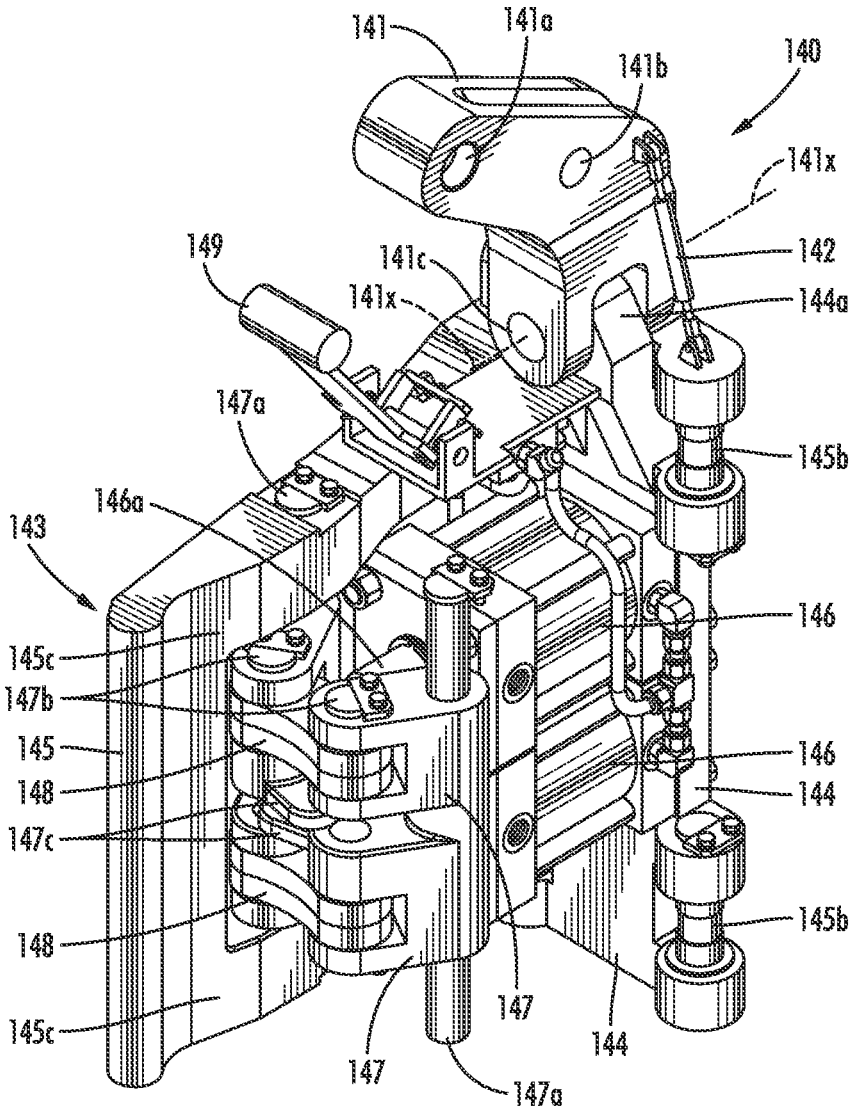
Figure 8C:
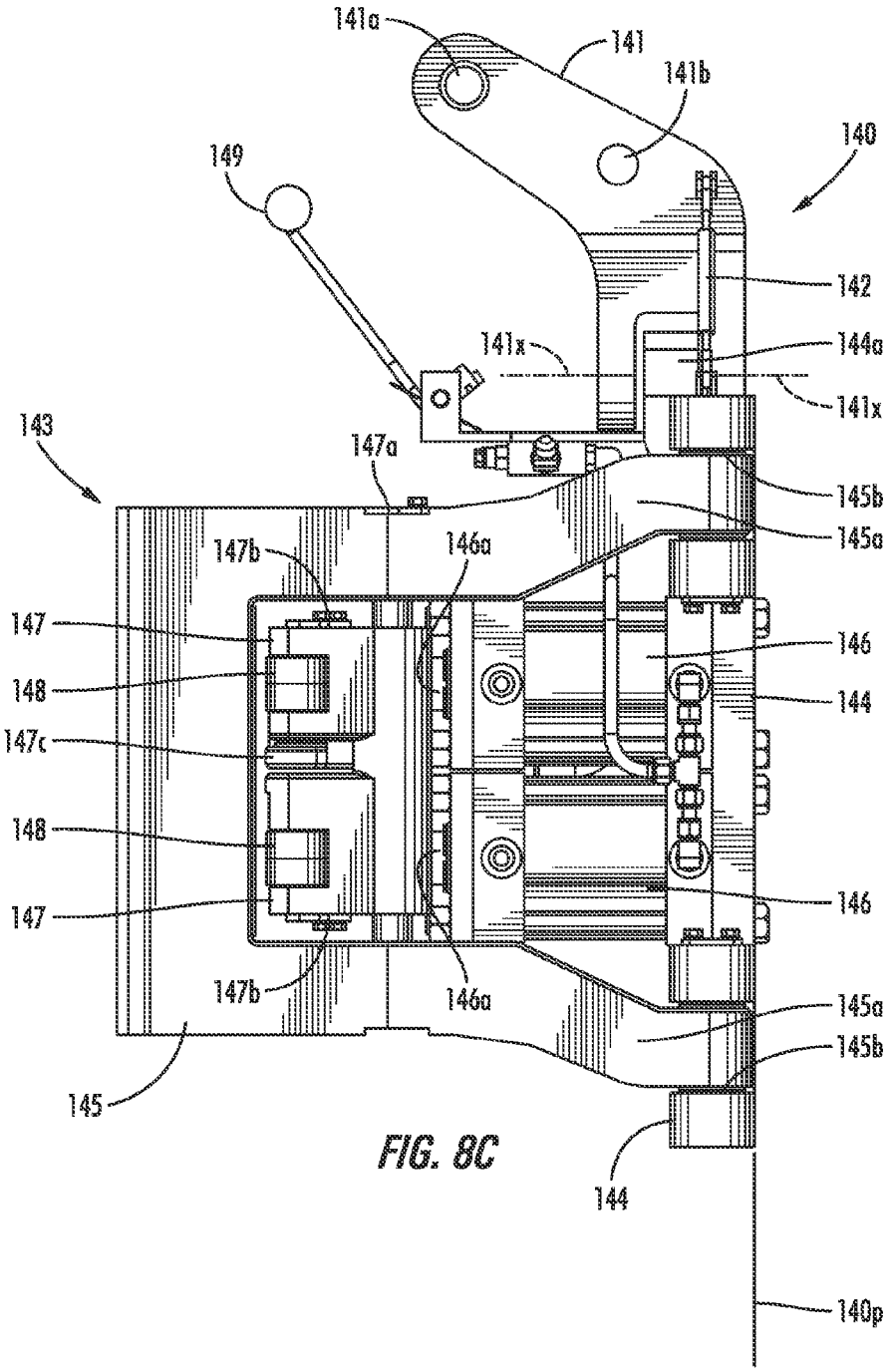
Figure 8D:
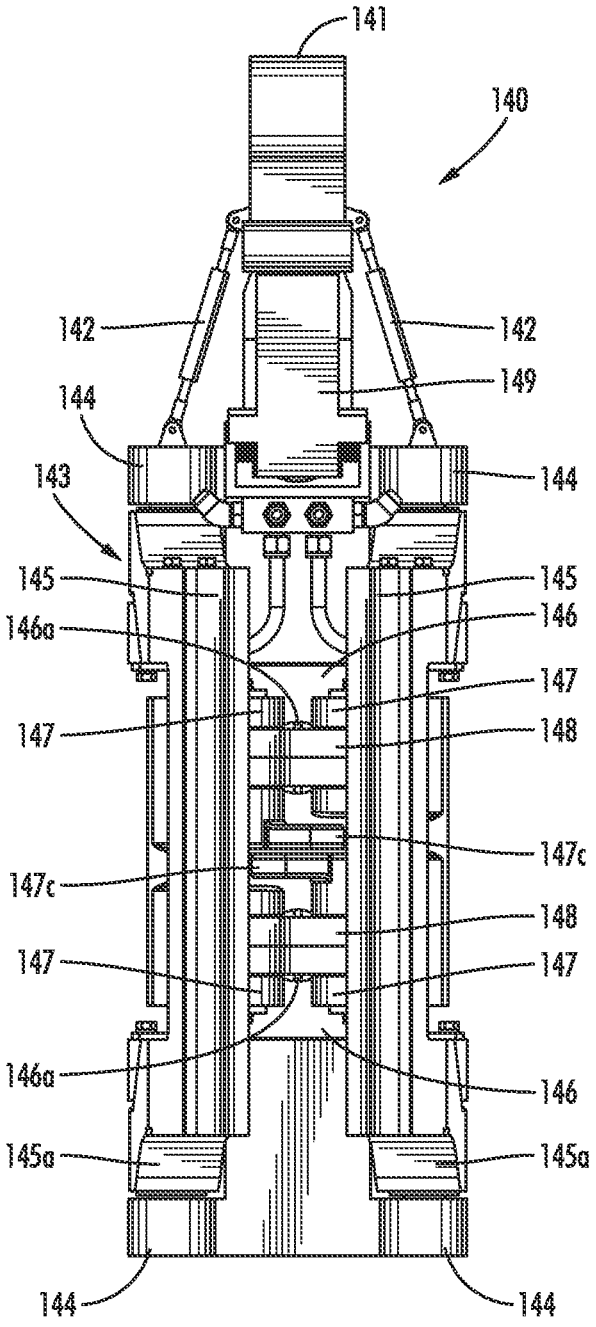
Figure 8F:
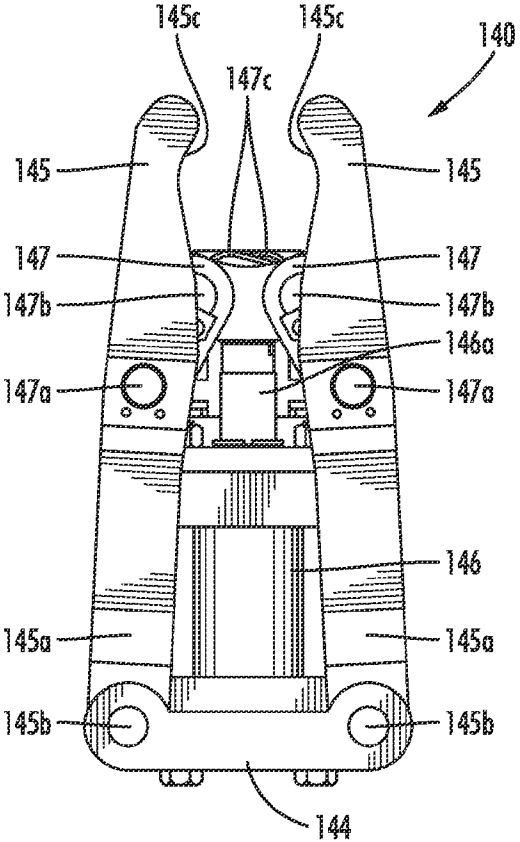
Figure 8E:
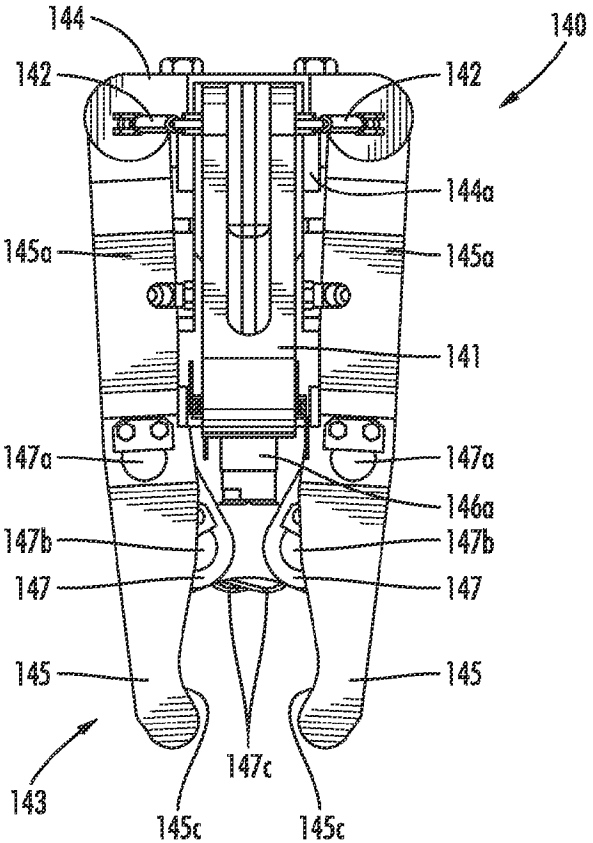

FIGS. 8A-8F are various views of one exemplary embodiment of the lift jaw assembly 140 shown in FIGS. 5A-7C, wherein however the lift arm assembly 133 that supports the lift jaw assembly 140 is not shown for drawing clarity. More specifically, FIG. 8A is an isometric view of the lift jaw assembly 140, and FIG. 8B depicts the same isometric view shown in FIG. 8A wherein one of the two gripping jaws 145 has been removed so as to more clearly illustrate some additional aspects of the lift jaw assembly 140. Additionally, FIGS. 8C and 8D are side and front elevation views, respectively, and FIGS. 8E and 8F are top-down and bottom-up views, respectively, of the lift jaw assembly 140.

In some embodiments, the lift jaw assembly 140 may include a lift jaw gripping apparatus 143 having a pair of laterally opposed gripping jaws 145. Each of the laterally opposed gripping jaws 145 may have a front clamping face or gripping portion 145*c* that is generally shaped and configured to engage with and clamp on the outer diametral surface of a drill pipe stand, such as the drill pipe stands 106/106*a* described above, so as to thereby fixedly hold the drill pipe stand and prevent it from slipping through the gripping jaws 145 during pipe handling operations. As shown in FIGS. 8A-8C, the gripping jaws 145 may each have a substantially U-shaped or horseshoe-shaped configuration that includes upper and lower jaw extension arms 145*a* extending from the front clamping face/gripping portion 145*c* of each gripping jaw 145 toward the back side of the lift jaw gripping apparatus 143. In certain embodiments, each extension arm 145*a* may be pivotably coupled to a lift jaw frame 144 at respective pinned connections 145*b*, which may thus allow the gripping jaws 145 to be pivotably rotated relative to the lift jaw frame 144 during a drill pipe clamping or gripping operation so as to thereby facilitate a clamping/gripping action on the outer diametral surface of a drill pipe stand 106/106*a* by the respective gripping faces 145*c*, as will be further described below.

In certain illustrative configurations, the lift jaw assembly 140 may also include a lift jaw support lug 141 that is used to support the lift jaw gripping apparatus 143 during gripping and lifting operations, and to pivotably couple the lift jaw assembly 140 to the lift arm assembly 133. To that end, the front lift arms 133*a* and the front alignment strut 133*c* (see, FIGS. 5A-7C) may be pivotably coupled to the lift jaw support lug 141 at first and second pinned connections 141*a* and 141*b*, respectively. Furthermore, a lift jaw pinned connection 141*c* may be used to pivotably couple the lift jaw support lug 141 to a frame lug 144*a* that protrudes from an upper end of the lift jaw frame 144 in a clevis-type configuration, such that the lift jaw support lug 141 straddles the frame lug 144*a*, as shown in FIGS. 8A-8C. In at least some embodiments, an axis 141*x* of the lift jaw pinned connection 141*c* is arranged substantially perpendicular to the plane 140*p* defining the rear face of the lift jaw frame 144 (see, FIG. 8C), and may also be oriented in a substantially horizontal direction during the typical pipe handling operations that are performed by lift jaw assembly 140 and lift arm assembly 133. Furthermore, in certain embodiments the pinned connection 141*c* is adapted to allow the lift jaw gripping apparatus 143 to be pivoted or twisted about the axis 141*x* to a substantially non-zero angle 106*x* (see, FIGS. 10A-11D, described below) relative to a substantially vertical direction. In this way, the lift jaw gripping apparatus 143 may therefore be able to clamp onto and grab, and/or otherwise fixedly hold onto, a drill pipe stand 106*a* that may be vertically misaligned during some pipe handling operational situations. For example, such vertical misalignment of the a drill pipe stand 106*a* may sometimes occur when the stand transfer apparatus 112 of the upper pipe handling assembly 120 is not substantially vertically aligned with the lift jaw assembly 140 of the floor mounted racking arm assembly 130 during drill pipe handling operations, as will be further described with respect to FIGS. 10A-11D below.

In order to substantially prevent the lift jaw gripping apparatus 143 from freely rotating about the axis 141*x* of the lift jaw pinned connection 141*c*, one or more damping devices 142, such as pneumatic/hydraulic cylinders (e.g., shock absorbers) and/or springs and the like, may be pivotably coupled between the lift jaw support lug 141 and the lift jaw frame 144. For example, in at least some embodiments, one damping device 142 may be positioned on each opposing side of the lift jaw support lug 141, as shown in FIG. 8D. In some embodiments, the damping devices 142 may provide a degree of resistance to rotational motion so as to thus inhibit the lift jaw gripping apparatus 143 from swinging from side to side about the axis 141*x* of the pinned connection 141*c* when the lift arm assembly 133 is moved and/or pivoted about the setback area 107*b* during various pipe handling operations. For example, the damping devices 142 may be sized and configured so as to hold the lift jaw gripping apparatus 143 in a substantially balanced position, e.g., such that the gripping jaws 145 are each substantially vertically oriented, until a nominal threshold torque load, such as approximately 50-100 ft-lbs and the like, is imposed on the lift jaw pinned connection 141*c*.

For example, the damping devices 142 may act to hold the lift jaw gripping apparatus 143 in a substantially balanced position relative to the lift jaw support lug 141 until such time as a vertical misalignment of the drill pipe stand 106*a* occurs as previously described, at which point the damping devices 142 would allow the lift jaw gripping apparatus 143 to pivot about the axis 141*x* of the lift jaw pinned connection 141*c* as required to reach its necessary vertical misalignment position. Thereafter, once the drill pipe stand vertical misalignment situation has been eliminated, such as when the lift jaw gripping apparatus 143 is actuated so as to release a vertically misaligned drill pipe stand 106*a*, the damping devices 142 will generally act to bring the lift jaw gripping apparatus 143 back to the substantially balanced position, e.g., wherein the gripping jaws 145 are substantially vertically oriented.

Turning now to the isometric view of the lift jaw assembly 140 depicted in FIG. 8B, one of the gripping jaws 145 has been omitted so as to illustrate further detailed aspects of the various jaw moving elements of the lift jaw gripping apparatus 143 that are configured and arranged so to open and close the gripping jaws 145, thereby enabling the jaws 145 to clamp on and/or release a drill pipe stand 106/106*a*. As shown in FIG. 8B, the lift jaw gripping apparatus 143 may include one or more clamp actuating devices 146 (two shown in FIGS. 8A-8F), such as a hydraulic or pneumatic cylinder and the like, which may be operated (e.g., extended and/or retracted) so as close the gripping jaws 145 around a drill pipe 106/106*a* and to open the gripping jaws 145 so as to release the drill pipe 106/106*a*. In those exemplary embodiments wherein the clamp actuating devices 146 may be hydraulic or pneumatic cylinders, each clamp actuating device 146 may include a piston 146*a* that is coupled to a respective inner clamping linkage 148 (see also FIGS. 8C, 8E, and 8F). Furthermore, each opposing end of the inner clamp linkage(s) 148 may in turn be pivotably coupled to respective outer clamping linkages 147 at respective pinned connections 147*b*. As shown in FIG. 8B, the outer clamping linkages 147 may also be pivotably connected to the respective gripping jaws 145 at respective pinned connections 147*a*.

During operation of the lift jaw gripping apparatus 143, when the clamp actuating device(s) 146 are actuated so as to extend a respective piston 146*a*, the inner clamping linkages 148 are moved forward, i.e., away from the lift jaw frame 144 and toward the front side of the gripping jaws 145. As the inner clamping linkages 148 move forward, the pinned connections 147*b* pivotably coupling the outer clamping linkages 147 to the inner clamping linkages 148 will also act to move the outer clamping linkages 147 toward the front side of the gripping jaws 145. Furthermore, as they move forward, the outer clamping linkages 147 will pivot about the pinned connections 147*b*, thus rotating the pinned connections 147*a* toward the piston(s) 146*a*, that is, toward a centerline/axis of the lift jaw gripping apparatus 143 that runs between the clamping faces 145*c* of the gripping jaws 145. The pinned connections 147*a* pivotably coupling the outer clamping linkages 147 to the respective gripping jaws 145 will thus cause each respective gripping jaw 145 to move toward the centerline/axis of the lift jaw gripping apparatus 143 as the upper and lower jaw extension arms 145*a* pivot about the pinned connections 145*b* that pivotably couple the gripping jaws 145 to the lift jaw frame 144. In this way, the front clamping faces/gripping portions 145*c* may be pivotably rotated together, i.e., closed, so as to clamp/grip the outer diametral surface of a drill pipe stand 106/106*a* and fixedly hold the drill pipe stand 106/106*a* is it is raised, lowered, and/or positioned by the lift arm assembly 133. When the clamp actuating devices 146 are actuated so as to retract each respective piston 146*a*, the linkages 147, 148 and pinned connections 147*a*, 147*b* similarly act so as to pivot each gripping jaw 145 about the respective pinned connections 145*b* in an opposite direction, thus pivotably rotating the front clamping faces/gripping portions 145*c* apart, i.e., opened, so as to release the drill pipe stand 106/106*a*.

In at least some exemplary embodiments, one or more of the outer clamping linkages 147 may also include cam elements 147*c* (see, FIGS. 8B-8F) that are coupled to and rotate with a respective outer clamping linkage 147 as the linkages 147 are pivotably rotated about the pinned connections 147*b*. As shown at least in FIGS. 8B and 8D-8F, the cam elements 147*c* may overlap and interleave such that each cam element 147*c* rotates in an opposite direction to that of an adjacent cam element 147*c*. As the piston 146*a* of each clamp actuating devices 146 is extended so as to close the gripping jaws 145 around a drill pipe stand 106/106*a*, the lobes of each cam element 147*c* rotate forward, i.e., toward the front side of the lift jaw gripping apparatus 143, so as to contactingly engage the outer diametral surface of the drill pipe and to properly position the drill pipe stand 106/106*a* approximately in the area of the shaped/contoured portions of the front clamping faces 145*c* of each gripping jaw 145. In this way, the lift jaw gripping apparatus 143 may be actuated so as to clamp down on, grip, and fixedly hold the drill pipe stand 106/106*a* with the shaped/contoured portions 145*c* of the gripping jaws 145.

In certain embodiments, the lift jaw assembly 140 may also include a spring-loaded tongue apparatus 149 that is operatively coupled to a sensing device (not shown) and is adapted to indicate if a drill pipe stand 106/106*a* is positioned between the gripping jaws 145 of the lift jaw assembly 140. For example, when there is no drill pipe stand 106/106*a* positioned between the gripping jaws 145, the spring-loaded tongue apparatus 149 may be fully extended toward the open (front) end of the lift jaw assembly 140 (see, FIGS. 8A-8C), during which time the sensing device may send a control signal indicative of this position to a lift jaw assembly controller apparatus (not shown). However, as a drill pipe stand 106/106*a* is moved between the gripping jaws 145, the stand 106/106*a* will eventually contact the spring-loaded tongue apparatus 149 (see, FIGS. 5B and 6B) and cause the tongue apparatus 149 to rotate against the resistance of the spring and away from the front end of the lift jaw assembly 140. In some embodiments, this rotational movement of the spring-loaded tongue apparatus 149 when contacted by the drill pipe stand 106/106*a* may thereby interrupt the control signal from the sensing device so that the gripping jaws 145 can be actuated to clamp on and grip the stand 106/106*a*.

Figure 9A:
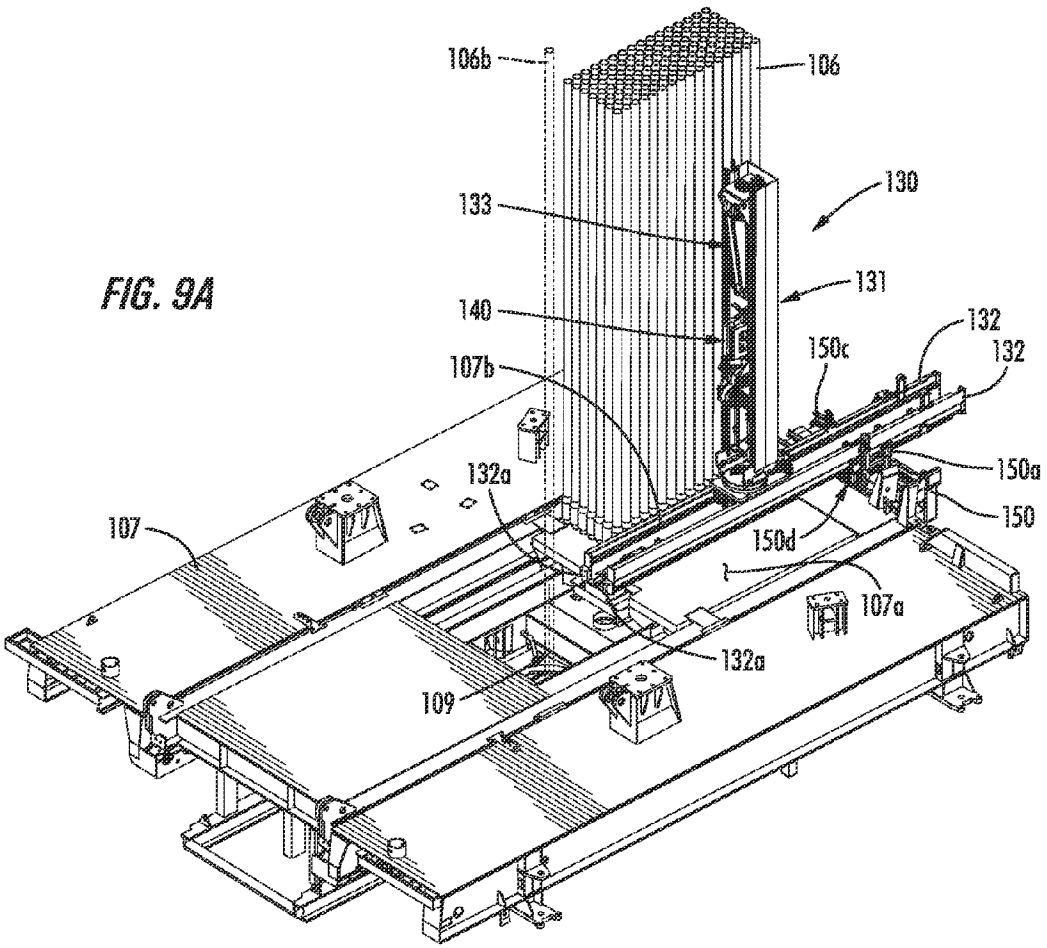
FIGS. 9A-9C are close-up isometric views of the drilling rig assembly shown in FIGS. 3A and 3B wherein the drilling rig mast has been removed for clarity, and depict an exemplary operational sequence of using the illustrative floor mounted racking arm assembly of the present disclosure to lift and maneuver the lower end of a drill pipe stand.
Figure 9B:
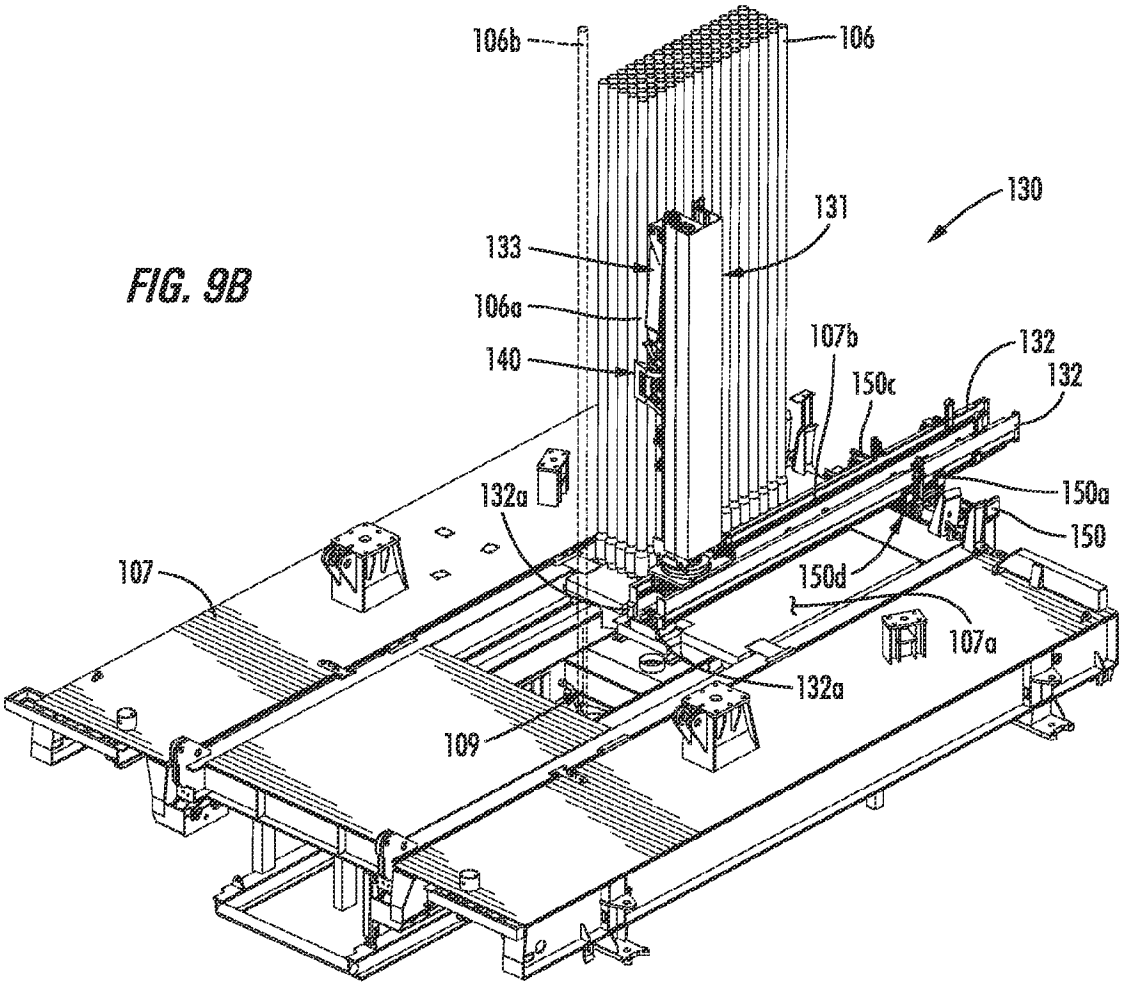
Figure 9C:
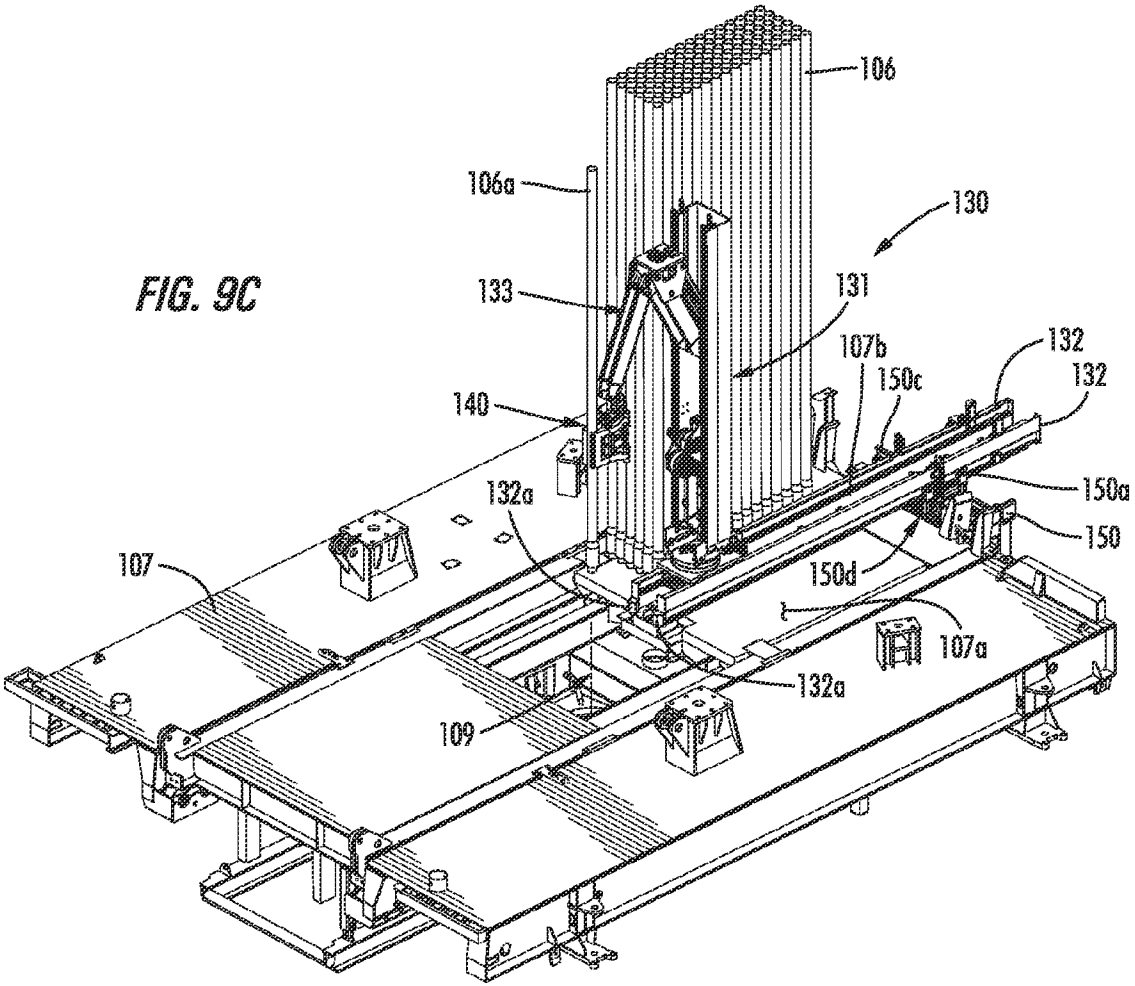
Figure 9D:
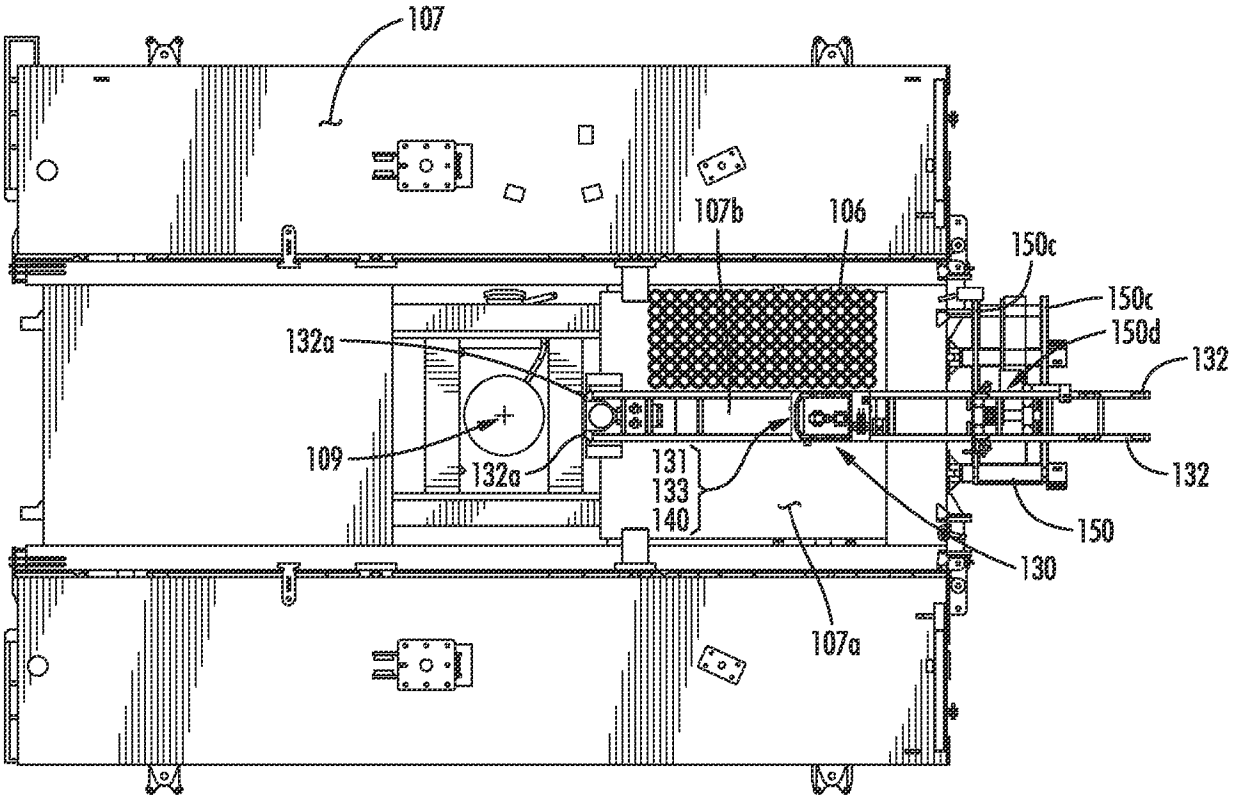
FIGS. 9D-9F are plan views of the illustrative floor mounted racking arm assembly disclosed herein that correspond to the exemplary drill pipe handling sequence depicted in the isometric views of FIGS. 9A-9C, respectively.
Figure 9E:
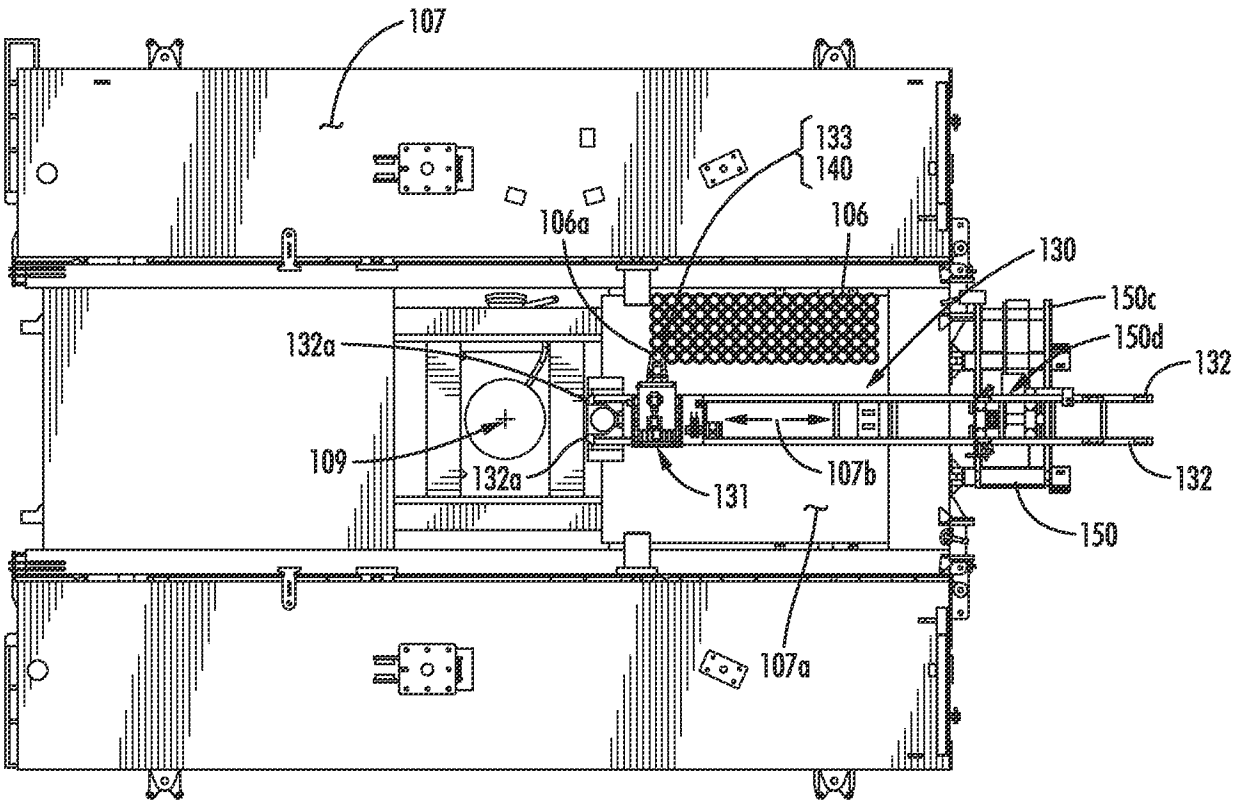
Figure 9F:
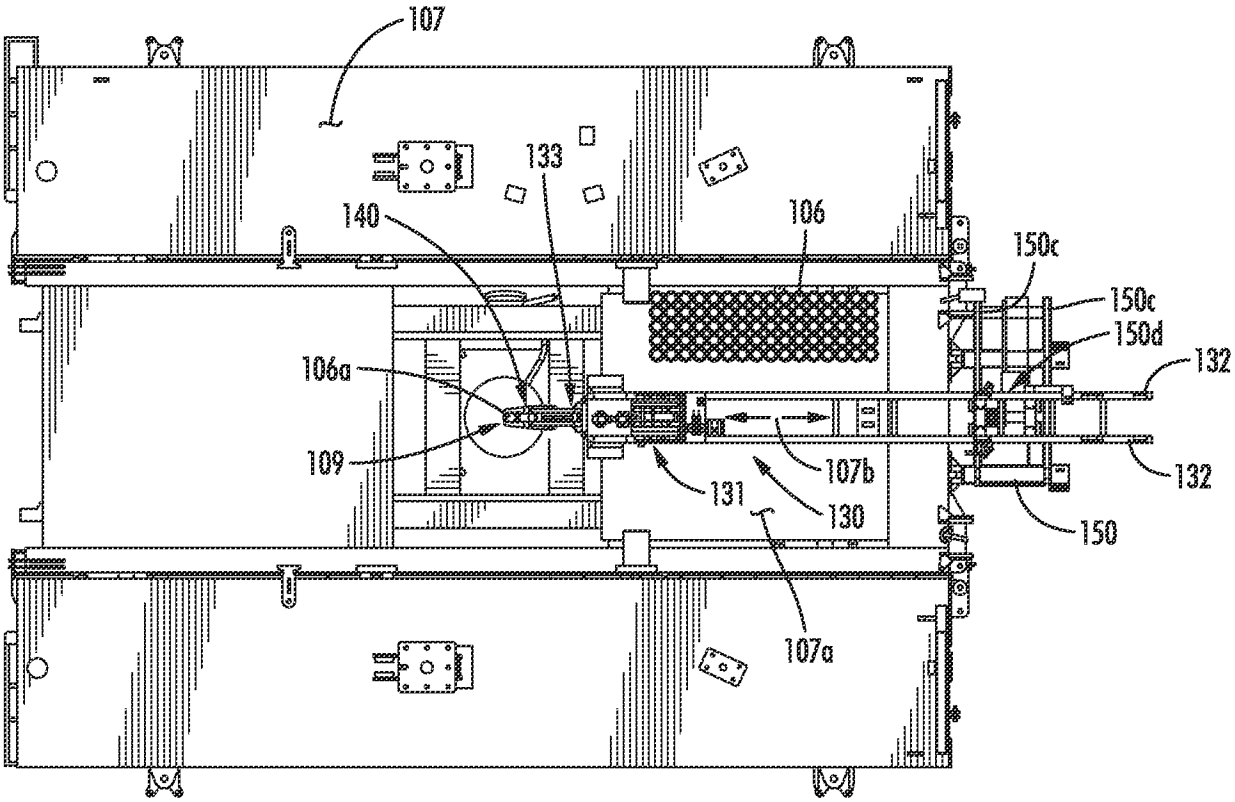

FIGS. 9A-9F depict an exemplary operational sequence of using an illustrative floor mounted racking arm assembly 130 to lift and maneuver the lower end of a drill pipe stand 106*a*. In particular, FIGS. 9A-9C are close-up isometric views of the drilling rig assembly 101 shown in FIGS. 3A and 3B wherein the drilling rig mast 102 and an upper portion of each of the various drill pipe stands 106 have been removed for additional drawing clarity, and FIGS. 9D-9F are plan views of the drilling rig assembly 101 that correspond to each of the respective steps illustrated in FIGS. 9A-9C.

Turning first to FIGS. 9A and 9D, the floor mounted racking arm assembly 130 is removably mounted to the drill floor 107 of the drilling rig assembly 101 such that the pipe handling apparatus conveyance system, e.g., the rails 132, of the racking arm assembly 130 extend down the alleyway 107*b* of the setback area 107*a* and across a drill floor extension platform 150. In certain embodiments, one end of each rail 132 may be removably attached to the setback area 107*a* of the drill floor 107 using the respective floor mounting connections 132*a*. Furthermore, the other end of each rail 132 may be maintained in position above the extension platform 150 by a plurality of roller guides 150*a* that are mounted on a movable platform carriage 150*d*, which is in turn movably coupled to a plurality of platform rails 150*c* on the drill floor extension platform 150. In some embodiments, the roller guides 150*a*, the movable platform carriage 150*d*, and the platform rails 150*c* may also be used to facilitate the removal of the floor mounted racking arm assembly 130 from above the setback area 107*a* of the drill floor 107, as will be further described in conjunction with FIGS. 14A-14I below.

In the exemplary step depicted in FIGS. 9A and 9D, the movable pipe handling apparatus 131 is being moved through the alleyway 107*b*, i.e., between the groups of drill pipe stands 106 positioned on either side of the alleyway 107*b* in setback area 107*a* (only one group of drill pipe stands 106 are included for clarity) along the rails 132 by the column movement carriage 131*b* (see, FIGS. 5A-6C). In the position shown, the lift arm assembly 133 and the lift jaw assembly 140 are in a retracted or collapsed configuration, i.e., wherein each are tucked back into the vertical support column 136 (see, FIGS. 5A-6C). When the lift arm assembly 133 and lift jaw assembly 140 are in this retracted/collapsed configuration, the vertical support column 136 may be rotated substantially freely about the vertical axis 136*x* (see, FIGS. 5A-6C) of the column 136, that is, substantially without any interference from or obstruction by any other drill pipe stands 106 that may be immediately adjacent to the alleyway 107*b* and the rails 132.

Turning now to FIGS. 9B and 9E, the movable pipe handling apparatus 131 has been moved along the rails 132 to a position proximate a row of drill pipe stands 106 that are closest to the wellcenter 109. Furthermore, the vertical support column 136 has been rotated about its vertical axis 136*x* by the column rotation apparatus 131*a* (see, FIGS. 5A-6C) so that the lift jaw assembly 140 is substantially oriented toward a specific drill pipe stand 106*a* located near a front corner of the group of drill pipe stands 106. Additionally, the lift arm assembly 133 has been extended in the manner described above so that the lift jaw assembly 140 can grab and hold the drill pipe stand 106*a*, after which the stand 106*a* can moved into position proximate the wellcenter 109 by the movable pipe handling apparatus 131.

Figure 1B:
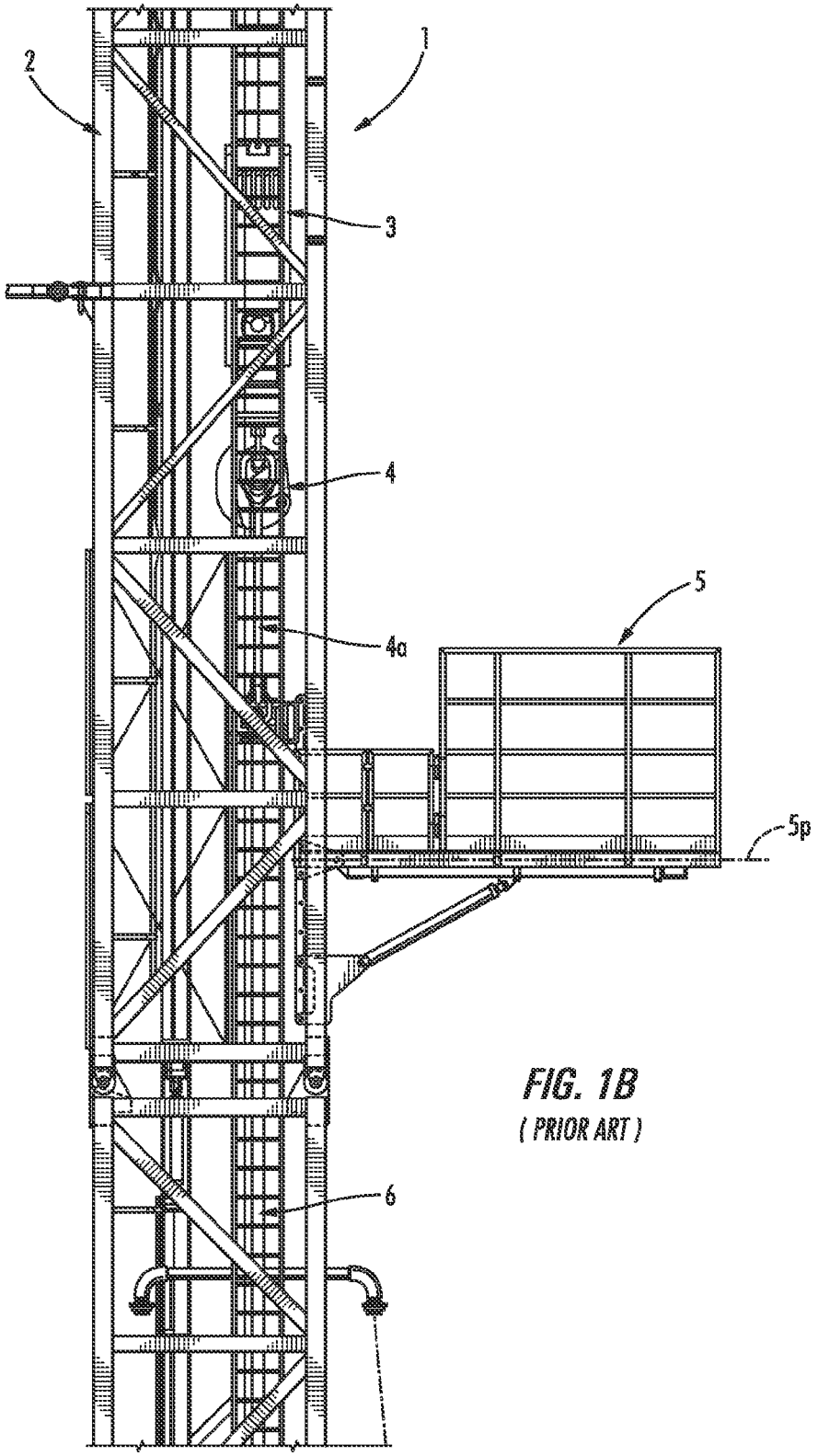
FIG. 1B ( PRIOR ART )
Figure 1C:
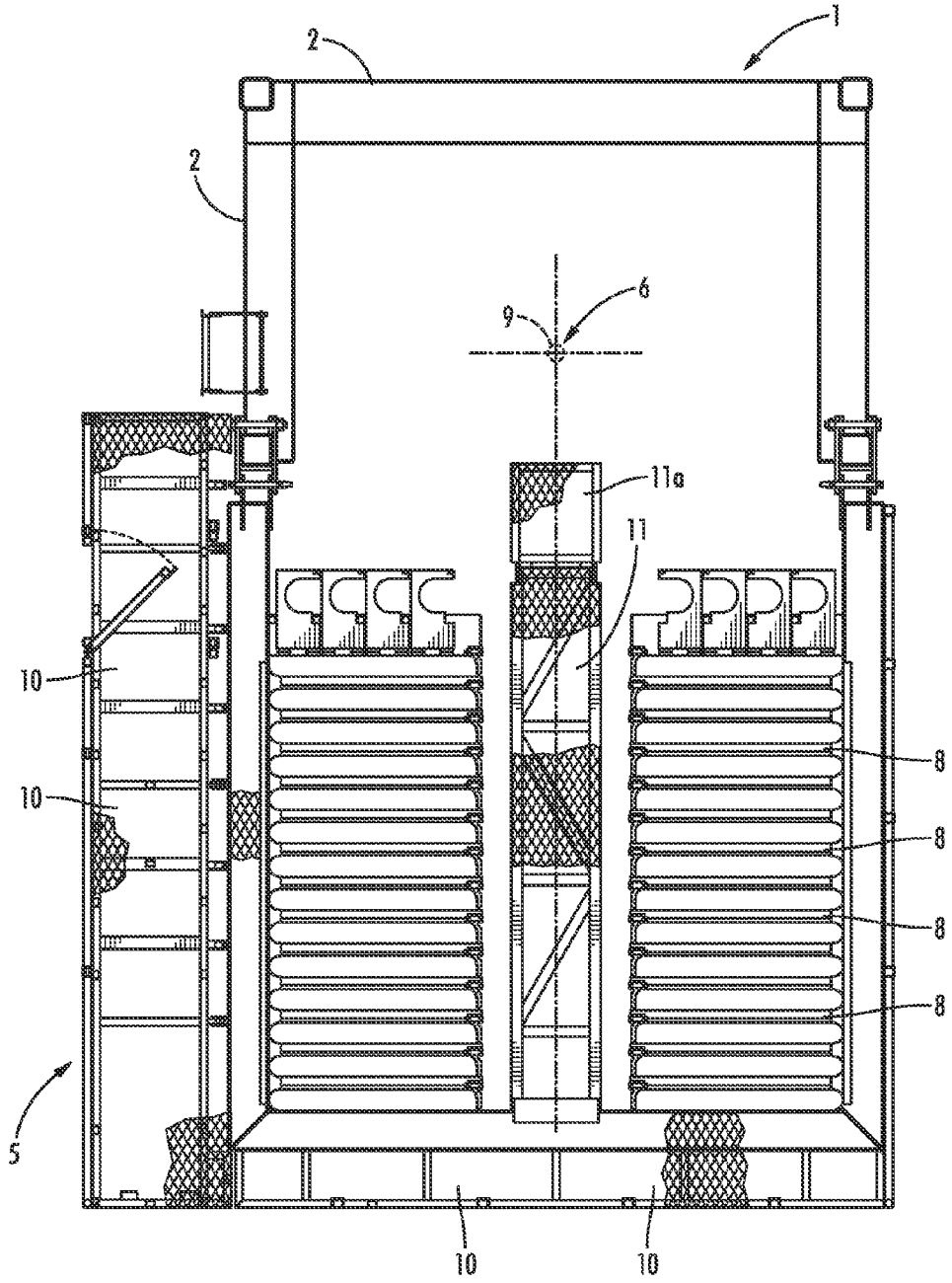
FIG. 1C ( PRIOR ART )
Figure 2A:
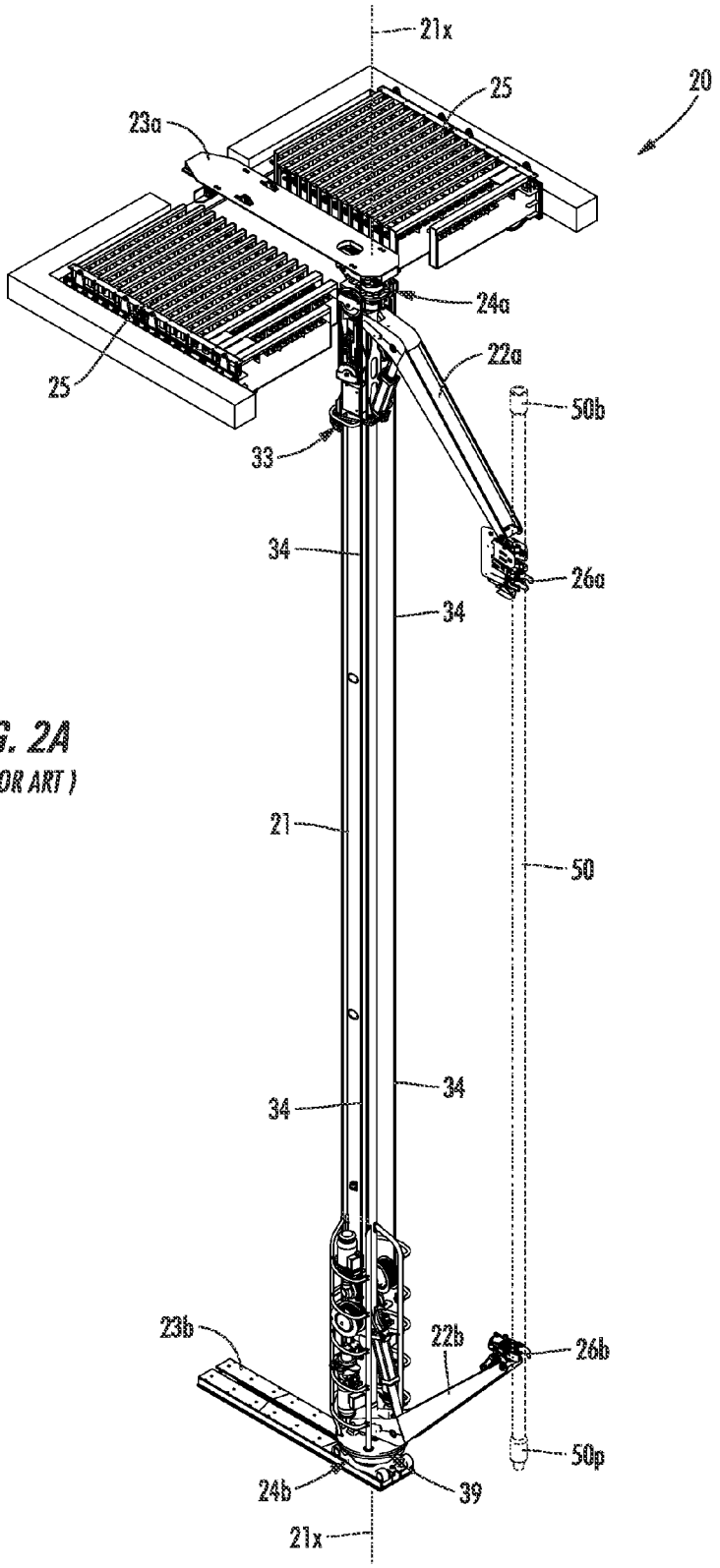
FIG. 2A ( PRIOR ART )
FIGS. 2A-2C are various isometric views of an illustrative prior art mechanical pipe handling system for mechanically handling and moving drill pipe stands during drilling operations.
Figure 2B:
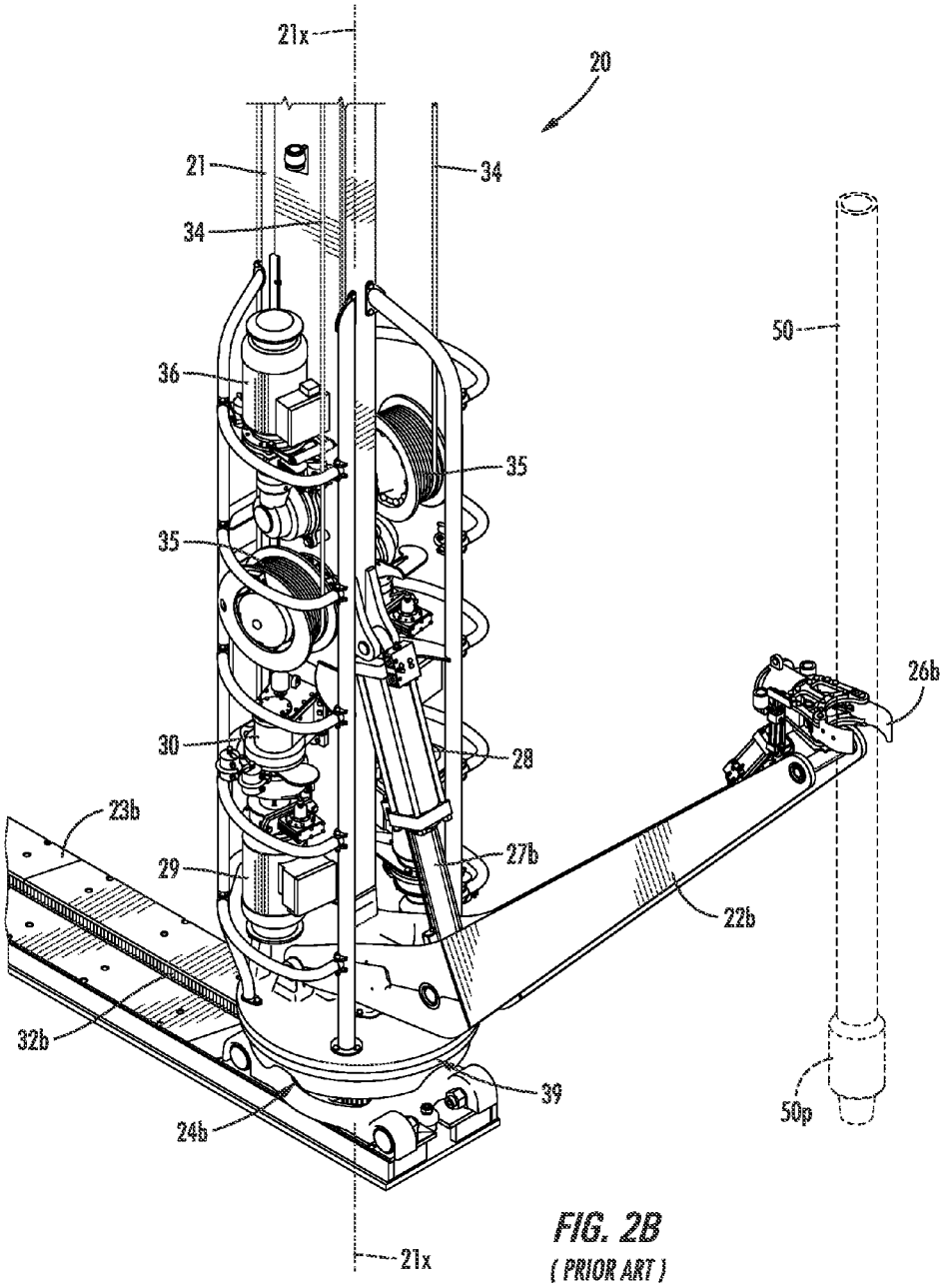
FIG. 2B ( PRIOR ART )
Figure 2C:
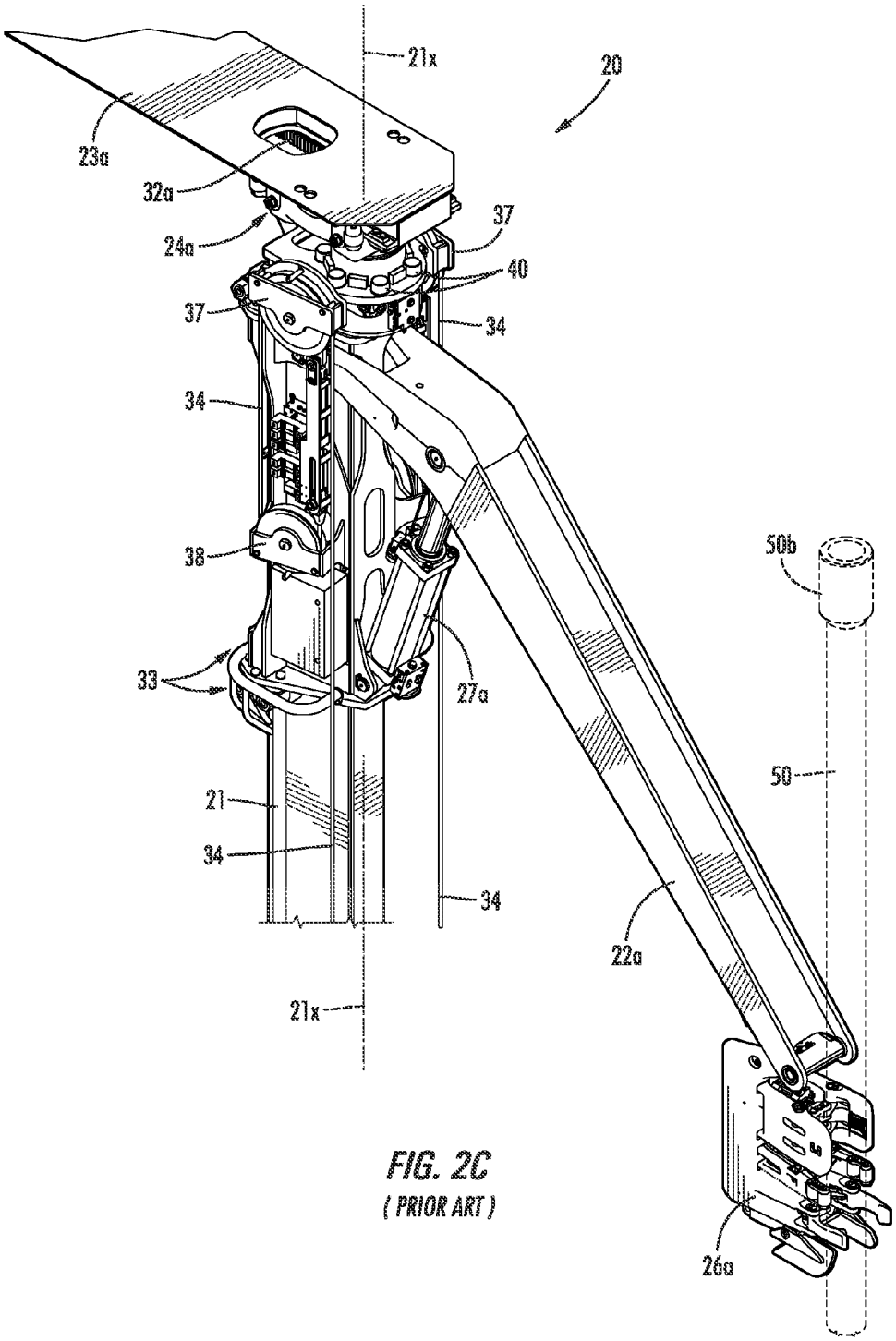
FIG. 2C ( PRIOR ART )

As may be appreciated by those of ordinary skill after a complete reading of the present disclosure, the drill pipe handling steps depicted in FIGS. 9A and 9B may be performed "offline." In other words, since the floor mounted racking arm assembly 130 is fully capable of gripping, lifting, and maneuvering any one of the drill pipe stands 106 substantially without any assistance from the a traveling block assembly (not shown) mounted in the drilling mast 102 (see, FIGS. 3A-4), these type of drill pipe lifting and maneuvering operations may be performed substantially simultaneously while the traveling block assembly is being used to lower a drill string (not shown) into a wellbore (not shown) after a previously maneuvered drill pipe stand 106*b* has been attached to extend the length of the drill string. In this way, a substantial time savings may be realized during drill pipe tripping operations over the type of prior art systems described in conjunction with FIGS. 1A-1C above.

FIGS. 9C and 9F illustrate a further step in the exemplary pipe handling sequence after the drill string with the extending drill pipe stand 106*b* attached thereto has been lowered into the wellbore, and the box end of the drill pipe stand 106*b* (not shown) has been supported by slips so that the next drill pipe stand 106*a* may be attached thereto. As shown in FIGS. 9C and 9F, the lift jaw assembly 140 has been used to grab/clamp onto and fixedly hold the drill pipe stand 106*a*, the lift arm carriage 133*f* (see, FIGS. 5A-7C) has been used to lift/raise the drill pipe stand 106*a* off of the setback area 107*a*, and the column rotation apparatus 131*a* has been used to rotate the vertical support column 136 about the vertical axis 136*x* so that the lift jaw assembly 140 and the drill pipe stand 106*a* are oriented substantially toward the wellcenter 109. Furthermore, in some embodiments, the column movement carriage 131*b* may be used to bring the movable pipe handling apparatus 131 proximate the ends of the rails 132 that are closest to the wellcenter 109, and the lift arm assembly 133 may be extended as previously described so as to position the pin end of the drill pipe stand 106*a* substantially directly above the suspended drill string (not shown). Thereafter, the lift arm assembly 133 may be used to lower the drill pipe stand 106*a* (i.e., by operation of the lift arm carriage 133*f* as previously described) so that the pin end of the drill pipe stand 106*a* may be threadably connected to the box end of the drill pipe stand 106*b* (not shown) at the upper end of the suspended drill string.

Figure 10A:
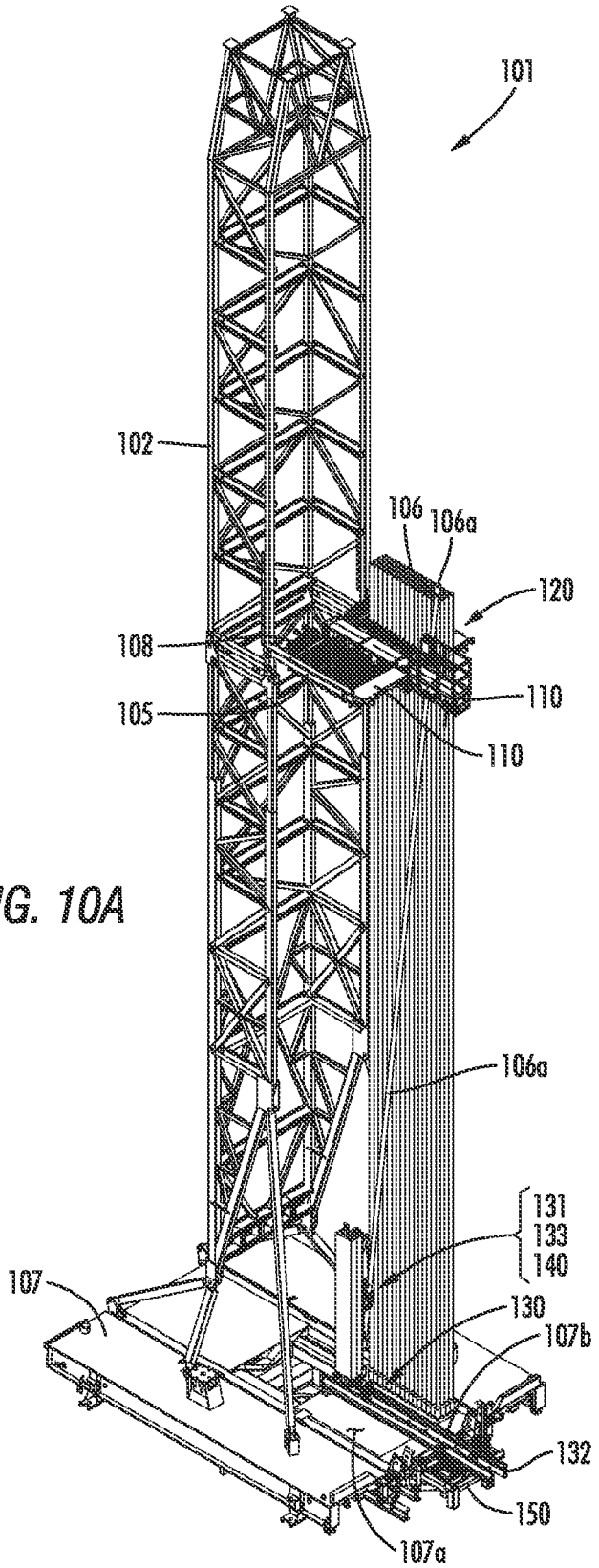
FIGS. 10A and 10B are isometric and elevation views, respectively, of the illustrative drilling rig assembly shown in FIGS. 3A and 3B, wherein the illustrative floor mounted racking arm assembly is lifting and maneuvering a drill pipe stand independent of the upper pipe handling assembly such that the drill pipe stand is misaligned with respect to a substantially vertical axis.
Figure 10B:
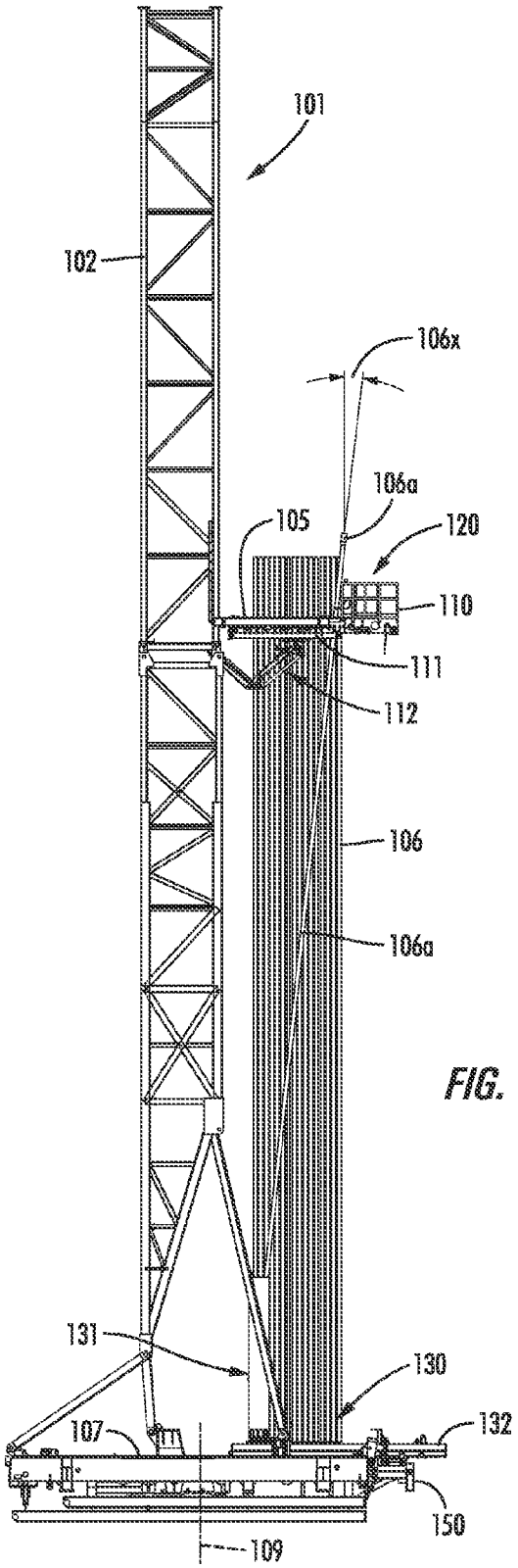
Figure 11A:
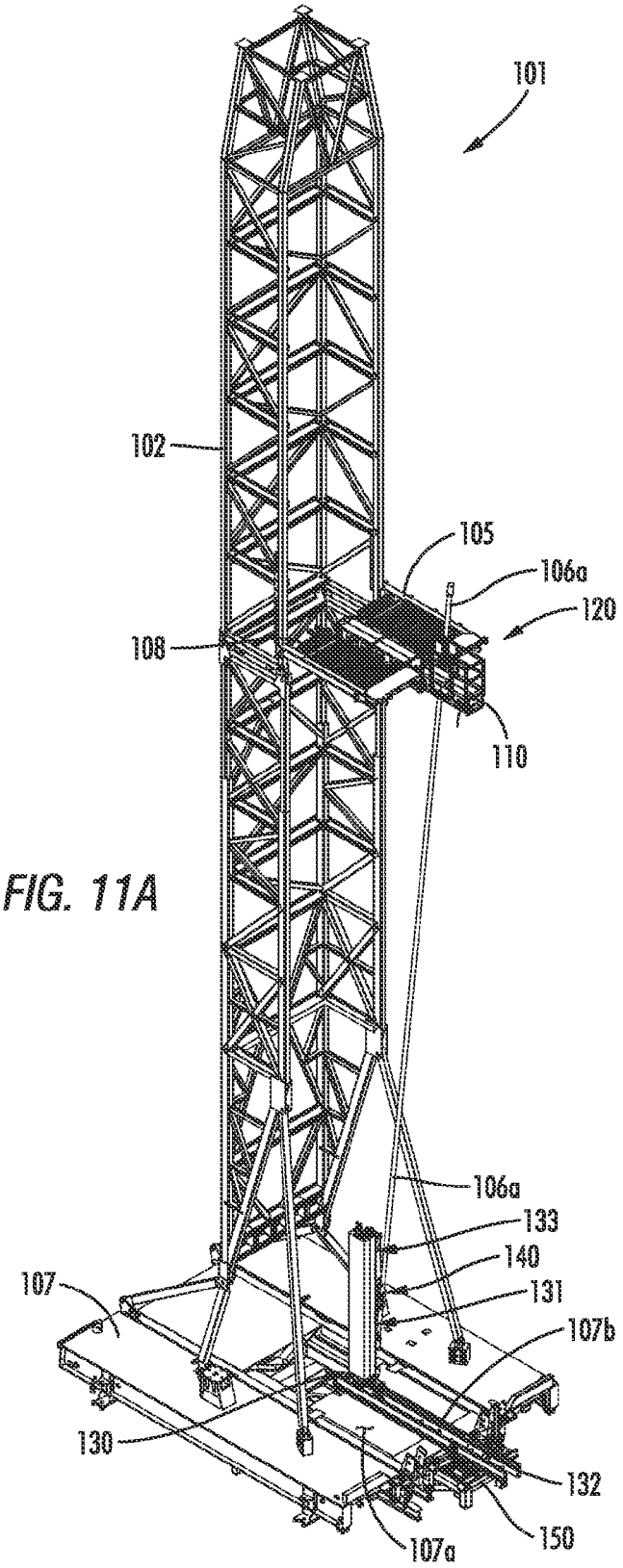
FIGS. 11A and 11B are isometric and elevation views, respectively, that substantially correspond to the views depicted in FIGS. 10A and 10B, wherein the group of drill pipe stands shown in the setback area of FIGS. 10A and 10B have been removed for clarity.
Figure 11B:
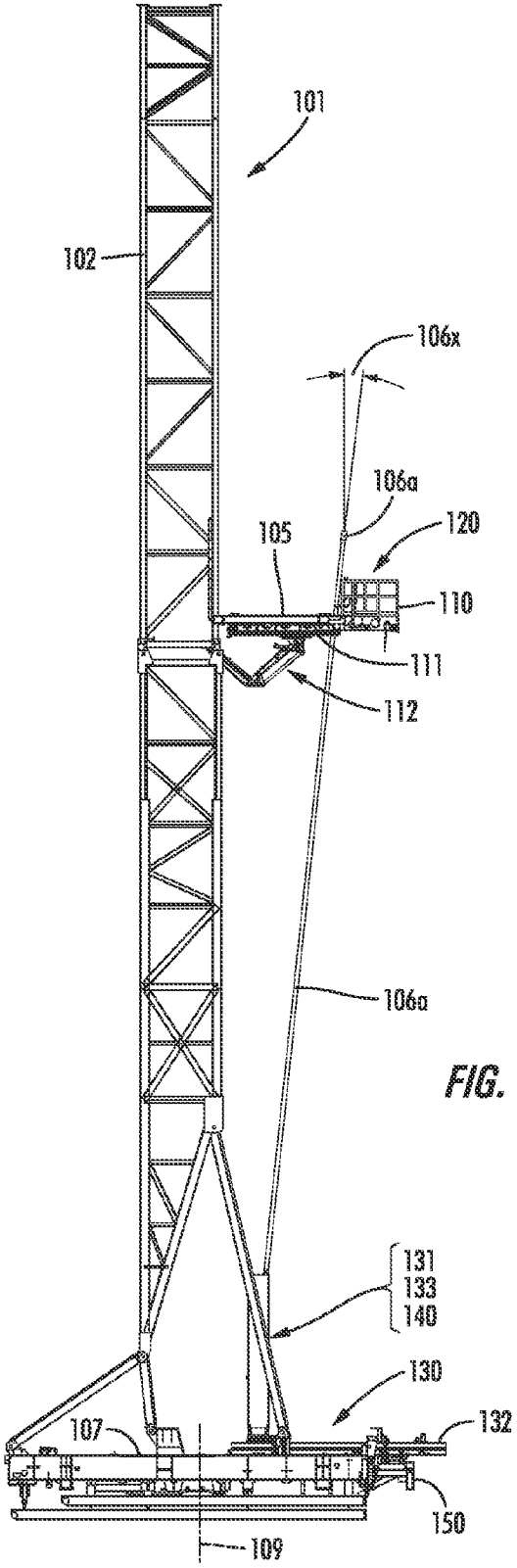
Figure 11C:
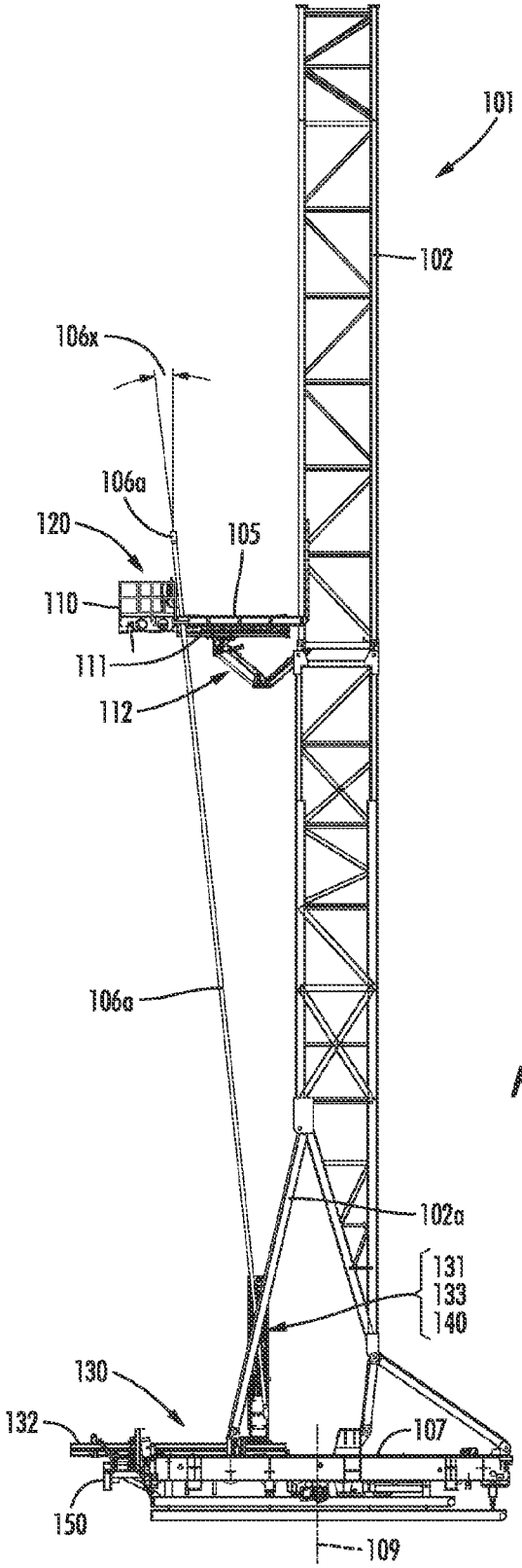
FIG. 11C is an elevation view of the drilling rig assembly shown in FIGS. 11A and 11B when viewed from the opposite side of the drilling rig assembly from the view depicted in FIG. 11B.
Figure 11D:
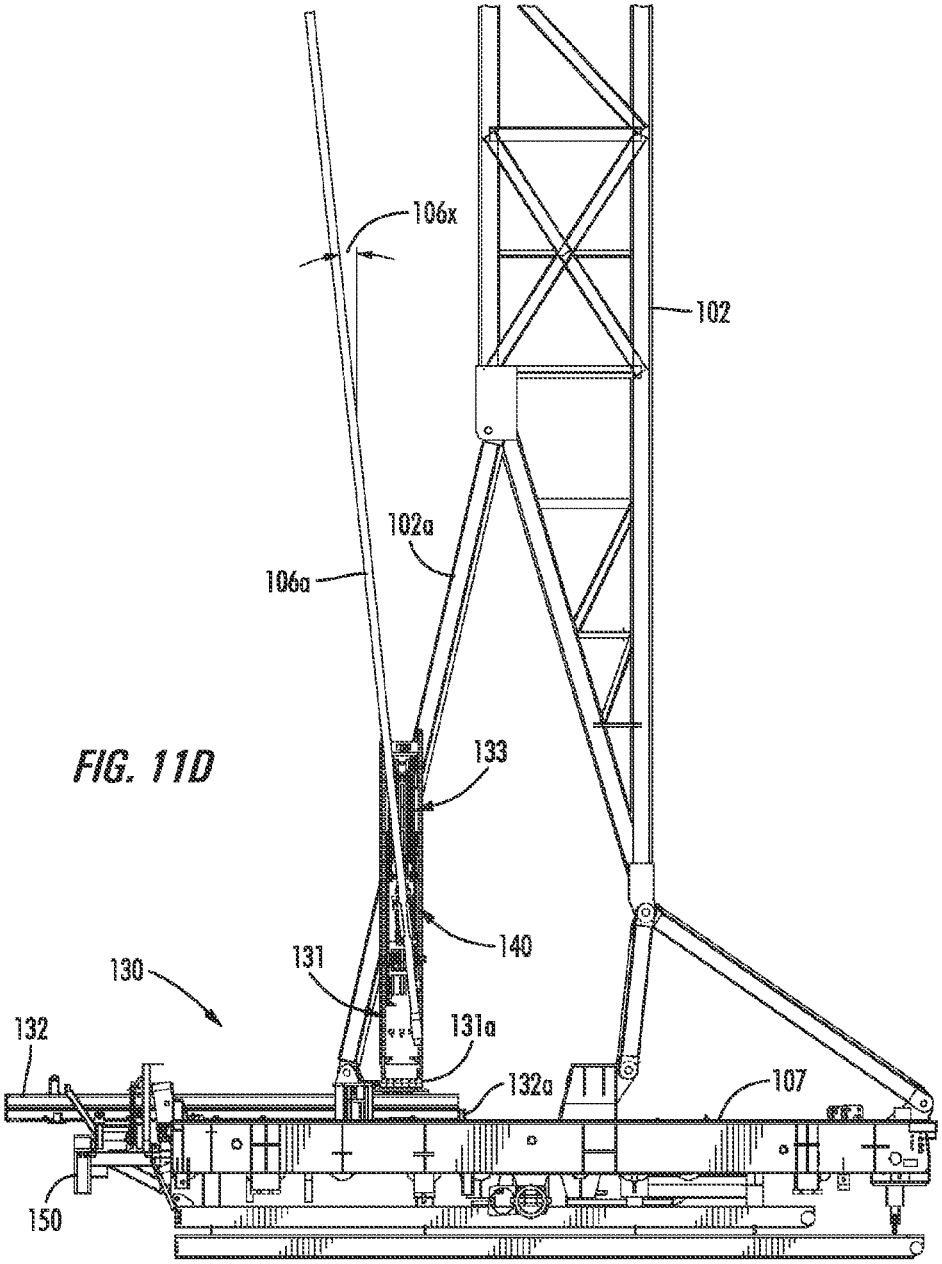
FIG. 11D is a close-up elevation view of the lower portion of the drilling rig assembly shown in FIG. 11C, wherein a drilling rig mast brace has been removed for clarity.

As noted previously, the various illustrative embodiments of the floor mounted racking arm assembly 130 disclosed herein may be operated to lift the pin (lower) end of a drill pipe stand 106 and position the drill pipe stand 106 substantially independently of any traveling block assembly that may be used to raise or lower a drill pipe string into or out of a drilled wellbore during pipe tripping operations. FIGS. 10A-11D illustrate various different aspects of the present disclosure wherein an exemplary floor mounted racking arm assembly 130 may be operated to handle and move a drill pipe stand 106*a* substantially independently of a pipe handling assembly that is used to maneuver the box (upper) end of the drill pipe stand 106*a*, such as the upper pipe handling assembly 120 and stand transfer apparatus 112 depicted in FIGS. 3A-4. In particular, FIGS. 10A and 10B are isometric and elevation views of the drilling rig assembly 101 that correspond to the isometric and elevation views shown in FIGS. 3A and 3B, respectively, and depict an illustrative embodiment wherein the floor mounted racking arm assembly 130 is handling a drill pipe stand 106*a* that is misaligned with respect to a substantially vertical axis. Furthermore, FIGS. 11A and 11B depict the same views as shown in FIGS. 10A and 10B, wherein however the group of drill pipe stands 106 vertically staged on and above the setback area 107*a* of the drill floor 107 have been removed so that aspects of the floor mounted racking arm assembly 130 and the misaligned drill pipe stand 106*a* can be viewed more clearly. FIG. 11C is a driller's side elevation view of the drilling rig assembly 101 shown in FIGS. 11A and 11B (as compared to the off-driller's side elevation view of the drilling rig 101 shown in FIG. 1B), and FIG. 11D is a close-up view of the driller's side elevation view depicted in FIG. 11C, wherein a driller's side leg brace 102*a* has been removed for further drawing clarity.

Turning to FIGS. 11A-11D, the lift jaw assembly 140 of the floor mounted racking arm assembly 130 is shown grabbing onto and holding the lower (box) end of drill pipe stand 106*a* while the upper (pin) end of the drill pipe stand 106*a* is still positioned between racking fingers 108 of the fingerboard 105. As a result, the drill pipe stand 106*a* is depicted as being vertically misaligned between the pin and box ends thereof at an angle 106*x* relative to a substantially vertical axis. In other embodiments, the drill pipe stand 106 may be similarly vertically misaligned at an angle 106*x* when the box end of the drill pipe stand 106*a* is being maneuvered from its position in the fingerboard 105 over the to the wellcenter 109 while the pin end of the drill pipe stand 106*a* remains in the setback area 107*a*. It should be appreciated, however, that the magnitude of the vertical misalignment angle 106*x* will vary depending on the relative positions of the box end and pin end of the drill pipe stand 106*a* during the specific pipe handling process.

For example, in those illustrative embodiments where the stand transfer apparatus 112 and the floor mounted racking arm assembly 130 are being operated in substantial concert with one another, the vertical misalignment angle 106*x* may be very small, such as less than 1° or even substantially 0°. However, when the position of the stand capture head 112*c* (see, FIG. 4) of stand transfer apparatus 112 either substantially lags behind or substantially leads ahead of the position of the lift jaw assembly 140, the vertical misalignment angle 106*x* may be significantly greater, such as on the order of 2°-5° or more. Furthermore, the magnitude of the misalignment angle 106*x* would typically be its greatest in those situations wherein, for example, the box end of the drill pipe stand 106*a* remains in the fingerboard 105 as the pin end is moved by the floor mounted racking arm assembly 103 proximate the wellcenter 109, or when the pin end of the drill pipe stand 106*a* is moved from the wellcenter 109 back to the setback area 107*a* while the box end is coupled to the top drive system (not shown) of the drilling rig assembly 101.

As noted previously with respect to FIG. 8A-8F, the lift jaw assembly 140 may be adapted to pivot or twist about the substantially horizontally oriented axis 141*x* of a pinned connection 141*c* that pivotably couples the lift jaw gripping apparatus 143 of the lift jaw assembly 140 to the lift jaw support lug 141 (see, FIGS. 12 and 13A), thus accommodating the vertical misalignment angle 106*x* of the drill pipe stand 106*a*. In certain illustrative embodiments, the lift jaw assembly 140 may be adapted to accommodate a misalignment angle 106*x* that ranges up to approximately 8-10° or even greater, depending on the various design and operational parameters of the floor mounted racking arm assembly 130 and the upper pipe handling assembly 120. For example, such parameters may include the distance between drill floor 107 and the fingerboard 105, the lateral distance between the wellcenter 109 and the furthermost racking fingers 108 of the fingerboard 105, and/or the lateral distance between a top drive assembly (not shown) of the drilling rig assembly 101 and the furthest edge of the setback area 107*a*, and the like.

Figure 12:
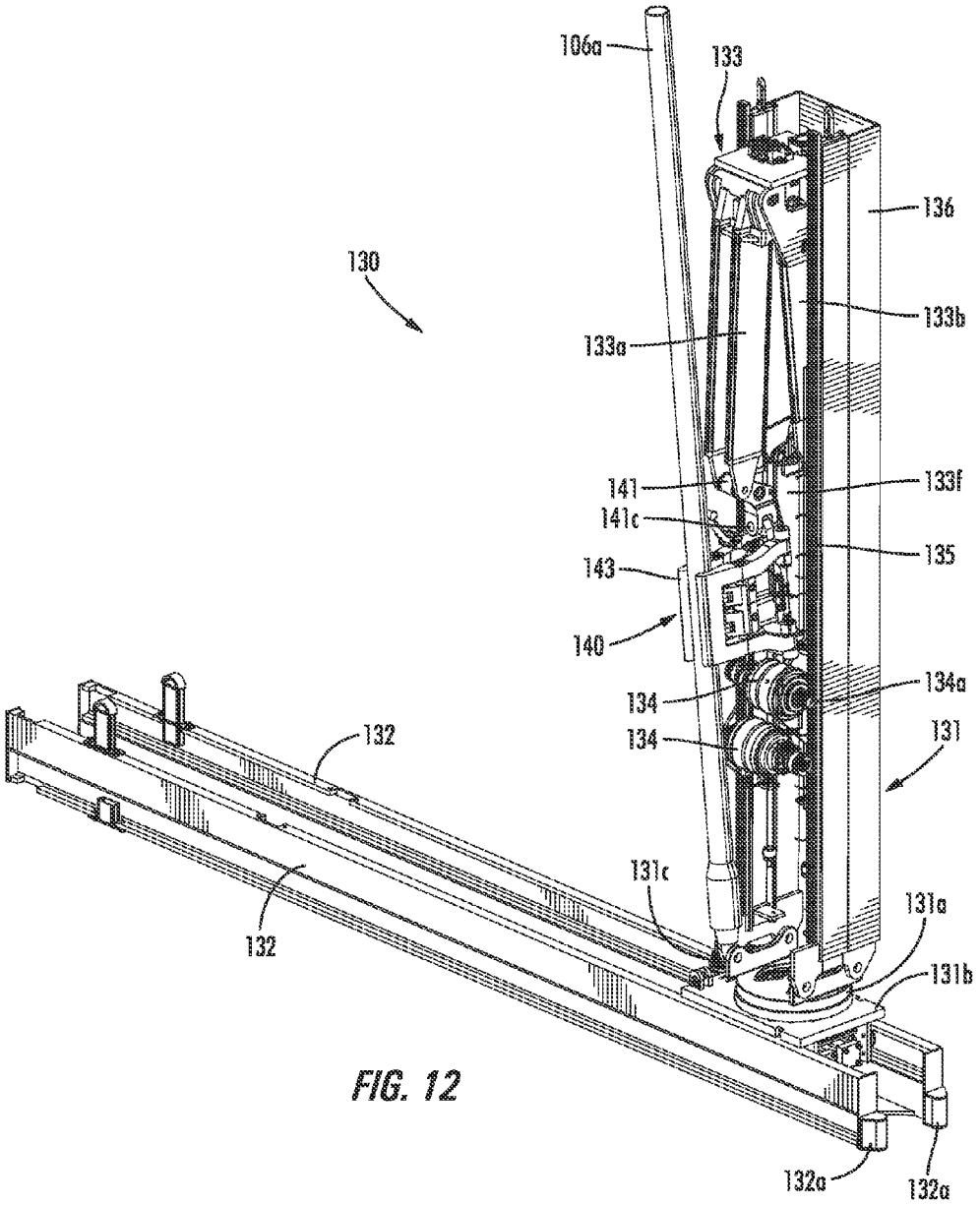
FIG. 12 is an isometric view of exemplary floor mounted racking arm assembly depicted in FIGS. 11A-11D.
Figure 13A:
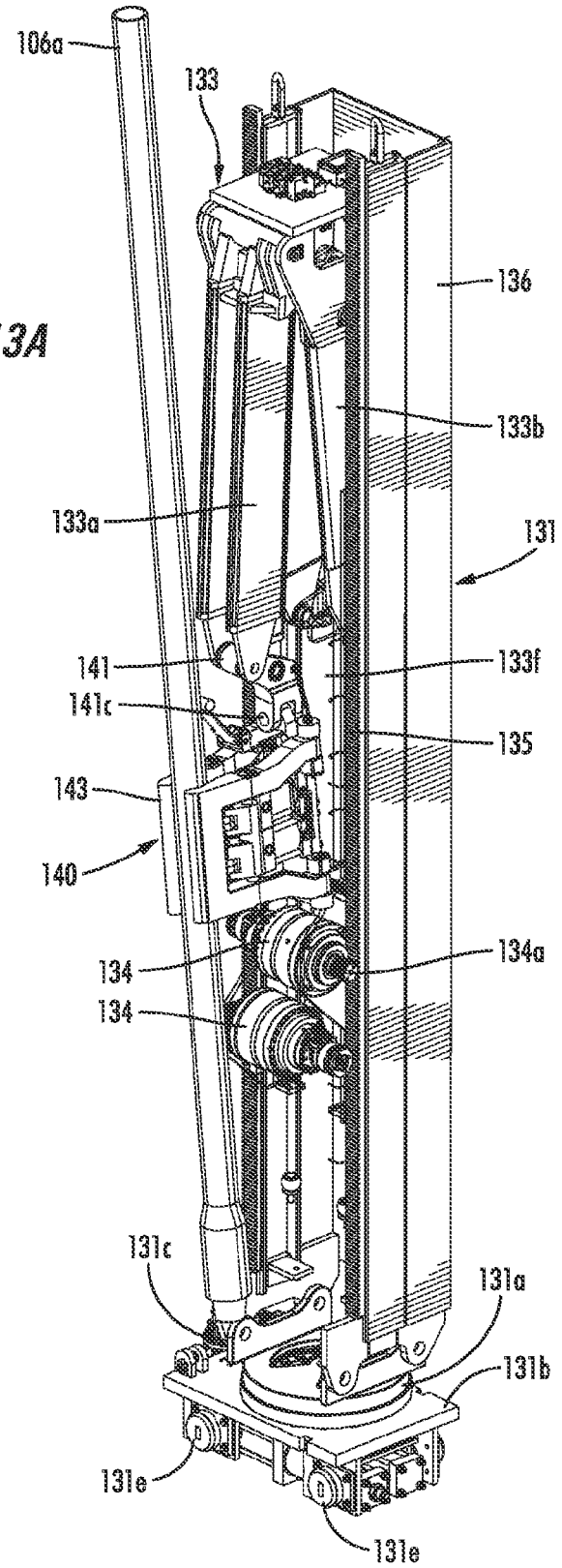
FIGS. 13A-13C are various isometric and elevation views the movable pipe handling apparatus of the illustrative floor mounted racking arm assembly shown in FIG. 12 in accordance with one exemplary embodiment disclosed herein.
Figure 13B:
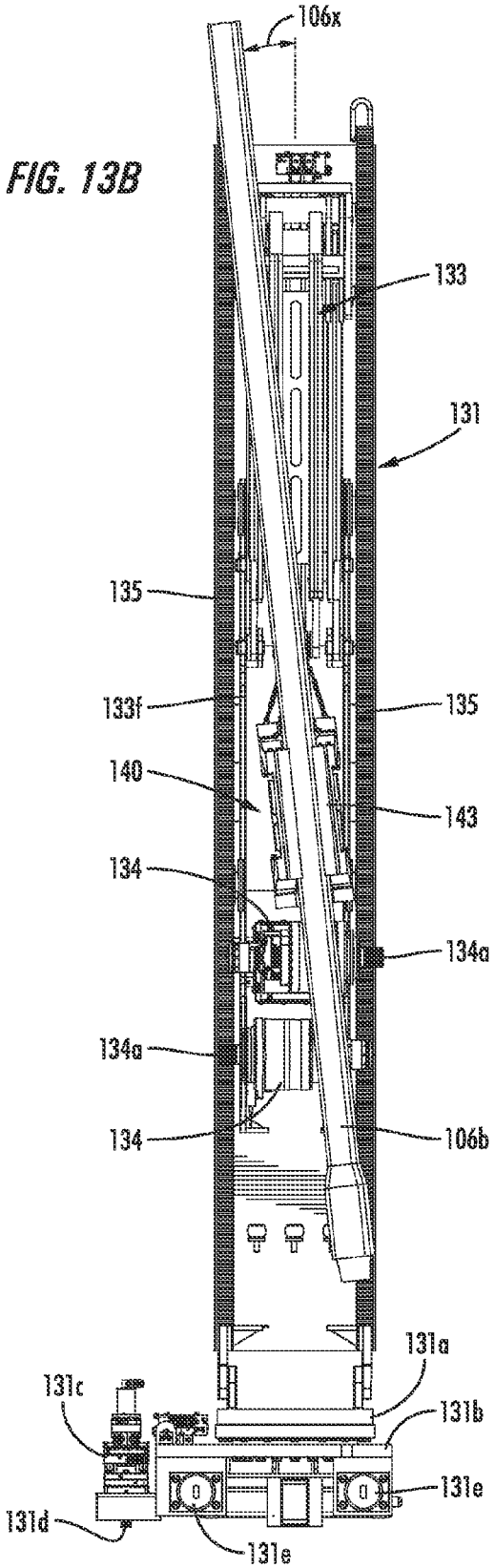
Figure 13C:
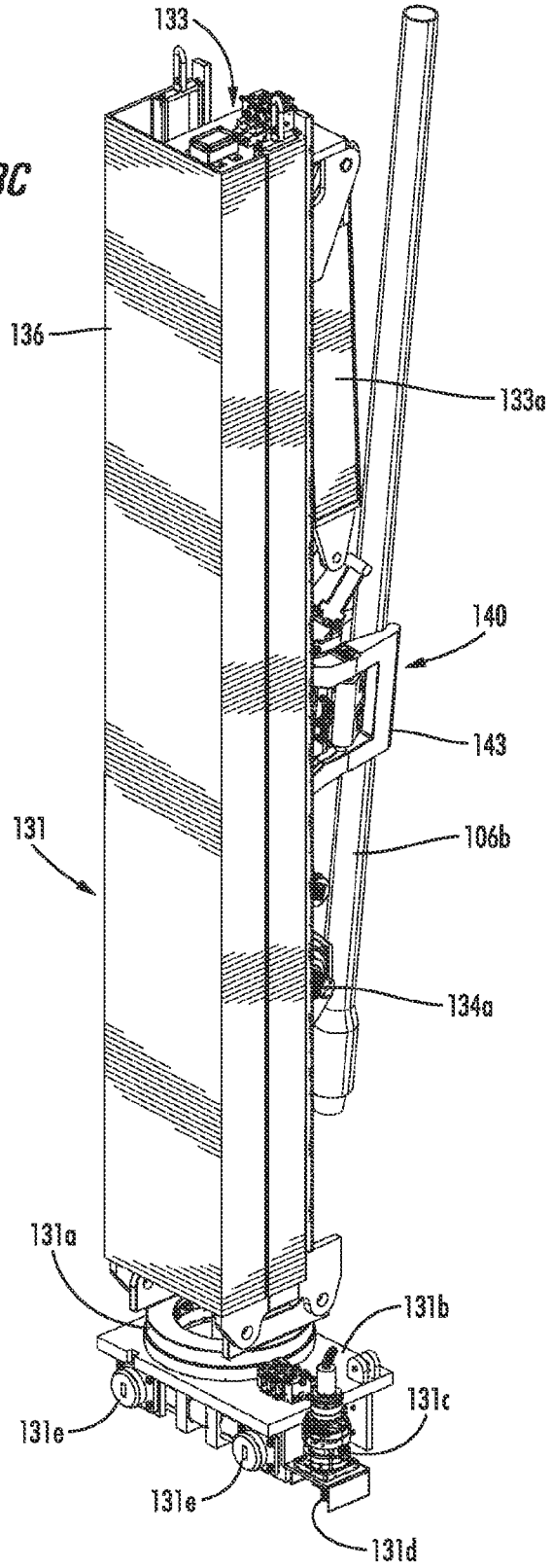

FIGS. 12-13C are various close-up views of the floor mounted racking arm assembly 130 shown in FIGS. 10A-11D which depict additional detailed aspects of the floor mounted racking arm assembly 130 as it handles a vertically misaligned drill pipe stand 106*a*, however some elements depicted in FIGS. 10A-11D have been removed for drawing clarity. More specifically, FIG. 12 is an isometric view of the exemplary floor mounted racking arm assembly 130 wherein the drilling mast 102 and the surrounding drill floor 107 have been removed, and FIGS. 13A-13C are various isometric and elevation views of a movable pipe handling apparatus 131 of the floor mounted racking arm assembly 130 shown in FIG. 12 wherein the pipe handling apparatus conveyance system, e.g., the rails 132, have also been removed. As shown in FIGS. 12-13C, the drill pipe stand 106*a* is vertically misaligned at an angle 106*x* relative to a substantially vertical direction and the lift jaw assembly 140 is clamping/gripping the vertically misaligned drill pipe stand 106*a*. Furthermore, in this configuration the lift jaw gripping apparatus 143 is rotated or twisted about the substantially horizontally oriented axis 141*x* of the pinned connection 141*c* at substantially the same vertical misalignment angle 106*x* as that of the drill pipe stand 106*a*, as can best be seen in FIG. 13B, which is a close-up elevation view of the movable pipe handling apparatus 131 when viewed from the driller's side of the drilling rig assembly 101 shown in FIGS. 10A-11D.

In some embodiments disclosed herein, it may sometimes be necessary to remove the floor mounted racking arm assembly 130 from the setback area 107*a* so as to clear up space on the drill floor 107 to perform other rig operations or activities. For example, depending on the design of a given drilling rig assembly 101, the size of the setback area 107*a* may sometimes limit the total number of drill pipe stands 106 that can be vertically staged adjacent to the drilling mast 102 for drilling and/or tripping operations. As such, additional drill pipe stands 106 may sometimes have to be periodically assembled and staged in the setback area 107*a* during the wellbore drilling process in order to support the required target depth of the drilled wellbore. In such cases, it may be necessary to move the floor mounted racking arm assembly 130 out of the alleyway 107*b* and off of the setback area 107*a* so that additional joints of drill pipe can be moved from a horizontal pipe staging/laydown area adjacent to the drill rig assembly 101 and assembled into additional drill pipe stands 106 so they can be vertically staged in the setback area 107*a* before further drilling or tripping operations can proceed. In other cases, it may be necessary to perform maintenance activities on the floor mounted racking arm assembly 130, e.g., as a result of malfunctioning and/or damaged components, while still performing the requisite ongoing drilling and/or tripping operations based upon alternative pipe handling methods, such as the manual methods described above. In still other instances, it may be necessary to simply free up drill floor space in order to move in other equipment or materials, and/or perform other drilling rig operations, such as bringing additional drill pipe from staging areas (not shown) at grade level adjacent to the drilling rig 101 up to the drill floor, and the like.

Figure 14A:
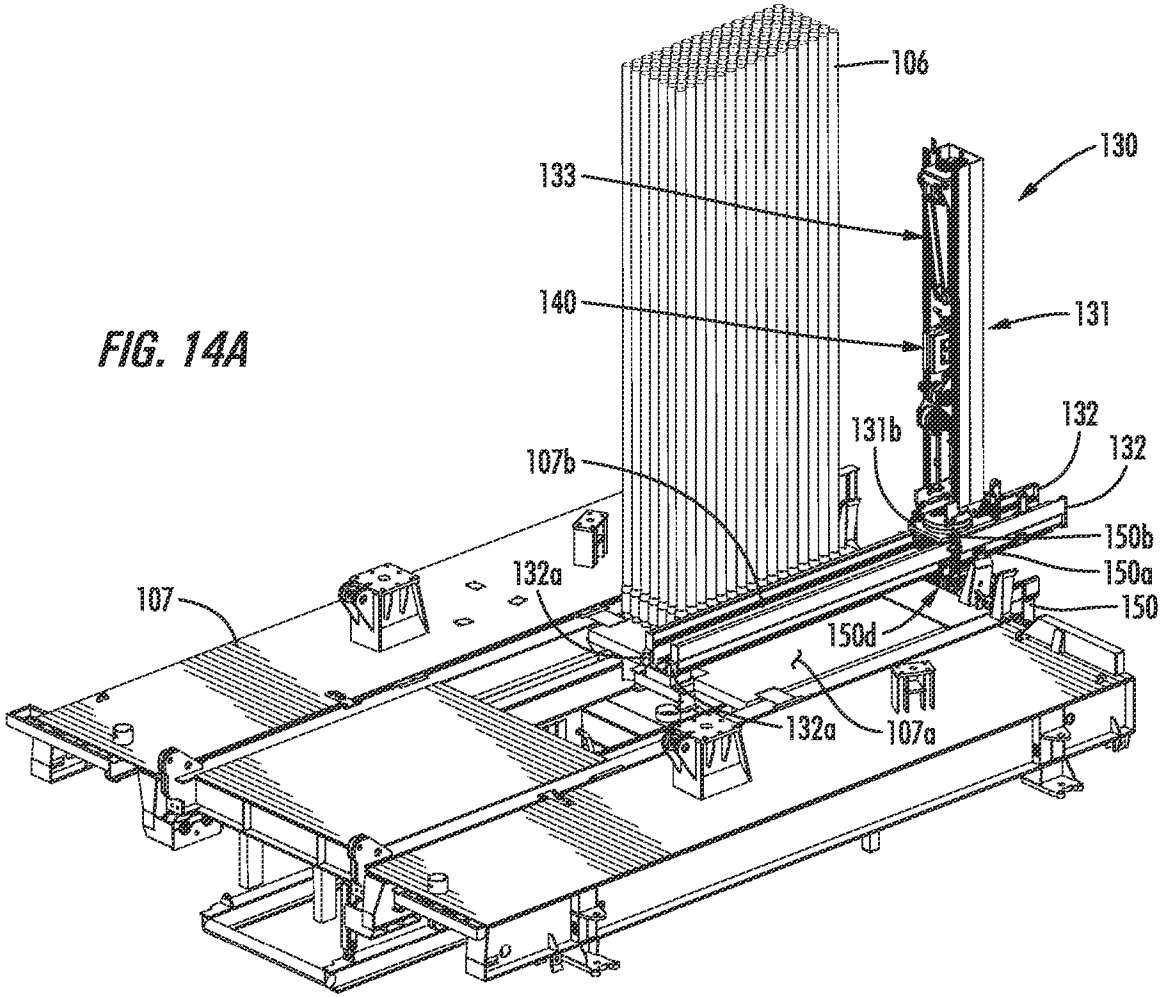
FIGS. 14A-14C are close-up isometric views of the drilling rig assembly shown in FIGS. 3A and 3B wherein the drilling rig mast has been removed for clarity, and depict an illustrative operational sequence wherein the disclosed floor mounted racking arm assembly is operated so as to remove itself from the setback area of the drill floor.
Figure 14B:
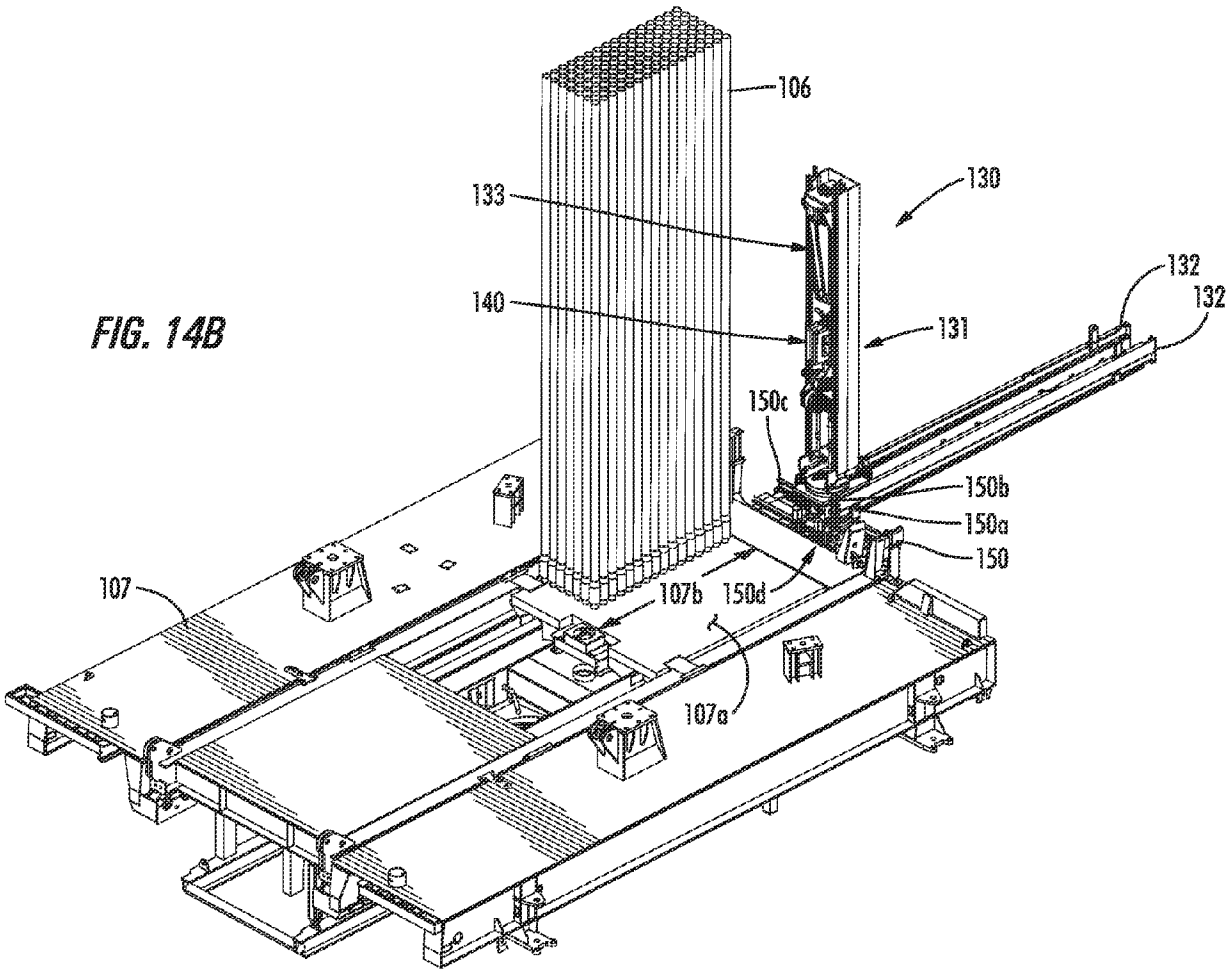
Figure 14C:
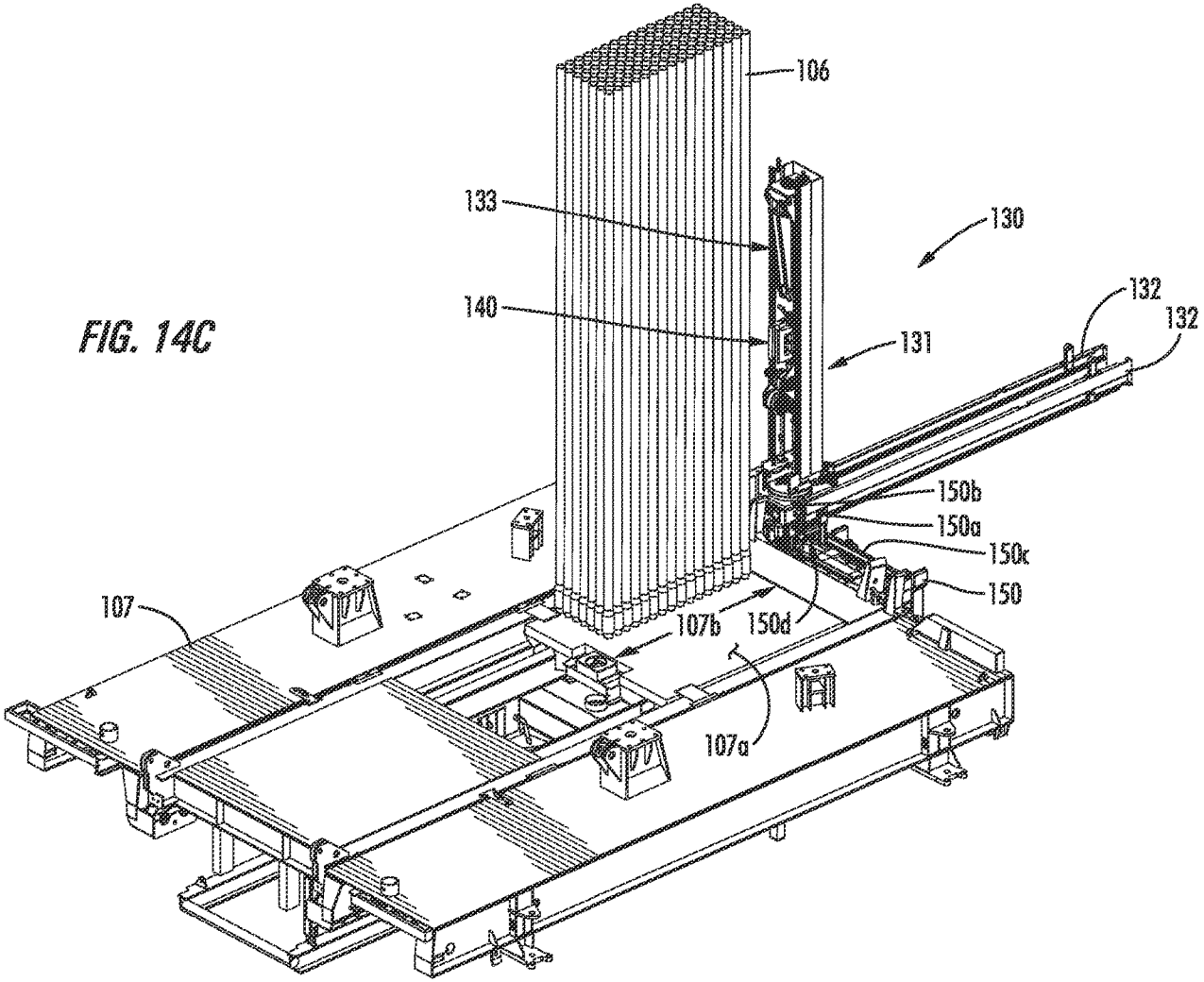
Figure 14D:
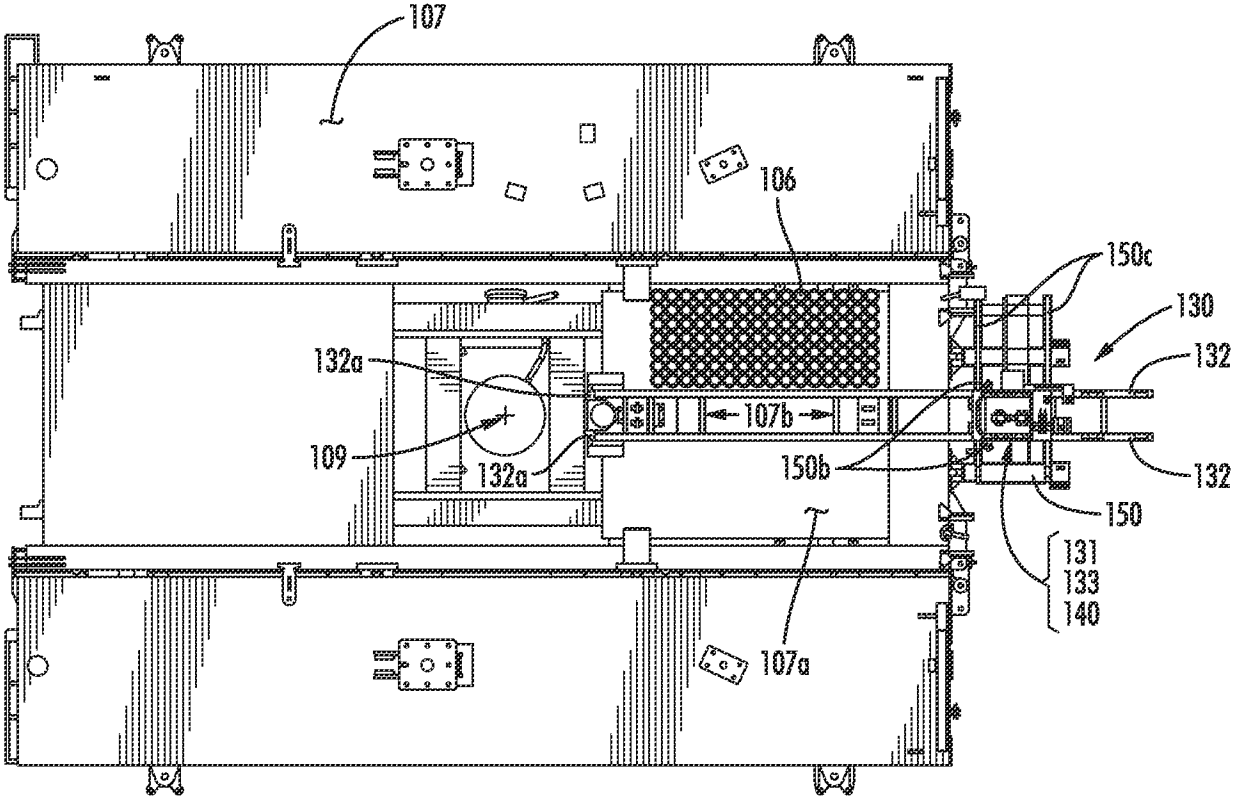
FIGS. 14D-14F are plan views of the illustrative floor mounted racking arm assembly that correspond to the exemplary operational sequence depicted in the isometric views of FIGS. 14A-14C, respectively.
Figure 14E:
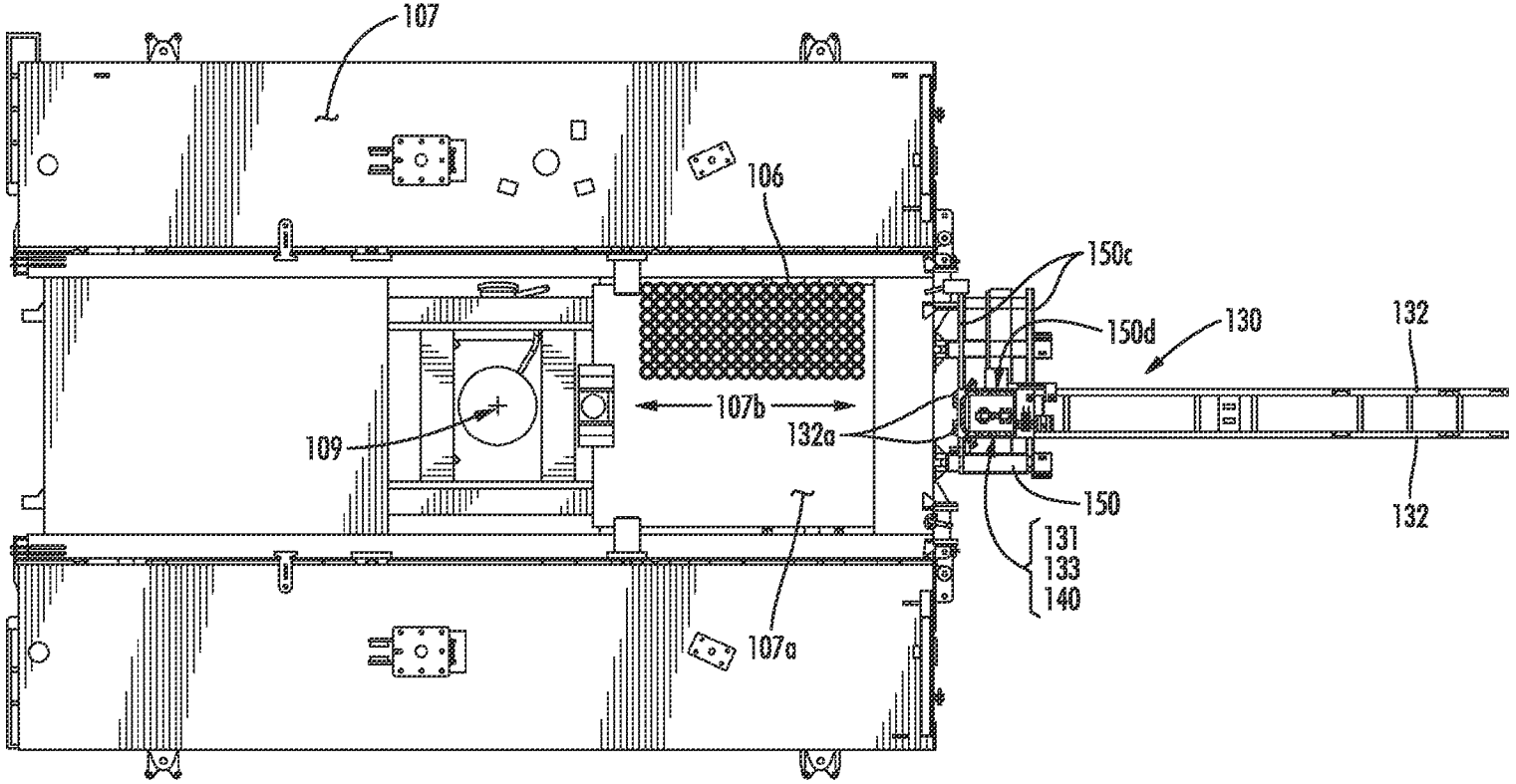
Figure 14F:
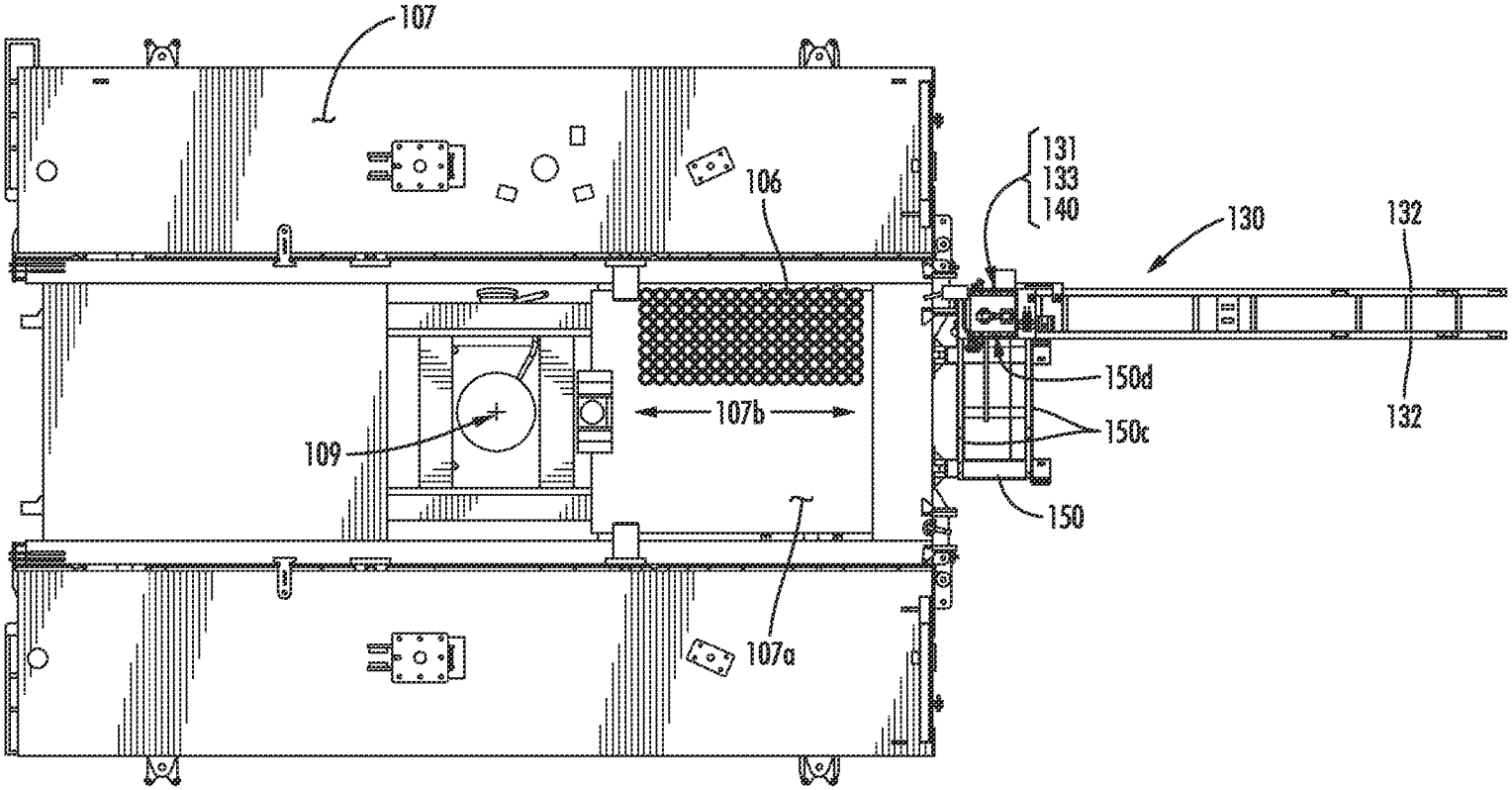

To that end, FIGS. 14A-14I depict one illustrative sequence of operating a disclosed embodiment of the floor mounted racking arm assembly 130 in such a manner as to remove itself from the setback area 107*a*, thereby opening up the alleyway 107*b* for performing other drilling rig operations, such as the above-described drilling support and/or maintenance activities and the like. In particular, FIGS. 14A-14C are close-up isometric views of the drilling rig assembly 101 shown in FIGS. 3A and 3B that illustrate an exemplary sequence of operating steps for removing the floor mounted racking arm assembly 130 from the setback area 107*a*, wherein the drilling rig mast 102 and an upper portion of each of the various drill pipe stands 106 have been removed for additional drawing clarity in similar fashion to FIGS. 9A-9C above. Additionally, FIGS. 14D-14F are plan views of the drilling rig assembly 101 that correspond to each of the respective operating steps illustrated in FIGS. 14A-14C, and FIGS. 14G-14I are further zoomed-in isometric views that depict additional close-up detail of the respective views and steps depicted in FIGS. 14A-14C.

Figure 14G:
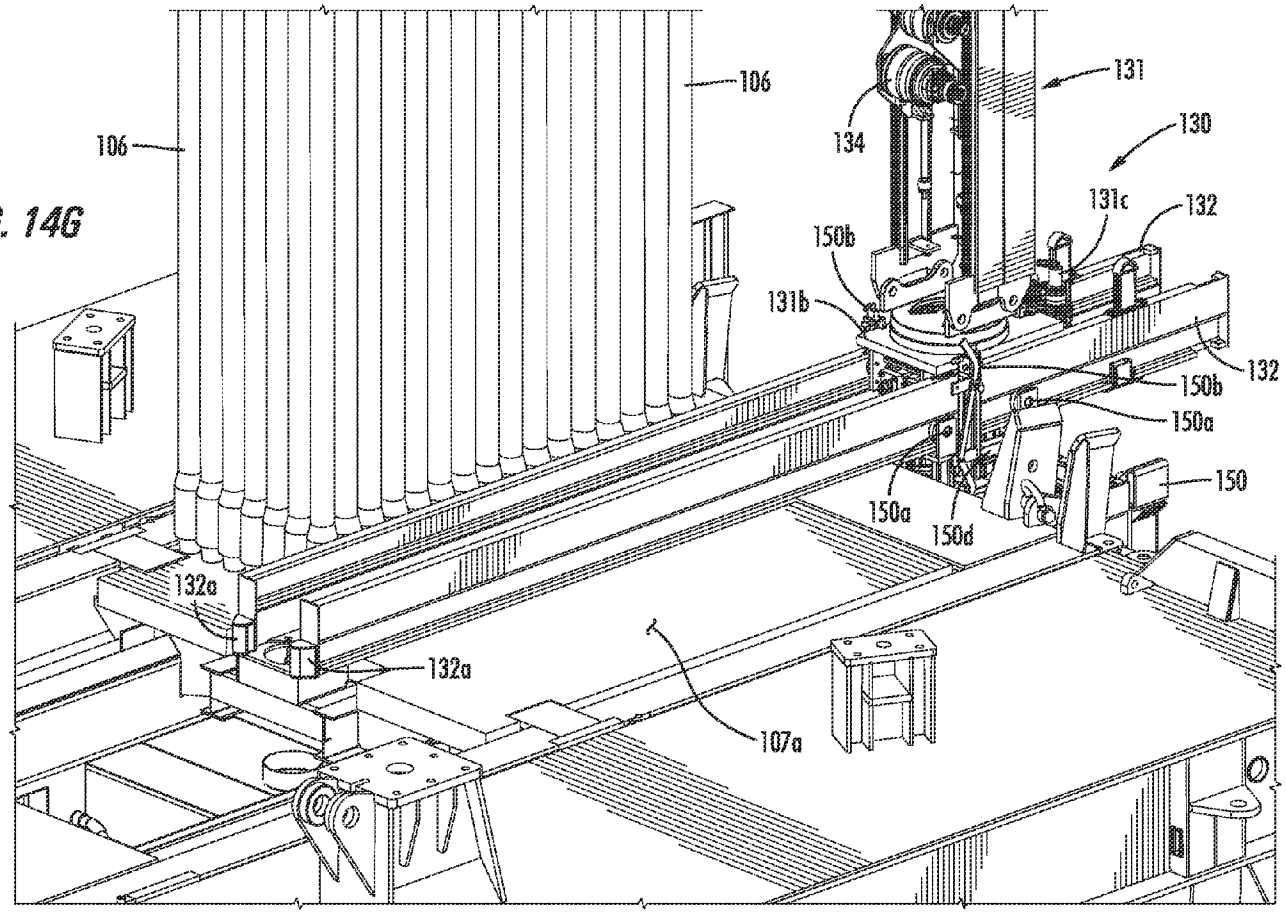
FIGS. 14G-14I are further zoomed-in close-up isometric views of the exemplary floor mounted racking arm assembly that correspond to the exemplary operational sequence depicted in the isometric views shown in FIGS. 14A-14C.

Turning first to FIGS. 14A, 14D, and 14G, the floor mounted racking arm assembly 130 is removably mounted to the drill floor 107 of the drilling rig assembly 101 such that the pipe handling apparatus conveyance system, e.g., the rails 132, of the racking arm assembly 130 extend down the alleyway 107*b* of the setback area 107*a* and across the drill floor extension platform 150. As previously described with respect to FIGS. 9A and 9D above, the rails 132 may be maintained in place above the drill floor extension platform 150 by a plurality of roller guides 150*a* that are mounted on a movable platform carriage 150*d*, which is in turn movably coupled to a plurality of platform rails 150*c* on the extension platform 150, as best shown in FIGS. 14G-14I.

Rather than traversing the alleyway 107*b* during pipe handling operations as depicted in FIGS. 9A and 9D, FIGS. 14A, 14D, and 14G show that the column movement carriage 131*b* has been used to move the movable pipe handling apparatus 131 off of the setback area 107*a* and positioned above the movable platform carriage 150*d* on the drill floor extension platform 150. Once the movable pipe handling apparatus 131 has been moved off of the setback area 107*a* of the drill floor 107, carriage locking apparatuses 150*b* may be operated so as to engage corresponding position locking mechanisms on either side of the column movement carriage 131*b*, thereby locking the movable pipe handling apparatus 131 in position above the movable platform carriage 150*d*, as best shown in FIG. 14G. Thereafter, the floor mounting connections 132*a* attaching the rails 132 to the drill floor 107 proximate the wellcenter 109 may be disconnected in preparation for retracting the rails 132 from above the setback area 107*a*, as will be further described below.

Figure 14H:
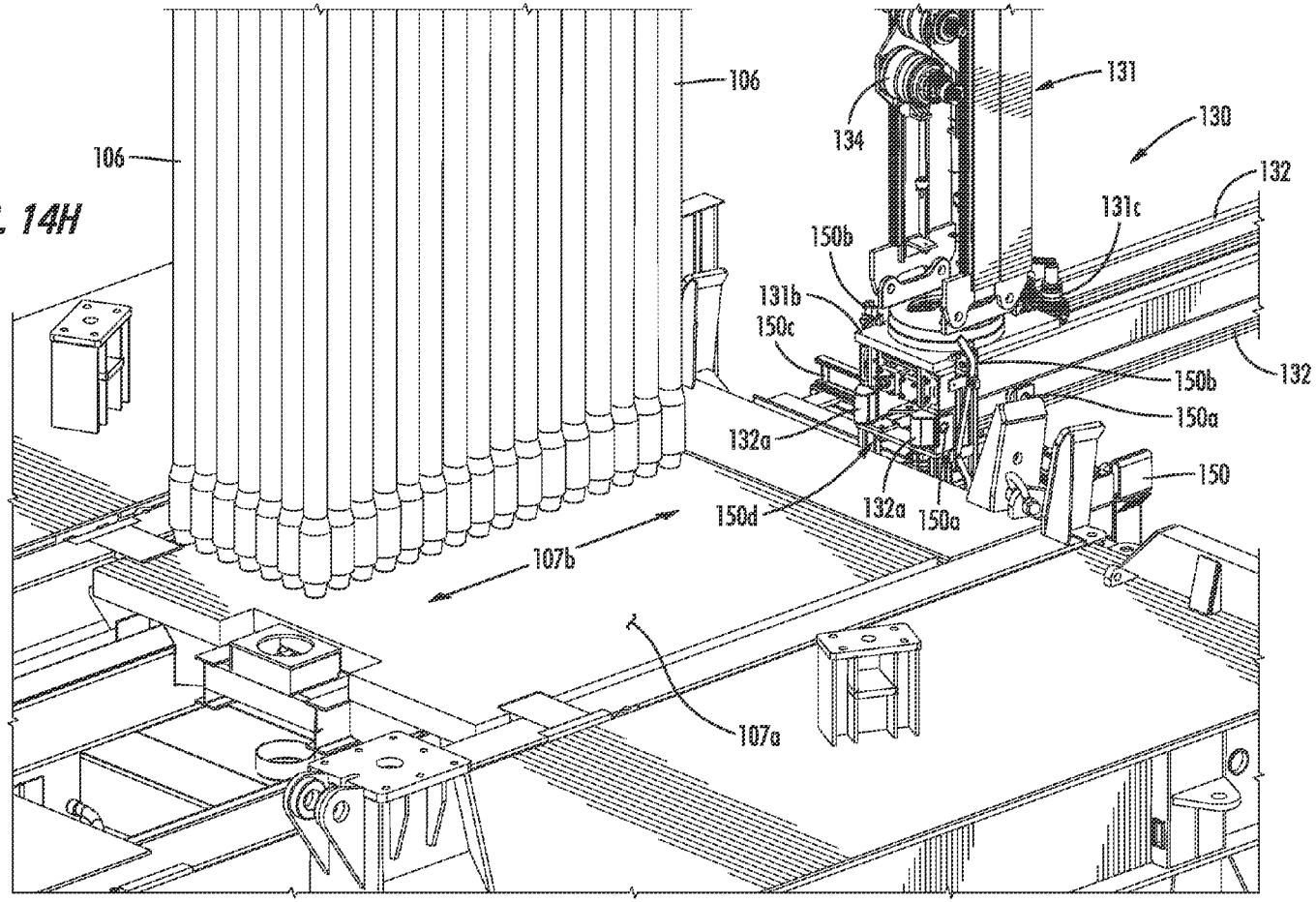

Turning now to FIGS. 14B, 14E, and 14H, the rails 132 have been retracted from the alleyway 107*b* so that they clear the setback area 107*a* and extend across the drill floor extension platform 150 laterally away from the setback side of the drill floor 107. In some embodiments, after the movable pipe handling apparatus 131 has been locked in position above the movable platform carriage 150*d*, the carriage movement means may be used to retract the rails 132 from above the setback area 107*a* and into the position shown in FIGS. 14B, 14E, and 14H. For example, the rails 132 may be retracted by actuating the drive motor 131*c* of the column movement carriage 131*b*, which, as previously described, is engaged with a corresponding rack gear (not shown) on the rails 132. More specifically, since the column movement carriage 131*b* is now locked in place by the carriage locking apparatuses 150*b* on the movable platform carriage 150*d* and the floor mounting connections 132*a* have been detached from the drill floor 107, the drive motor 131*c* therefore acts to move the now-disconnected rails 132 relative to the fixed-in-place column movement carriage 131*b*, rather than moving the column movement carriage 131*b* relative to the rails 132 as would otherwise be the case during normal piping handling operations.

Figure 14I:
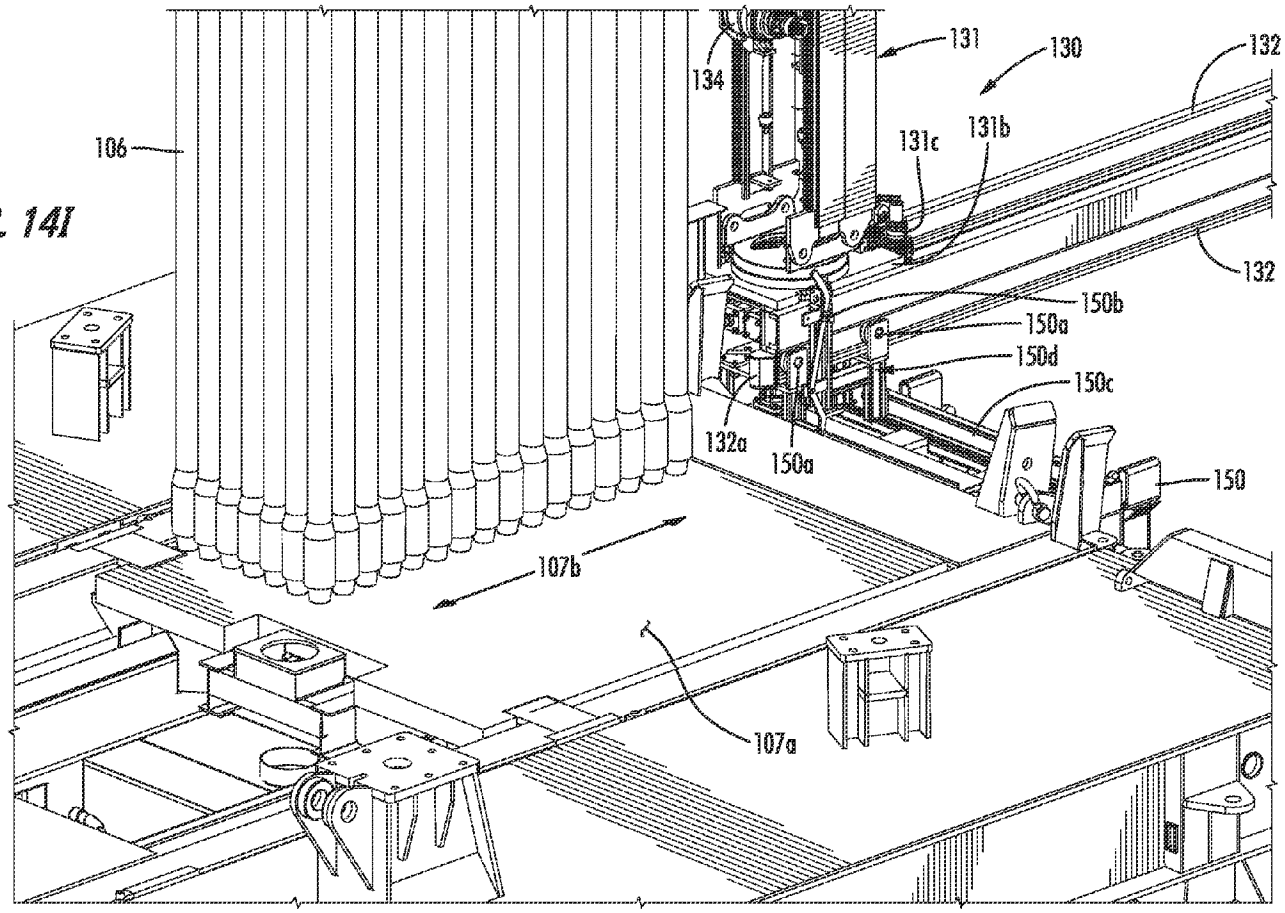

FIGS. 14C, 14F, and 14I illustrate a final step in the illustrative operational sequence that may be used to move the floor mounted racking arm assembly 130 off of the setback area 107*a* and out of the alleyway 107*b* so that other rig activities may be performed, such as those described above. As shown in FIGS. 14C, 14F, and 14I, the movable platform carriage 150*d* may be laterally moved along the platform rails 150*c*, thus clearing a path from the setback side of the drill floor 107 through alleyway 107*b*. The movable platform carriage 150*d* and floor mounted racking arm assembly 130 may be laterally moved as described above in any suitable manner known in the art. For example, in certain embodiments the movable platform carriage 150*d* may be moved by use of a tugger along with appropriate cables and/or pulley mechanisms, which may be connected directly to the movable platform carriage 150*d*, and/or to the movable pipe handling apparatus 131. In other embodiments, the movable platform carriage 150*d* may include a platform carriage drive motor (not shown) and the platform rails 150*c* may include a corresponding rack gear (not shown) that may be configured and arranged in similar fashion to the drive motor 131*c* and rack gear that are used to move the column movement carriage 131*b*. Other means for moving the movable platform carriage 150*d* out from in front of the setback side of the alleyway 107*b* may also be used.

While the exemplary embodiment illustrated in FIGS. 14A-14I depicts a particular configuration of the drill floor extension platform 150 wherein the movable platform carriage 150*d* with the racking arm assembly 130 positioned thereon is moved toward the driller's side of the drill floor 107, it should be appreciated by those of ordinary skill in the art after a complete reading of the present disclosure that the extension platform 150 and the movable platform carriage 150*d* may readily be configured such that the floor mounted racking arm assembly 130 may be moved toward the off-drillers' side of the drill floor 107. Moreover, it should also be appreciated that means other than by way of the movable platform carriage 150*d* may be used so as to move the racking arm assembly 130 from in front of the alleyway 107*b*. For example, in some embodiments the extension platform 150 may be pivotably attached to the rig substructure (not shown) adjacent to the setback side of drill floor 107. In such embodiments, once the rails 132 have been retracted from the alleyway 107*b* so that they clear the setback area 107*a* and extend across the extension platform 150 in the manner described above, the extension platform 150 and racking arm assembly 130 positioned thereabove may then be pivotably rotated away from in front of the alleyway 107*b*, e.g., in a hinged fashion, thus opening up access to the setback area 107*a* for other activities.

Once any necessary support and/or maintenance activities have been completed in the cleared area of the drill floor 107, the floor mounted racking arm assembly 130 may then be moved back into place above the setback area 107*a* and in the alleyway 107*b* by performing a substantially reversed sequence of operations to those used for removing the floor mounted racking arm assembly 130 from the drill floor 107. For example, the movable platform carriage 150*d* may first be laterally moved back into place adjacent to the setback area 107*a*, such that the rails 132 of the floor mounted racking arm assembly 130 are appropriately re-aligned with the alleyway 107*b*. Thereafter, the carriage movement means, e.g., the drive motor 131*c* of the movable pipe handling apparatus 131, may be actuated so as to extend the rails 132 back across the setback area 107*a*, after which the floor mounting connections 132*a* may be re-attached to the drill floor 107 proximate the wellcenter 109. Finally, the carriage locking apparatuses 150*b* may be disengaged from the corresponding position locking mechanisms on either side of the column movement carriage 131*b* so that the drive motor 131*c* can once again be actuated to move the movable pipe handling apparatus 131 along the rails 132, thereby allowing further pipe handling operations to be performed in the manner described above.

Accordingly, the present disclosure describes various methods and systems that may be used for handling drill pipe and other tubular members during drilling and/or workover operations of a well. In certain embodiments, such pipe handling operations may be performed using a floor mounted racking arm assembly that may be adapted to lift and position drill pipe stands in an "offline" manner, that is, without the aid or involvement of a traveling block assembly and the like. Furthermore, the floor mounted racking arm assembly of the present disclosure may also be adapted to handle drill pipe stands that are misaligned with respect to a substantially vertical axis or plane.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown. It is therefore evident that the particular embodiments disclosed above may be altered or modified and all such variations are considered within the scope and spirit of the invention.

What is claimed:

1. A racking arm assembly that is adapted to be mounted on a drill floor of a drilling rig, the racking arm assembly comprising:

a lift arm assembly having a first arm that is movably coupled to a vertical support column, wherein said lift arm assembly is adapted to be raised and lowered along a vertical length of said vertical support column during a pipe handling operation; and a lift jaw assembly pivotably coupled to a second arm of said lift arm assembly, said lift jaw assembly comprising a lift jaw gripping apparatus that is adapted to grip and fixedly hold a drill pipe stand proximate a pin end of said drill pipe stand during said pipe handling operation, wherein said lift jaw gripping apparatus is further adapted to be rotated relative to said lift arm assembly about a substantially horizontal axis while said lift jaw gripping apparatus is fixedly holding said drill pipe stand and when a box end of said drill pipe stand is vertically misaligned at a substantially non-zero misalignment angle relative to said pin end of said drill pipe stand.

2. The racking arm assembly of claim 1, wherein said lift jaw gripping apparatus is adapted to be rotated relative to said lift arm assembly about said substantially horizontal axis at an angle of up to approximately 10°.

3. The racking arm assembly of claim 1, wherein said vertical support column is adapted to be movably coupled to said drill floor.

4. The racking arm assembly of claim 1, further comprising a pipe handling apparatus conveyance system that is adapted to be removably positioned on said drill floor, wherein said vertical support column is movably coupled to said pipe handling apparatus conveyance system.

5. The racking arm assembly of claim 4, wherein said pipe handling apparatus conveyance system is adapted to be removably positioned in an alleyway of a setback area on said drill floor and said vertical column is adapted to move through said alleyway along said pipe handling apparatus conveyance system during said pipe handling operation.

6. The racking arm assembly of claim 4, further comprising a column movement carriage movably coupling said vertical support column to said pipe handling apparatus conveyance system, wherein said column movement carriage is adapted to move said vertical column along said pipe handling apparatus conveyance system during said pipe handling operation.

7. The racking arm assembly of claim 6, further comprising carriage movement means for moving said column movement carriage along said pipe handling apparatus conveyance system.

8. The racking arm assembly of claim 7, wherein said carriage movement means is adapted to retract said pipe handling apparatus conveyance system from said drill floor.

9. A racking arm assembly that is adapted to be mounted on a drill floor of a drilling rig, the racking arm assembly comprising:

a lift arm assembly having a first arm that is movably coupled to a vertical support column, wherein said lift arm assembly is adapted to be raised and lowered along a vertical length of said vertical support column during a pipe handling operation; and a lift jaw assembly pivotably coupled to a second arm of said lift arm assembly, said lift jaw assembly comprising a lift jaw gripping apparatus that is adapted to grip and fixedly hold a drill pipe stand proximate a pin end of said drill pipe stand during said pipe handling operation, wherein said lift jaw gripping apparatus is further adapted to be rotated relative to said lift arm assembly about a substantially horizontal axis while said lift jaw gripping apparatus is fixedly holding said drill pipe stand and when a box end of said drill pipe stand is vertically misaligned at a substantially non-zero misalignment angle relative to said pin end of said drill pipe stand, wherein said racking arm assembly is adapted to vertically lift and laterally move said pin end of said drill pipe stand while an upper pipe handling assembly that is mounted on a drilling mast of said drilling rig is independently maneuvering a box end of said drill pipe stand during said pipe handling operation.

10. The racking arm assembly of claim 9, further comprising lift arm raising means for raising and lowering said lift arm assembly along said vertical length of said vertical support column during said pipe handling operation.

11. A floor mounted racking arm assembly, comprising:

a pipe handling apparatus conveyance system that is adapted to be removably mounted in a mounting position on a drill floor of a drilling rig;

a drill floor extension platform positioned adjacent to said mounting position, wherein said pipe handling apparatus conveyance system is adapted to extend from said mounting position across said drill floor extension platform;

a movable pipe handling apparatus movably coupled to said pipe handling apparatus conveyance system, said movable pipe handling apparatus comprising:

a vertical support column that is rotatably coupled to a column movement carriage, said column movement carriage movably coupling said vertical support column to said pipe handling apparatus conveyance system;

a lift arm assembly having a first arm that is movably coupled to said vertical support column, wherein said lift arm assembly is adapted to be raised and lowered along a vertical length of said vertical support column during a pipe handling operation;

a lift jaw assembly pivotably coupled to a second arm of said lift arm assembly, said lift jaw assembly comprising a lift jaw gripping apparatus that is adapted to grip and fixedly hold a drill pipe stand proximate a pin end of said drill pipe stand during said pipe handling operation, wherein said lift jaw gripping apparatus is further adapted to be rotated relative to said lift arm assembly about a substantially horizontal axis while said lift jaw gripping apparatus is fixedly holding said drill pipe stand; and carriage movement means for moving said movable pipe handling apparatus along said pipe handling apparatus conveyance system during said pipe handling operation, wherein said carriage movement means is adapted to retract said pipe handling apparatus conveyance system from said mounting position when said movable pipe handling apparatus is positioned above said drill floor extension platform.

12. The floor mounted racking arm assembly of claim 11, wherein said mounting position is in an alleyway of a setback area on said drill floor and said movable pipe handling apparatus is adapted to move through said alleyway along said pipe handling apparatus conveyance system during said pipe handling operation.

13. The floor mounted racking arm assembly of claim 11, further comprising a movable platform carriage that is movably coupled to said drill floor extension platform, wherein said movable platform carriage is adapted to move said movable pipe handling apparatus and said pipe handling apparatus conveyance system laterally away from said mounting position of said drill floor after said pipe handling apparatus conveyance system has been retracted from said mounting position.

14. The floor mounted racking arm assembly of claim 13, wherein said pipe handling apparatus conveyance system comprises a plurality of rails, a first end of each of said plurality of rails being adapted to be removably attached to said mounting position of said drill floor and a second end of each of said plurality of rails extending across said drill floor extension platform, said movable platform carriage comprising a plurality of roller guides that are adapted to guide each of said plurality of rails when said plurality of rails are retracted from said mounting position of said drill floor.

15. The floor mounted racking arm assembly of claim 14, wherein said movable platform carriage comprises a carriage locking apparatus that is adapted to lock said column movement carriage into a position above said movable platform carriage prior to retracting said rails from said mounting position of said drill floor.

16. A drilling rig pipe handling system, comprising:

a floor mounted racking arm assembly comprising a pipe handling apparatus conveyance system mounted to a drill floor of a drilling rig and a movable pipe handling apparatus movably coupled to said pipe handling apparatus conveyance system, wherein said movable pipe handling apparatus is adapted to lift a pin end of a drill pipe stand from a setback area of said drill floor and move said pin end proximate a wellcenter of said drilling rig during a pipe handling operation, said movable pipe handling apparatus comprising a lift jaw assembly that is adapted to clamp onto and fixedly hold said drill pipe stand proximate said pin end and a lift arm assembly that is adapted raise and lower said drill pipe stand while said drill pipe stand is fixedly held by said lift jaw assembly; and an upper pipe handling assembly mounted to a drilling mast of said drilling rig in a position that is substantially above said setback area of said drill floor, said upper pipe handling assembly comprising a fingerboard and a drill pipe stand transfer apparatus that is adapted to guide a box end of said drill pipe stand from said fingerboard to said wellcenter of said drilling rig, wherein said lift jaw assembly of said floor mounted racking arm assembly comprises a pinned connection that is adapted to allow a lift jaw gripping apparatus of said lift jaw assembly to pivotably rotate about a substantially horizontal axis to a substantially non-zero misalignment angle relative to a substantially vertical axis while gripping said pin end of said drill pipe stand when said box end of said drill pipe stand that is being handled by said upper pipe handling assembly is vertically misaligned relative to said pin end.

17. The drilling rig pipe handling system of claim 16, wherein said pinned connection of said lift jaw assembly is adapted to allow said lift jaw gripping apparatus to pivotably rotate about said substantially horizontal axis at an angle of up to approximately 10°.

18. The drilling rig pipe handling system of claim 16, wherein said pinned connection of said lift jaw assembly is adapted to allow said floor mounted racking arm assembly to lift said pin end of said drill pipe stand from said setback area and move said pin end proximate said wellcenter of said drilling rig while said box end of said drill pipe stand is positioned in said fingerboard of said upper pipe handling assembly.

19. The drilling rig pipe handling system of claim 16, wherein said pinned connection of said lift jaw assembly is adapted to allow said floor mounted racking arm assembly to grab said pin end of said drill pipe stand at a position proximate said wellcenter of said drilling rig and move said pin end to said setback area while said box end of said drill pipe stand is coupled to a top drive system of drilling rig.

20. The drilling rig pipe handling system of claim 16, wherein said pipe handling apparatus conveyance system is mounted to an alleyway of said setback area of said drill floor.

21. A method for handling drill pipe using the drilling rig pipe handling system of claim 17, the method comprising:

movably coupling said movable pipe handling apparatus to said drill floor of said drilling rig;

moving said movable pipe handling apparatus over said drill floor to a position proximate a drill pipe stand positioned in said setback area of said drill floor;

gripping onto and fixedly holding said drill pipe stand with said lift jaw assembly of said movable pipe handling apparatus proximate a pin end of said drill pipe stand, said lift jaw assembly being coupled to said lift arm assembly of said movable pipe handling apparatus;

lifting said pin end of said drill pipe stand above said setback area with said lift arm while fixedly holding said drill pipe stand with said lift jaw assembly;

moving said movable pipe handling apparatus proximate said wellcenter of said drilling rig while fixedly holding said drill pipe stand with said lift jaw assembly;

positioning said pin end of said drill pipe stand over said wellcenter with said lift arm assembly; and maneuvering a box end of said drill pipe stand from a position in said fingerboard to a position proximate said wellcenter, wherein said box end of said drill pipe stand is vertically misaligned by an angle greater than 0° relative to said pin end of said drill pipe stand while said pin end is being moved proximate said wellcenter by said movable pipe handling apparatus.

22. The method of claim 21, wherein said movable pipe handling apparatus is movably coupled to an alleyway of said setback area of a drill floor of a drilling rig and wherein said movable pipe handling apparatus is moved along said alleyway to said position proximate said drill pipe stand positioned in said setback area of said drill floor.

23. The method of claim 21, wherein said box end of said drill pipe stand is vertically misaligned by an angle greater than approximately 1° and less than approximately 10° relative to said pin end of said drill pipe stand while said pin end is being moved proximate said wellcenter by said movable pipe handling apparatus.

24. The method of claim 21, further comprising, after positioning said pin end of said drill pipe stand over said wellcenter with said lift arm assembly, threadably coupling said pin end of said drill pipe stand to a box end of a drill string positioned in a drilled wellbore.

25. The method of claim 21, wherein moving said box end of said drill pipe stand to said position proximate said wellcenter comprises coupling said box end to a top drive system of said drilling rig.

26. The method of claim 21, wherein said pin end of said drill pipe stand is moved proximate said wellcenter before said box end of said drill pipe stand is moved to said position proximate said wellcenter.

27. The method of claim 21, wherein said pin end of said drill pipe stand is moved proximate said wellcenter after said box end of said drill pipe stand is moved to said position proximate said wellcenter.

28. A lift jaw assembly of a floor mounted racking arm assembly, the lift jaw assembly comprising:

a lift jaw gripping apparatus that is adapted to grip and fixedly hold a pin end of a substantially vertically oriented drill pipe stand while said drill pipe stand is being raised or lowered by said floor mounted racking arm assembly, said lift jaw gripping apparatus comprising a lift jaw frame and a plurality of gripping jaws pivotably coupled to said lift jaw frame, wherein each of said plurality of gripping jaws has a clamping face that is configured to engage with and clamp on an outer diametral surface of a drill pipe stand; and a lift jaw support lug that is adapted to couple said lift jaw assembly to a lift arm assembly of said floor mounted racking arm assembly, wherein said lift jaw support lug is pivotably coupled to said lift jaw gripping apparatus at a pinned connection that is adapted to allow said lift jaw gripping apparatus to pivotably rotate about a substantially horizontal axis relative to said lift jaw support lug and said lift arm assembly from a position wherein said gripping jaws are in a substantially vertical orientation by an angle of up to approximately 10°.

29. The lift jaw assembly of claim 28, wherein said lift jaw gripping apparatus comprises one or more clamp actuating devices, said one or more clamp actuating devices being pivotably coupled to each of said plurality of gripping jaws and adapted to open and close said plurality of gripping jaws.

30. The lift jaw assembly of claim 29, where said one or more clamp actuating devices comprises one of a hydraulic and a pneumatic cylinder.

31. The lift jaw assembly of claim 28, further comprising one or more damping devices pivotably coupled to said lift jaw support lug and said lift jaw gripping apparatus, wherein said one or more damping devices are adapted to maintain said gripping jaws in a substantially vertical orientation when said lift jaw gripping apparatus is not gripping onto or fixedly holding a drill pipe stand.

* * * * *